US009883742B2

(12) United States Patent
Yang et al.

(10) Patent No.: US 9,883,742 B2
(45) Date of Patent: Feb. 6, 2018

(54) SHOWER CADDY WITH SHELF ADJUSTABLY MAOUNTED ALONG AN ELONGATE SUPPORT MEMBER

(71) Applicant: simplehuman, LLC, Torrance, CA (US)

(72) Inventors: Frank Yang, Rancho Palos Verdes, CA (US); Joseph Sandor, Newport Beach, CA (US); Zachary Rapoport, Northridge, CA (US)

(73) Assignee: simplehuman, LLC, Torrance, CA (US)

( * ) Notice: Subject to any disclaimer, the term of this patent is extended or adjusted under 35 U.S.C. 154(b) by 168 days.

(21) Appl. No.: 14/634,408

(22) Filed: Feb. 27, 2015

(65) Prior Publication Data

US 2015/0257533 A1 Sep. 17, 2015

Related U.S. Application Data

(60) Provisional application No. 61/953,376, filed on Mar. 14, 2014.

(51) Int. Cl.

| | |
|---|---|
| ***A47K 1/09*** | (2006.01) |
| ***A47B 57/26*** | (2006.01) |
| ***A47K 3/28*** | (2006.01) |

(52) U.S. Cl.

CPC ..... *A47B 57/26* (2013.01); *A47K 1/09* (2013.01); *A47K 3/281* (2013.01); *A47K 2201/025* (2013.01); *Y10T 29/49826* (2015.01)

(58) Field of Classification Search

CPC ..... A47K 1/09; A47K 3/281; A47B 57/26

See application file for complete search history.

(56) References Cited

U.S. PATENT DOCUMENTS

| | | | |
|---|---|---|---|
| 141,186 | A | 7/1873 | Thomas |
| 163,852 | A | 6/1875 | Denman |
| 181,593 | A | 8/1876 | Randall |

(Continued)

FOREIGN PATENT DOCUMENTS

| | | |
|---|---|---|
| AU | 364938 | 10/2015 |
| AU | 364939 | 10/2015 |

(Continued)

OTHER PUBLICATIONS

Magnite—The Magnetic Shower Caddy by Max Hunt, Coroflot product webpage; available as early as Aug. 10, 2012 [retrieved on Feb. 17, 2015 from internet <URL: http://www.coroflot.com/theha/Magnite-The-Magnetic-Shower-Caddy.

(Continued)

*Primary Examiner* — Michael Safavi

(74) *Attorney, Agent, or Firm* — Knobbe, Martens, Olson & Bear, LLP

(57) ABSTRACT

Various embodiments of shelving systems are disclosed. In some embodiments, the shelving system can include an elongated support member and a plurality of shelves. In certain embodiments, the one or more of the shelves has an accessory. In various embodiments, the accessory has a deployable divider and/or an expandable bottom. Certain embodiments of the shelving system include an attachment mechanism configured to couple a lower portion of the support member to a stationary objection, such as a wall.

40 Claims, 49 Drawing Sheets

(56) References Cited

U.S. PATENT DOCUMENTS 284,090 A 8/1883 Tingle
387,758 A 8/1888 Barnhart
397,558 A 2/1889 Lumley
434,708 A 8/1890 Grier
475,020 A 5/1892 Perry
477,291 A 6/1892 Bomar
496,961 A 5/1893 Trude
527,273 A 10/1894 Fowler
536,272 A 3/1895 Edsall
543,935 A 8/1895 Hostler
612,061 A 10/1898 Shambaugh
613,231 A 11/1898 Bennett
618,425 A 1/1899 Manger
626,739 A * 6/1899 Vanderman ..... A47K 1/09 211/119.009
644,080 A 2/1900 Huebel
661,755 A 11/1900 Cheheyl
799,233 A * 9/1905 Hubbell ..... A47B 49/004 108/105
839,339 A 12/1906 Tuttle
841,866 A 1/1907 Hollis
845,917 A 3/1907 Worley
913,955 A 3/1909 Hansen
970,485 A 9/1910 Frey
1,026,149 A 5/1912 Crane
1,071,428 A 8/1913 Jones
1,254,094 A 1/1918 Vogt
1,446,036 A 2/1923 Dodd
1,478,339 A 12/1923 Jayne
1,511,704 A 10/1924 Buck
1,554,137 A 9/1925 Slifkin
1,582,762 A 4/1926 Klock
1,639,551 A 8/1927 Booth
1,931,321 A 10/1933 Keil
2,012,452 A 8/1935 Littell
2,042,517 A 6/1936 Ellis
2,155,097 A * 4/1939 Mendle ..... A47F 5/06 211/107
2,157,309 A 5/1939 Swedman et al.
2,199,851 A 5/1940 Culver
2,254,770 A 9/1941 Bitney
2,513,889 A 7/1950 Nilsson
2,593,738 A 4/1952 Dollahite
2,675,782 A 4/1954 Lage et al.
2,677,519 A 5/1954 Hobson
2,693,751 A * 11/1954 Allen ..... A47J 37/0878 126/30
2,746,661 A 5/1956 Kaplan
2,788,902 A 4/1957 Nowicki
2,837,219 A 6/1958 Ferdinand et al.
2,868,386 A 1/1959 Seyforth
2,919,873 A 1/1960 Tice
2,923,415 A 2/1960 Brown
2,923,428 A 2/1960 Averill
2,928,512 A 3/1960 Slater et al.
2,932,873 A 4/1960 Reichert
2,936,146 A 5/1960 Wunder
2,937,766 A 5/1960 Penn
2,941,669 A 6/1960 Palay et al.
D188,332 S 7/1960 Salen
D189,722 S 2/1961 Wolf
2,976,003 A 3/1961 Foster
2,977,953 A * 4/1961 Miller ..... A47J 37/0763 126/30
3,035,708 A 5/1962 Freeman
3,043,440 A 7/1962 Berlin
3,059,374 A 10/1962 Bernay
3,088,598 A 5/1963 Werneke
D195,412 S 6/1963 Vernik
3,111,723 A 11/1963 Bates
3,115,107 A 12/1963 Glenny
3,119,496 A 1/1964 Burk
3,124,253 A 3/1964 Pelrich et al.
3,132,609 A 5/1964 Chesley
3,134,474 A * 5/1964 Marchman ..... A47B 21/045 108/59
3,138,260 A 6/1964 Tedrick
3,181,923 A 5/1965 Guillon et al.
3,239,182 A 3/1966 Blanz
3,266,764 A 8/1966 Briles
3,307,710 A 3/1967 Negri
3,319,983 A 5/1967 Zibell
3,323,851 A * 6/1967 Duboff ..... A47B 96/1425 211/107
3,343,685 A 9/1967 Giambalvo
3,471,031 A 10/1969 Coplan
3,533,583 A * 10/1970 Azim ..... F16M 11/08 248/124.2
3,593,857 A 7/1971 Hernes
D222,276 S 10/1971 Hughes
3,641,922 A 2/1972 Nachazel et al.
3,661,121 A 5/1972 Zielin
3,695,455 A 10/1972 Larson
3,710,096 A 1/1973 McFarlin
3,734,439 A 5/1973 Wintz
3,787,078 A 1/1974 Williams
3,789,996 A 2/1974 Stroh
3,791,091 A 2/1974 Albrizzi
3,807,574 A 4/1974 Lanza
3,854,686 A 12/1974 Konstant
3,894,707 A 7/1975 Heard
3,907,119 A 9/1975 Franz
3,923,162 A 12/1975 Hussey
D239,579 S 4/1976 Taub
3,954,182 A 5/1976 McEvers
3,983,823 A 10/1976 McDonnell
3,998,334 A 12/1976 Smith
4,018,019 A 4/1977 Raith et al.
4,033,539 A 7/1977 Bardocz
4,059,915 A 11/1977 Owens
4,096,951 A 6/1978 Menssen
4,106,736 A 8/1978 Becker, III et al.
D250,560 S 12/1978 Gordon
4,154,356 A 5/1979 Schieve
4,192,426 A 3/1980 Gauthier
4,215,840 A 8/1980 Babberl
4,232,790 A 11/1980 Serrano
4,274,400 A 6/1981 Baus
4,310,193 A 1/1982 Kolleas
4,360,283 A 11/1982 Psotta
4,387,811 A 6/1983 Ragir et al.
4,415,091 A 11/1983 Wolff
4,415,211 A 11/1983 Alissandratos
4,428,488 A 1/1984 McAvinn et al.
4,437,450 A 3/1984 Connelly
D273,645 S 5/1984 McEvers
D274,201 S 6/1984 Aaron
4,511,047 A 4/1985 Elinsky
4,541,131 A 9/1985 Sussman
4,559,879 A 12/1985 Hausser
D286,599 S 11/1986 Sussman
D289,353 S 4/1987 Davis et al.
4,664,428 A 5/1987 Bridges
D293,183 S 12/1987 Aaron
4,761,092 A * 8/1988 Nakatani ..... F16B 7/1454 248/188.5
4,771,897 A 9/1988 Ho
4,771,899 A 9/1988 Benedict et al.
4,776,471 A 10/1988 Elkins
4,786,022 A 11/1988 Grieshaber
4,805,784 A 2/1989 Solheim et al.
4,860,909 A 8/1989 Leumi
4,865,283 A 9/1989 Parker
4,869,378 A 9/1989 Miller
4,869,379 A 9/1989 Hawkrige
4,875,593 A 10/1989 Trimble
4,883,399 A 11/1989 MacLean
4,895,331 A 1/1990 Nehls
4,909,467 A 3/1990 Shan-Pao
D314,294 S 2/1991 Axhamre
4,998,647 A 3/1991 Sharp
D315,840 S 4/1991 Emery
5,014,860 A 5/1991 Emery

(56) References Cited

U.S. PATENT DOCUMENTS 5,023,755 A 6/1991 Rosenberg
5,083,670 A 1/1992 Zimmer
D327,187 S 6/1992 Swon
5,127,528 A 7/1992 Cone
5,160,101 A 11/1992 Ferraro et al.
5,165,644 A 11/1992 Allen
5,180,067 A 1/1993 Conaway et al.
5,190,170 A 3/1993 Steiner
5,192,427 A 3/1993 Eger et al.
5,197,614 A 3/1993 Dalton et al.
D340,604 S 10/1993 Conaway et al.
5,255,401 A 10/1993 Sambrookes et al.
5,284,260 A 2/1994 Caligiuri, Sr.
5,307,797 A 5/1994 Kleefeld
5,318,175 A 6/1994 Stevens
D351,750 S 10/1994 Sweeney
D351,751 S 10/1994 Brightbill et al.
5,355,867 A 10/1994 Hall et al.
5,429,252 A 7/1995 Liu
5,462,178 A 10/1995 Wallach et al.
5,483,761 A 1/1996 Simpson
5,505,318 A 4/1996 Goff
5,505,319 A 4/1996 Todd, Jr.
D370,809 S 6/1996 Munoz et al.
D370,810 S 6/1996 Munoz
D371,031 S 6/1996 Munoz et al.
5,524,772 A 6/1996 Simmons
5,527,273 A 6/1996 Manna et al.
D376,941 S 12/1996 Munoz et al.
5,588,543 A 12/1996 Finger
D377,286 S 1/1997 Munoz
D378,556 S 3/1997 Munoz
5,620,105 A 4/1997 Macek
5,632,049 A 5/1997 Chen
D382,733 S 8/1997 Goetz
5,666,940 A 9/1997 Kreiter
D387,595 S 12/1997 Whang
5,692,817 A 12/1997 Jun et al.
5,697,508 A 12/1997 Rifkin et al.
5,702,010 A 12/1997 Liang
D388,642 S 1/1998 Winter
5,735,413 A 4/1998 Allen
5,772,048 A 6/1998 Sopcisak
5,772,050 A 6/1998 Shih
D395,773 S 7/1998 Hofman
D396,379 S 7/1998 Stoetzl
D396,585 S 8/1998 Hofman
D397,567 S 9/1998 Hofman
D400,745 S 11/1998 France
5,833,192 A 11/1998 Buhrman
D402,145 S 12/1998 Hofman et al.
5,855,184 A 1/1999 Eichler et al.
5,855,286 A 1/1999 Zaid
5,897,002 A 4/1999 Carlino
D409,424 S 5/1999 Hofman et al.
5,899,423 A 5/1999 Albertini
5,934,636 A * 8/1999 Cyrell ..... A47B 57/56 248/220.21
5,941,397 A 8/1999 Buchanan et al.
5,944,896 A 8/1999 Landesman et al.
5,984,114 A 11/1999 Frankel
D417,991 S 12/1999 Hofman et al.
D419,020 S 1/2000 Emery et al.
6,017,009 A 1/2000 Swartz et al.
D421,692 S 3/2000 Wojtowicz et al.
D421,867 S 3/2000 Carville et al.
6,050,426 A 4/2000 Leurdijk
D424,355 S 5/2000 Barton
6,065,618 A 5/2000 Stetler
D427,469 S 7/2000 Thurston-Chartraw et al.
D429,091 S 8/2000 Chen
D429,934 S 8/2000 Hofman
6,113,042 A 9/2000 Welsch et al.
6,119,878 A 9/2000 Zen
6,123,303 A 9/2000 Huang
6,135,668 A 10/2000 Lin
6,152,312 A 11/2000 Nava et al.
6,206,206 B1 3/2001 Saylor et al.
6,233,877 B1 5/2001 Monroe
D443,162 S 7/2001 Winter
D444,333 S 7/2001 Ferrer Beltran
D446,670 S 8/2001 Emery et al.
6,302,036 B1 10/2001 Carson et al.
6,302,280 B1 10/2001 Bermes
6,311,856 B2 11/2001 Battaglia et al.
6,318,572 B1 11/2001 Lai
6,347,777 B1 * 2/2002 Webber ..... A47C 7/402 248/188.5
6,378,709 B1 4/2002 Stuart
6,394,404 B1 5/2002 Cyrell
6,409,029 B1 6/2002 Bermes
D462,552 S 9/2002 Emery et al.
6,481,586 B1 11/2002 Hoff
6,494,327 B2 12/2002 Huang
6,502,794 B1 1/2003 Ting
D470,703 S 2/2003 Hoernig
6,520,351 B1 2/2003 Zadro
6,527,473 B2 3/2003 Chen
D472,750 S 4/2003 Clucas
D473,084 S 4/2003 Suero, Jr.
D473,411 S 4/2003 Walker
6,540,430 B2 4/2003 Hsu
6,550,739 B1 * 4/2003 Brindisi ..... A47G 1/1613 248/476
6,551,226 B1 4/2003 Webber et al.
D475,560 S 6/2003 Suero, Jr.
D475,561 S 6/2003 Suero, Jr.
6,575,315 B2 6/2003 Zidek
6,581,790 B1 6/2003 Zadro
6,591,996 B1 7/2003 Wu
D477,947 S 8/2003 Snell
D479,073 S 9/2003 Snell
D479,074 S 9/2003 Snell
6,619,164 B1 9/2003 Ricci et al.
6,648,152 B2 11/2003 Bermes
D483,251 S 12/2003 Suero, Jr.
D485,462 S 1/2004 Suero, Jr.
6,688,238 B1 2/2004 Alexiou
6,726,034 B2 4/2004 Holbrook et al.
D489,207 S 5/2004 Rosen
D492,188 S 6/2004 Goldberg
6,758,355 B2 7/2004 Zidek
D493,991 S 8/2004 Dretzka
D495,549 S 9/2004 Yu et al.
D496,549 S 9/2004 Snell
D498,102 S 11/2004 Snell
6,824,000 B2 11/2004 Samelson
6,824,225 B2 11/2004 Stiffler
6,848,144 B1 2/2005 McDonald
6,871,748 B2 3/2005 Suttles
6,918,498 B2 7/2005 Sparkowski
D509,361 S 9/2005 Suero, Jr.
6,957,794 B2 10/2005 Landreville et al.
D512,861 S 12/2005 Rosen
6,983,853 B1 * 1/2006 Fickett ..... A47F 5/04 211/18
D516,901 S 3/2006 Murray
7,021,814 B2 4/2006 Berardi
7,059,271 B2 6/2006 Santa Cruz et al.
7,086,633 B2 8/2006 Welch et al.
D530,551 S 10/2006 Snell
D533,283 S 12/2006 Holztrager
D534,062 S 12/2006 van den Bosch
7,152,488 B2 12/2006 Hedrich et al.
7,195,213 B2 3/2007 Weatherly
D543,747 S 6/2007 Harwanko
D544,786 S 6/2007 Barrese
7,229,059 B1 6/2007 Hood
D546,879 S 7/2007 Qiu
7,246,711 B1 7/2007 Metcalf
7,255,312 B2 8/2007 Melic
D552,391 S 10/2007 Rosen
D552,392 S 10/2007 Rosen
D552,393 S 10/2007 Rosen

(56) References Cited

U.S. PATENT DOCUMENTS

| | | | |
|---|---|---|---|
| 7,275,647 | B1 | 10/2007 | Thompson |
| D557,050 | S | 12/2007 | Dretzka |
| 7,316,376 | B1 | 1/2008 | Engler |
| D562,608 | S | 2/2008 | Kramer |
| D562,609 | S | 2/2008 | Kramer |
| D564,257 | S | 3/2008 | Yang et al. |
| 7,347,197 | B2 | 3/2008 | Hankinson |
| D566,991 | S | 4/2008 | Harwanko |
| D568,657 | S | 5/2008 | Snider |
| D568,658 | S | 5/2008 | Yang et al. |
| D569,148 | S | 5/2008 | Yang et al. |
| D569,149 | S | 5/2008 | Walker |
| D572,060 | S | 7/2008 | Snider |
| D572,502 | S | 7/2008 | Yang et al. |
| D572,516 | S | 7/2008 | Snider |
| D573,386 | S | 7/2008 | Clucas |
| D573,387 | S | 7/2008 | Walker |
| D573,822 | S | 7/2008 | Yang et al. |
| 7,398,790 | B2 | 7/2008 | Glatz |
| 7,401,754 | B2 | 7/2008 | Welch et al. |
| D574,649 | S | 8/2008 | Snider |
| D574,650 | S | 8/2008 | Snider |
| D575,087 | S | 8/2008 | Ghiorghie |
| 7,407,060 | B2 | 8/2008 | Swartz et al. |
| D578,815 | S | 10/2008 | Dominique et al. |
| D579,254 | S | 10/2008 | Dominique et al. |
| D587,504 | S | 3/2009 | Russell et al. |
| D589,728 | S | 4/2009 | Shaha et al. |
| D598,688 | S | 8/2009 | Yang et al. |
| 7,591,385 | B2 | 9/2009 | Brooks |
| D615,333 | S | 5/2010 | Snell |
| D616,235 | S | 5/2010 | Guindi |
| D617,128 | S | 6/2010 | Guindi |
| D622,990 | S | 9/2010 | Yang et al. |
| D627,969 | S | 11/2010 | Klein et al. |
| D628,385 | S | 12/2010 | Klein et al. |
| D628,841 | S | 12/2010 | Yang et al. |
| D632,081 | S | 2/2011 | Klein et al. |
| D632,514 | S | 2/2011 | Didehvar et al. |
| D635,807 | S | 4/2011 | Lindo |
| D640,488 | S | 6/2011 | Didehvar et al. |
| D641,191 | S | 7/2011 | Walker |
| D641,193 | S | 7/2011 | Vaccaro |
| 7,975,653 | B2 | 7/2011 | Cash |
| D644,050 | S | 8/2011 | Cittadino |
| D651,837 | S | 1/2012 | Yang et al. |
| D651,838 | S | 1/2012 | Yang et al. |
| 8,225,946 | B2 | 7/2012 | Yang et al. |
| D670,520 | S | 11/2012 | Gilbert |
| D676,696 | S | 2/2013 | Primeau |
| D677,956 | S | 3/2013 | Tawil |
| D677,957 | S | 3/2013 | Tawil |
| 8,408,405 | B2 | 4/2013 | Yang et al. |
| D683,165 | S | 5/2013 | Yang et al. |
| 8,474,632 | B2 | 7/2013 | Yang et al. |
| D694,548 | S | 12/2013 | Snell |
| D698,575 | S | 2/2014 | Tawil |
| D699,478 | S | 2/2014 | Snider |
| 8,763,821 | B2 | 7/2014 | Yang et al. |
| 8,845,045 | B2 | 9/2014 | Stubblefield |
| 8,950,599 | B2 | 2/2015 | Wilder |
| D726,441 | S | 4/2015 | Yang et al. |
| D727,060 | S | 4/2015 | Yang et al. |
| D734,956 | S | 7/2015 | Yang et al. |
| D753,411 | S | 4/2016 | Yang et al. |
| 9,339,151 | B2 | 5/2016 | Yang et al. |
| D769,641 | S | 10/2016 | Yang et al. |
| D770,197 | S | 11/2016 | Yang et al. |
| D770,198 | S | 11/2016 | Yang et al. |
| 2001/0004064 | A1 | 6/2001 | Battaglia et al. |
| 2002/0158033 | A1 | 10/2002 | Chen |
| 2002/0172549 | A1 | 11/2002 | Koros et al. |
| 2003/0000905 | A1 | 1/2003 | Zidek |
| 2003/0132181 | A1 | 7/2003 | Saulnier-Matteini |
| 2003/0136782 | A1 | 7/2003 | Dicello et al. |
| 2003/0222191 | A1 | 12/2003 | Tsai |
| 2004/0188369 | A1 | 9/2004 | Yu |
| 2004/0188577 | A1 | 9/2004 | Gaderick |
| 2005/0040301 | A1 | 2/2005 | Walter |
| 2005/0139562 | A1 | 6/2005 | Chen |
| 2005/0205509 | A1 | 9/2005 | Flynn |
| 2005/0205722 | A1 | 9/2005 | Krueger |
| 2006/0038097 | A1 | 2/2006 | Diller |
| 2006/0124812 | A1 | 6/2006 | Berardi |
| 2006/0130381 | A1 | 6/2006 | Caterinacci |
| 2006/0180561 | A1 | 8/2006 | Wisnoski et al. |
| 2006/0261022 | A1 | 11/2006 | Sampaio |
| 2007/0045208 | A1 | 3/2007 | Quan |
| 2007/0194191 | A1 | 8/2007 | Persson |
| 2007/0235611 | A1 | 10/2007 | Riblet |
| 2007/0295681 | A1 | 12/2007 | Colin |
| 2008/0053935 | A1 | 3/2008 | Newbouild et al. |
| 2008/0142669 | A1 | 6/2008 | Zlotocha |
| 2009/0134290 | A1 | 5/2009 | Begic et al. |
| 2009/0188880 | A1 | 7/2009 | Yang et al. |
| 2010/0000449 | A1 | 1/2010 | Botkin |
| 2012/0091088 | A1 | 4/2012 | Didehvar et al. |
| 2013/0313212 | A1 | 11/2013 | Lindo et al. |
| 2014/0319083 | A1 | 10/2014 | Stark |
| 2015/0257534 | A1 | 9/2015 | Yang et al. |
| 2016/0120303 | A1* | 5/2016 | Constantino ..... F16M 11/42 108/28 |
| 2016/0183737 | A1 | 6/2016 | Yang et al. |

FOREIGN PATENT DOCUMENTS

| | | | |
|---|---|---|---|
| AU | 364940 | | 10/2015 |
| CA | 132180 | | 7/2010 |
| CA | 135666 | | 3/2011 |
| CA | 136936 | | 3/2011 |
| CA | 158594 | | 12/2015 |
| CA | 164018 | | 3/2016 |
| CA | 164019 | | 3/2016 |
| CA | 164017 | | 4/2016 |
| CN | 301523949 | S | 4/2011 |
| CN | 301642065 | S | 8/2011 |
| CN | 301735061 | S | 11/2011 |
| CN | 303191392 | S | 4/2015 |
| CN | 303649072 | S | 4/2016 |
| CN | 303649076 | S | 4/2016 |
| CN | 303662895 | S | 5/2016 |
| CN | 303662896 | S | 5/2016 |
| CN | 106132260 | A | 11/2016 |
| DE | 29600613 | U1 | 3/1996 |
| EP | 0 717 947 | A2 | 6/1996 |
| EP | 2191757 | | 6/2010 |
| EP | 001217053 | | 8/2010 |
| EP | 001232896 | | 10/2010 |
| EP | 001232912 | | 10/2010 |
| EP | 001420582-0001 | | 11/2014 |
| EP | 001438428-0001 | | 8/2015 |
| EP | 001438394-0001 | | 11/2015 |
| EP | 001438410-0001 | | 11/2015 |
| FR | 2549361 | | 1/1985 |
| JP | D1136196 | | 1/2002 |
| KR | 2003093290000 | | 3/2003 |
| WO | WO 2009/097298 | | 8/2009 |
| WO | WO 2013/005462 | A1 | 1/2013 |
| WO | WO 2015/138257 | A1 | 9/2015 |

OTHER PUBLICATIONS

White Adjustable Shower Caddy, Simplehuman SKU# BT1015, available at least as early as Dec. 14, 2007 on the internet at www.simplehuman.com (see http://web.archive.org/web/20071221125437/www.simplehuman.com/products/bathroom-organization/white-shower-caddy.html).

* cited by examiner

SHOWER CADDY WITH SHELF ADJUSTABLY MAOUNTED ALONG AN ELONGATE SUPPORT MEMBER

CROSS-REFERENCE

This application claims the priority benefit under 35 U.S.C. § 119(e) of U.S. Provisional Application No. 61/953,376, filed Mar. 14, 2014, the entirety of which is hereby incorporated by reference. This application also hereby incorporates by reference in their entirety U.S. application Ser. Nos. 29/518,327 and 29/518,332, both filed Feb. 23, 2015.

BACKGROUND

Field

This disclosure is generally related to devices that can be used for storing and/or organizing personal articles, and specifically to shelving systems.

Description of the Related Art

Certain shelving devices, such as those commonly known as "shower caddies," are used in a shower or bath enclosure to store and organize personal care articles, such as shampoo, soap, razors, toothbrushes, bath sponges, etc. Shower caddies typically include shelves or baskets for holding the personal care items. The collection of personal care articles on the shelving can sometimes appear cluttered or disorganized. Some shower caddies are configured to hang and thus can be called "hanging shower caddies."

SUMMARY

In accordance with some embodiments, a shelving system can comprise at least one elongated support member configured to be positionable in an orientation such that it is elongated in a generally vertical direction. The at least one elongated support member can also comprise at least one channel. The channel can extend along a rear wall of the support member. In some variants, one or more channels extend along lateral edges of the support member. At least one member can be configured to support an article for drying. A connecting mechanism can be configured to releasably connect the at least one member to the elongated support member. The connecting mechanism can comprise first and second engaging members, each of the first and second engaging members can be pivotally mounted relative to the at least one elongated support member and comprising a control portion and an engaging portion. The engaging portions can be configured to extend into at least one of the channels. The connecting mechanism can comprise a biasing device configured to bias the first and second engaging members toward a position in which the engaging portions extend into at least one channel. At least one of the biasing member and the engaging portions can be configured to engage the at least one channel with sufficient force to support the at least one member with at least one wet article supported by the at least one member.

In accordance with some embodiments, a drying rack can comprise at least one member configured to support an article for drying. A connecting mechanism can be configured to releasably connect the at least one member to an elongated vertical support member having first and second elongated vertical channels. The connecting mechanism can further comprise first and second engaging members. Each of the first and second engaging members can be pivotally mounted relative to the at least one member and can comprise a control portion and an engaging portion. Each of the engaging portions can be configured to extend into one of the first and second elongated vertical channels. The connecting mechanism can further comprise a biasing device configured to bias the first and second engaging members toward a position in which the engaging portions extend into the first and second vertical channels. At least one of the biasing member and the engaging portions can be configured to engage the first and second vertical channels with sufficient force to support the at least one member with at least one wet article supported by the at least one member.

In accordance with some embodiments, a shelving system can comprise a support member having a first end, a second end, and a longitudinal axis. At least one shelf can be slidably connected to the support member with a connection mechanism. The connection mechanism can be configured to allow the at least one shelf to be adjusted in a first direction generally parallel to the longitudinal axis and in a second direction substantially perpendicular to the longitudinal axis with respect to the support member.

In accordance with some embodiments, a shelving system for a shower can comprise a central portion having a top end and a bottom end, wherein the central portion comprises at least one shelf. An upper attachment device can be configured to hang the central portion within a shower. A lower attachment device can be connected to the bottom end, wherein the lower attachment device is configured to be adjustable in at least a generally horizontal direction.

In accordance with some embodiments, a shower organizer can comprise an elongated element having a longitudinal axis, a first end, and a second end. A connector can have an aperture configured to fit around a shower head pipe. At least one shelf can be mounted on the elongated element. A resilient member can be disposed in the aperture so as to lie between an outer surface of a shower head pipe and an inner surface of the aperture when the connector is disposed around a shower head pipe.

In accordance with some embodiments, a shower caddy can comprise an elongated central support member with a longitudinal axis. The central support member can have a generally I-shaped cross-section, comprising at least a first flange with first and second lateral edges. At least first and second shelves can be provided, wherein each of the first and second shelves can have at least first and second cross members extending generally laterally across the respective shelves.

At least first and second clamp mechanisms can releasably connect the first and second shelves, respectively, to the central support member. In some embodiments, each of the first and second clamp mechanisms can comprise a clamp body with first and second hooks configured to engage the first and second lateral edges of the first flange. In certain variants, the clamp mechanisms can each have a clamp plate disposed at least partially in the clamp body and configured to rest against the first and second cross members, and a lever member having a cam. The lever member can be configured to pivot between locked and unlocked positions, wherein in the locked position, the cam presses the clamp plate against the cross members and causes the first and second hooks to press against the first and second lateral edges, respectively, with sufficient force to support the weight of the shelf.

A first connector device can be disposed at an upper end of the central support member. The first connector can have a first portion fixed to the upper end of the support and a second portion pivotally connected to the first portion so as to be pivotable between open and closed positions. The first and second portions can have an aperture configured to fit around a shower head pipe when in the closed position. A second connector device can comprise a suction cup pivotally mounted to a lower end of the central support member so as to be pivotable about a pivot axis extending generally perpendicular to the longitudinal axis.

Certain embodiments include an attachment system for a hanging shower caddy. The attachment system comprising can include a bracket connected to a pivot point at a bottom end of an elongate support member of the shower caddy. The bracket can have a magnetic portion, which can be a central portion. The bracket can include an outwardly extending arm. The arm can be configured to rotate freely about the pivot point. The bracket can include a connection member, such as a suction cup, attached to the arm. In some embodiments, the attachment system includes a hub configured to couple with a shower wall, such as with adhesive tape. The hub can be magnetic. The hub can have a front and a rear. The front can be configured to couple (e.g., magnetically) with the central portion of the bracket. The rear can have a generally planar surface configured to engage an adhesive material, an outer wall, and a recess. The recess can be located radially between the generally planar surface and the outer wall. The recess can be configured to receive a sealant material.

In some implementations, the attachment system includes a plurality of arms and a plurality of connection member, each of the arms comprising at least one of the connection members. In some implementations, the arm is rotatable 360° around the pivot point. In certain embodiments, the outer wall comprises a generally planar surface that is generally parallel with and/or not coplanar with the generally planar surface of the central portion. Some embodiments include a distance adjustment unit that includes an adjustment member configured to vary the distance between the support member and the hub. The adjustment member can include a threaded member. In various embodiments, the hub comprises a magnet.

According to certain embodiments, a method of securing a hanging shower caddy includes adhering an adhesive to a wall of the shower and adhering a magnetic hub to the adhesive. The method can include attaching an upper portion of the shower caddy to a pipe such that the weight of the shower caddy is supported from the pipe. The shower caddy can include an elongate support member, at least one shelf, and an attachment assembly. The attachment assembly can be located at a lower end of the shower caddy. In some embodiments, the method includes magnetically coupling the magnetic hub with the attachment assembly of the shower caddy, thereby securing the lower end of the shower caddy relative to the wall. In some variants, such as embodiments in which the shower caddy includes a pivoting arm with a suction cup, the method includes rotating the pivoting arm and connecting the suction cup with the wall. In some implementations, the method includes inserting a sealant material into a recess in the magnetic hub. Some variants include adjusting an adjustment member of the attachment assembly, thereby changing the distance between the attachment assembly and the wall of the shower. In certain embodiments, the method includes adjusting an adjustment member comprises rotating a threaded pin.

BRIEF DESCRIPTION OF THE DRAWINGS

Certain features, aspects, and advantages of the subject matter disclosed herein are described below with reference to the drawings, which are intended to illustrate and not to limit the scope of the disclosure. Various features of different disclosed embodiments can be combined to form additional embodiments, which are part of this disclosure. No structures, features, steps, or processes are essential or critical.

DETAILED DESCRIPTION OF CERTAIN EMBODIMENTS

Various improved shelving systems, such as shower caddies, are disclosed. The embodiments disclosed below are described in the context of a shower caddy due to particular utility in that context. However, the inventions disclosed herein can also be applied to other types of shelving units and other types of environments.

FIGS. 1-10

FIGS. 1-10 illustrate an embodiment of a shower caddy 10. The shower caddy 10 can have a support member 12 configured to support at least one shelf 16. In some embodiments, the support member 12 can be in the form of an elongated member. The support member 12 can have various cross-sectional shapes such as generally: circular, elliptical, triangular, rectangular, square, diamond-shaped, hexagonal, or otherwise. Certain embodiments have an I-beam cross-sectional shape.

Figure 2:
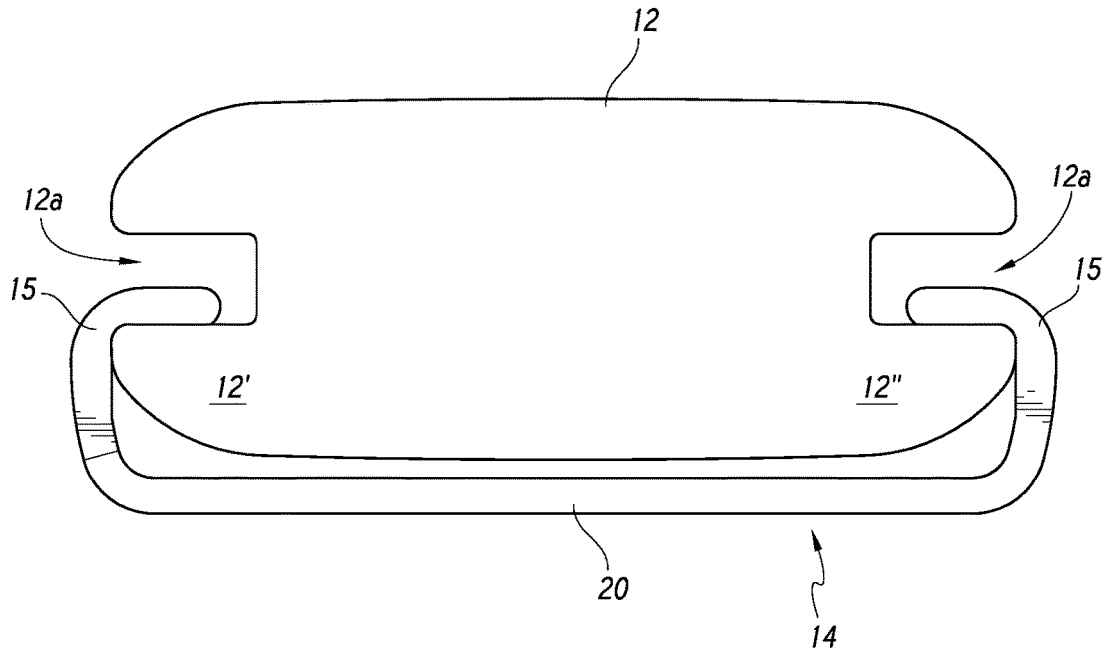
FIG. 2 is a schematic cross-sectional view of a portion of the central support member and a portion of a clamp that can be used to secure a shelf to the central support member.

FIG. 2 is a cross-sectional view of a portion of the support member 12 and a portion of a clamping mechanism 14 for securing a shelf 16 on the support member 12. As shown in FIG. 2, the cross-sectional shape of the support member 12 can be in the shape of the letter "I." In some embodiments, the support member 12 can be formed of satin aluminum that is bead blasted with clear anodizing. The support member 12 may be constructed of other suitable materials, such as steel, stainless steel, or any other metal, plastics, wood, or any other material. As shown, the support member 12 can include one or more tracks 12*a* (e.g., channels, grooves, etc.).

As will be described in more detail below, the clamping mechanism 14 can be configured to allow a user to adjust a position of the shelf 16 in addition to holding it in place on the support member 12. In some embodiments, the shelf 16 can be adjusted both in the horizontal and vertical directions. This provides advantages in that the shelves can be positioned to accommodate other devices or appliances that may be in a user's shower, as well as various sizes of items, such as toiletries, that may be oversized.

The clamping mechanism 14 can be slidably mounted on the support member 12 in the vertical or longitudinal direction. As shown in FIG. 2, the clamping mechanism 14 can have a hook 15 on both lateral sides that is configured to fit around and engage the outer flanges 12', 12" of the column 12. As described in more detail below, the shelf 16 can be adjusted, in both the horizontal and vertical directions, when the clamping mechanism 14 is loosened. When the clamping mechanism 14 is tightened, the shelf 16 is secured to the support member 12 in a fixed position. Thus, the clamping mechanism 14 can be configured to hold the shelf 16 in place when the shelf 16 is loaded with the maximum design weight, and in wet environments, such as a shower.

Figure 3:
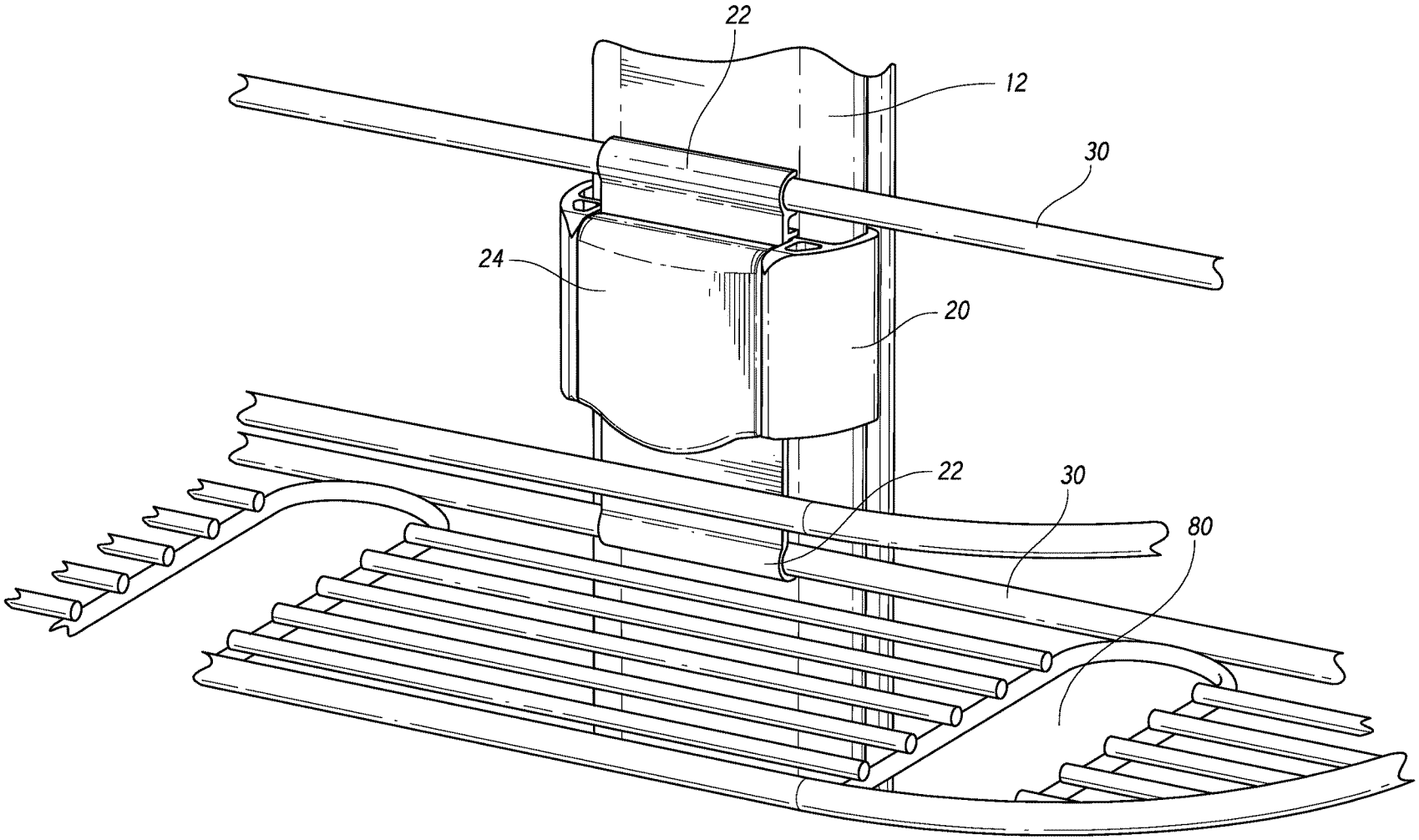
FIG. 3 is an enlarged front, top, and left side perspective view of a portion of a shelf and a clamping mechanism of the shower caddy.
Figure 4A:
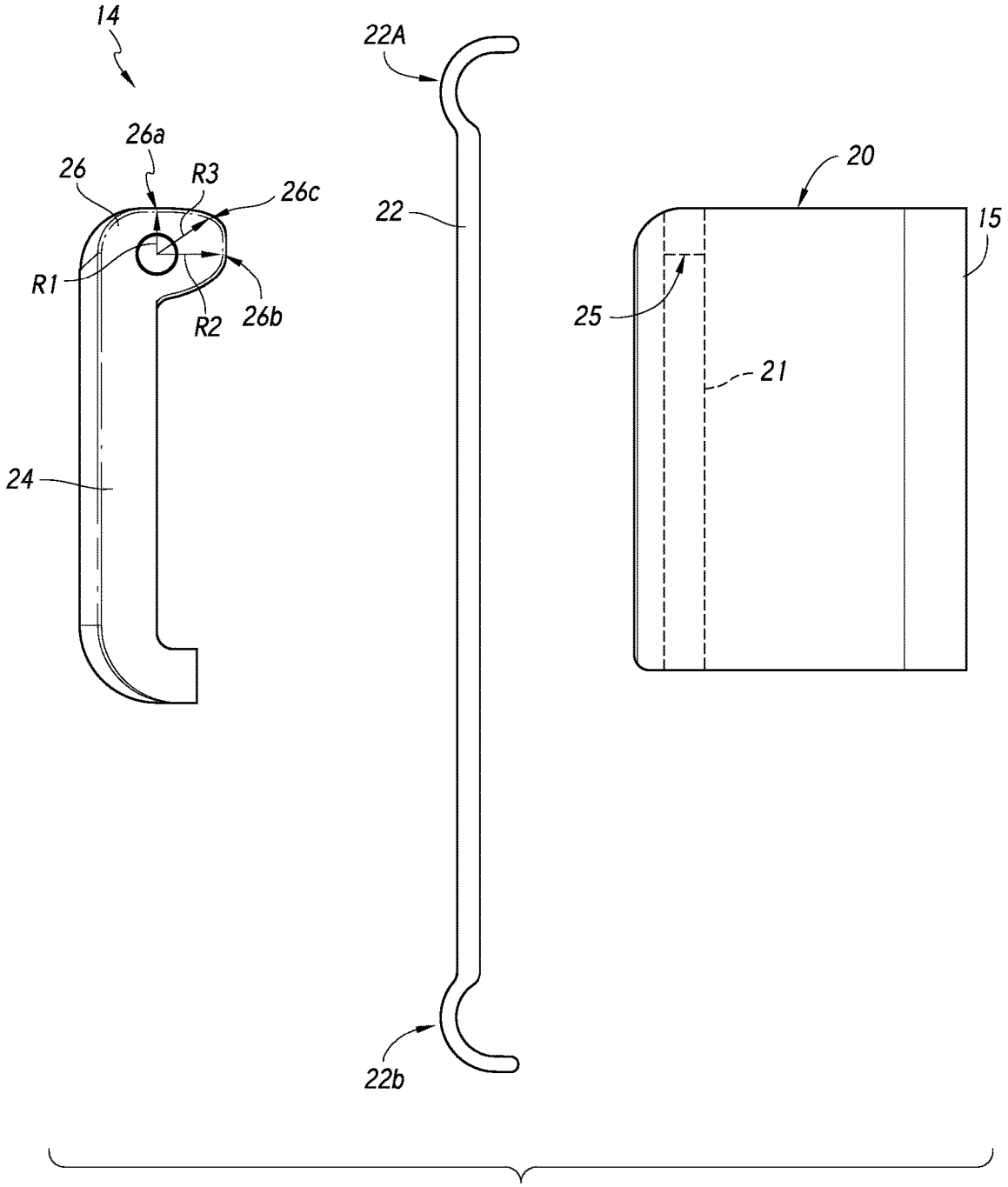
FIG. 4*a* is an exploded schematic side view of the clamping mechanism.
Figure 4B:
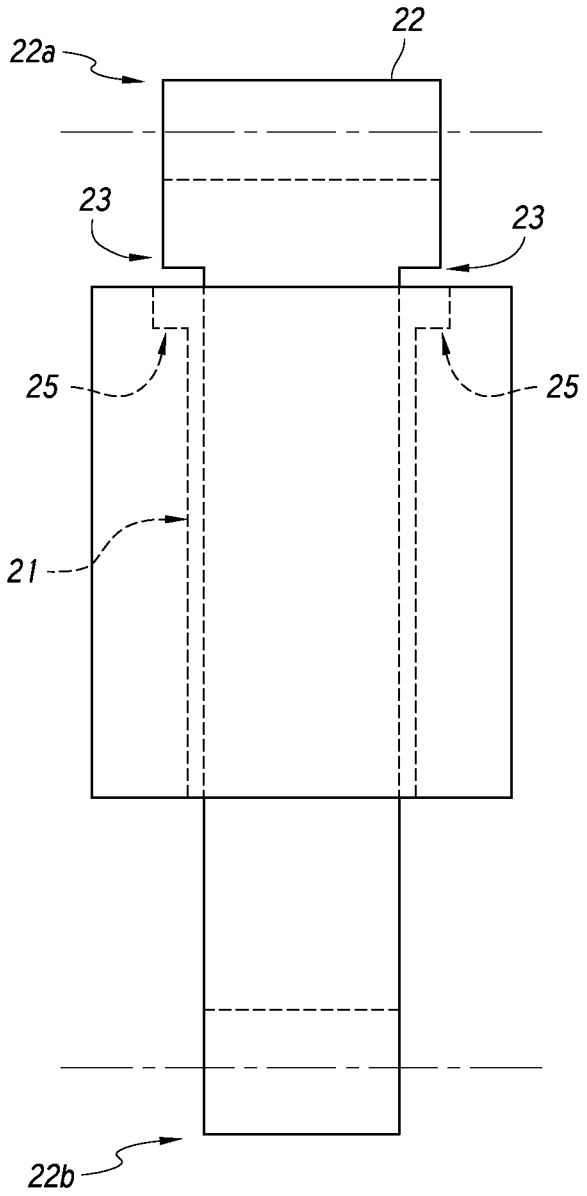
FIG. 4*b* is an exploded schematic front elevation view of the clamping mechanism.

With reference to FIGS. 3-5, the clamping mechanism 14 can include a clamp body 20, clamp plate 22, and clamp lever 24. The clamp body 20 can have hooks 15 on both sides, as noted above, that are configured to hook around and engage the outer flanges 12', 12" of the support member 12, as shown in FIGS. 2 and 3. The clamp body 20 can include a slot 21 configured to receive the clamp plate 22. In some embodiments, the slot 21 can be configured to support the clamp plate 22 within the slot, as described in greater detail below with reference to FIG. 4*b*.

The clamp plate 22 can be a generally flat member that is configured to fit through the slot 21 in the clamp body 20. As shown in FIGS. 3-5*c*, the clamp plate 22 can be configured to engage at least one cross member 30 of the shelf 16. For example, the clamp plate 22 can have upper and lower shoulders 22*a*, 22*b* or rounded portions that are shaped to engage cross members 30 of the shelf 16 when the clamping mechanism 14 is in the "closed" position (as explained in more detail below).

In some embodiments, the clamp plate 22 can be configured to engage the slot 21 so as to prevent the clamp plate 22 from falling through the slot 21, for example, when the clamp mechanism 14 is open. For example, with reference to FIG. 4*b*, the clamp plate 22 can include at least one shoulder configured to rest against a corresponding shoulder in or around the slot 21.

In some embodiments, the plate 22 can include shoulders 23. The shoulders 23 can be arranged to protrude outwardly from the main portion of the clamp plate 22. The clamp body 20 can include shoulders 25 configured to rest against the shoulders 23 so as to prevent the clamp plate 22 from falling through the clamp body 20.

Figure 5A:
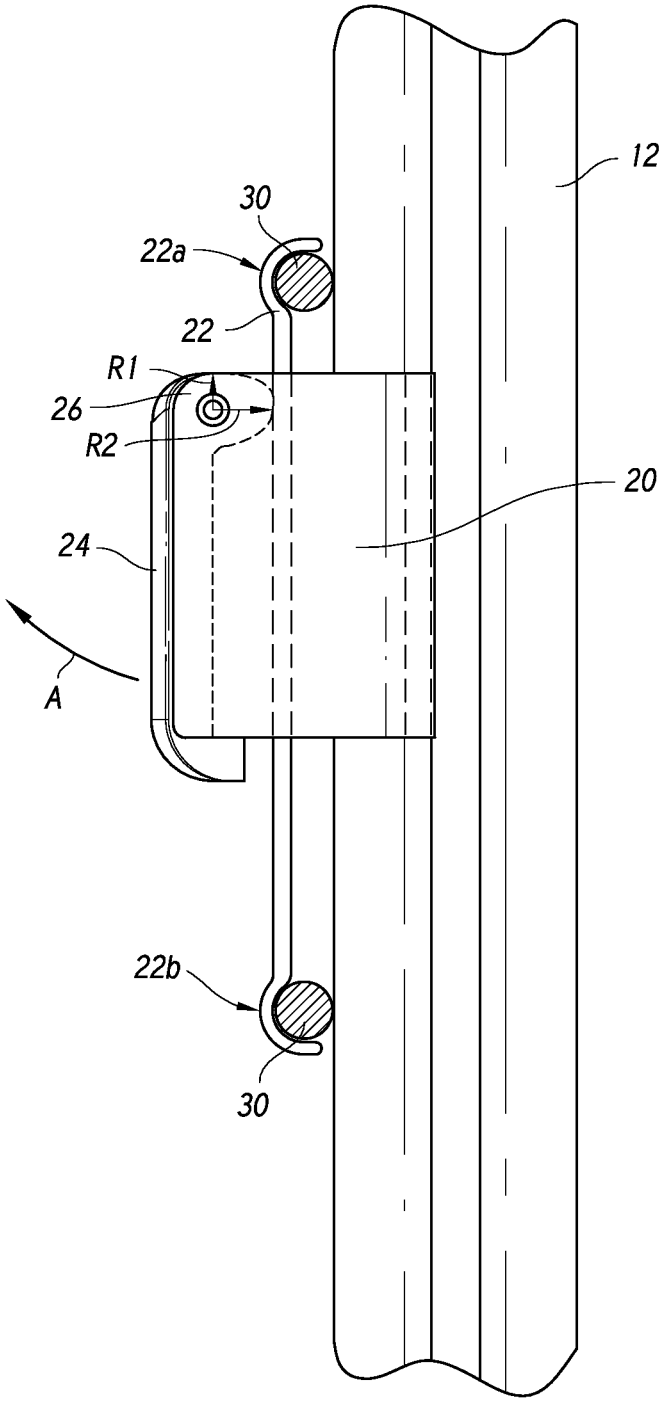
FIG. 5*a* is a schematic side elevation and partial cross-sectional view of the central support member, clamping mechanism, and a shelf of the shower caddy, with the clamping mechanism being shown in a "closed" position.
Figure 5B:
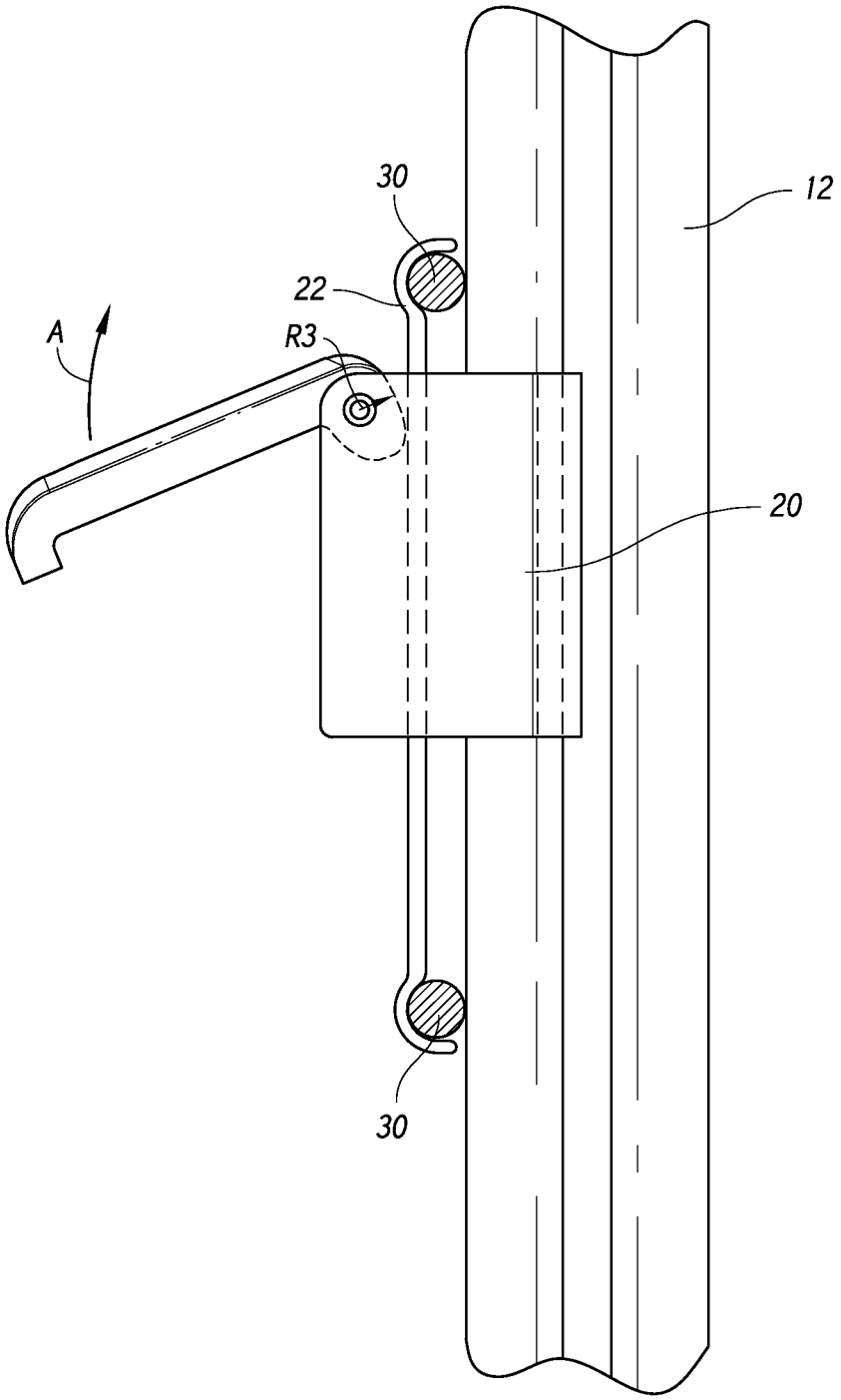
FIG. 5*b* is a side cross-sectional view of the vertical column, clamping mechanism, and shelf of the shower caddy, with the clamping mechanism in an intermediate position between "closed" and "open" positions.

As shown in FIGS. 3 and 5*a*-5*c*, a lever 24 can be rotatably mounted relative to the clamp body 20. The lever 24 can be configured to move between open (or unlocked) and closed (or locked) positions. For example, the lever 24 can be configured to secure the shelf 16 to the support member 12 when the lever 24 is in the closed position and to allow the shelf 16 to be moved when the lever 24 is in the open position. In some embodiments, the clamp lever 24 can be formed of a translucent polycarbonate. The lever 24 may be formed of other suitable materials, such as steel, stainless steel, aluminum, plastics, or any other material In some embodiments, the lever 24 can include a cam 26 configured to convert the pivotal movement of the lever 24 into a translational movement of the clamp plate 22. For example, the lever 24 can be hinged or otherwise pivotally mounted relative to the clamp body 20, as shown in FIGS. 5*a* and 5*b*. In some embodiments, the cam 26 can include at least a first portion 26*a* having a radius R1 and a second portion 26*b* with a radius R2, R2 being larger than R1. As such, when the lever 24 is rotated such that the first portion 26*a* is juxtaposed to the clamp plate 22, the clamp device 14 is in the open position. When the lever 24 is rotated such that the second portion 26*b* is juxtaposed to the clamp plate 22, the clamp device 14 is in the closed position. These movements are described below in greater detail with reference to FIGS. 5*a*-5*c*.

In some embodiments, the cam 26 can include a third portion 26*c* having a radius R3 which is larger than radius R2. As such, the cam 26 can be configured to provide an "over-center" operation. For example, with the radius R3 being larger than both the radiuses R1 and R2, the cam 26 will generate a maximum pressing force against the clamp plate 22 when the third portion 26*c* is juxtaposed to the clamp plate 22. However, as is described below in greater detail, this pressing force is reduced as the lever 24 is further pivoted until the second portion 26*b* is juxtaposed to the clamp plate 22. This provides an advantage in that the user is provided with a tactile signal that the lever 24 has been moved to the fully closed position. The lever 24 can move quickly from the intermediate position in which the third portion 26*c* is juxtaposed to the clamp plate 22 to the fully closed position in which the second portion 26*b* is juxtaposed to the clamp plate 22.

FIG. 5*a* shows the lever 24 in the closed position, which is when the clamping mechanism 14 is tightened to hold the shelf 16 in place. In this closed position, the clamping mechanism 14 is secured to the support member 12 by the pressing force caused by the second portion 26*b* of the cam 26 pushing against the clamp plate 22, which, in turn, pushes the clamp plate 22 against an outer surface of the support member 12. This pressing force also causes the hooks 15 (FIG. 2) of the clamp body 20 to press against and tighten around the flanges 12', 12" (FIG. 2) of the support member 12. In the "closed" position, the shoulders of the clamp plate 22 engage the cross members 30 of the shelf 16, as shown in FIG. 5*a*, and thus press the cross members 30 against the outer face of the support member 12.

The pressure between the shoulders 22*a*, 22*b* of the clamp plate 22 and the cross members 30 as well as the pressure between the hooks 15 of the clamp body 20 and the outer flanges 12', 12" of the support member 12 secure the shelf 16 in place in both the horizontal and vertical directions. As such, the magnitude of the radius R2 can be determined so as to provide a sufficient pressing force against the clamp plate 22 such that the friction between at least one of the cross members 30, the outer surface of the support member 12, the inner surface of the flanges 12', 12", and the hooks 15 is sufficient to support the shelf 16 at the desired location under a maximum load. However, other devices can also be used to secure the shelves 16.

Figure 5C:
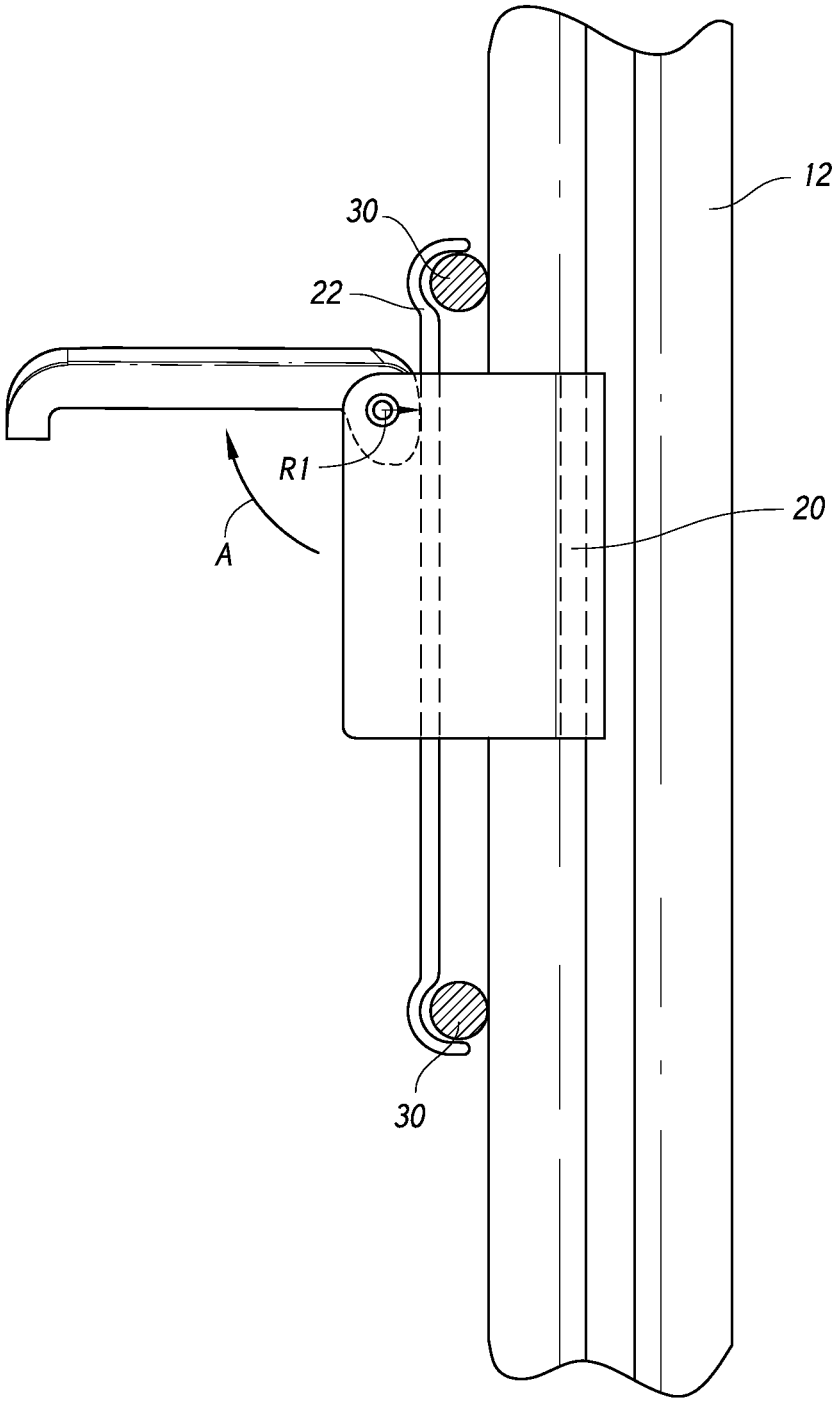
FIG. 5*c* is a side cross-sectional view of the vertical column, clamping mechanism, and shelf of the shower caddy, with the clamping mechanism in the "open" position.

When the lever 24 is in the open position, as shown in FIG. 5*c*, the first portion 26*a*, having the radius R1, is juxtaposed to the clamp plate 22. In some embodiments, the magnitude of the radius R1 is sufficiently small that the shelf 16 can be adjusted, both vertically and horizontally, when the lever 24 is in this position.

A user may "open" the lever 24 by pulling it generally in the direction of arrow A, away from the clamp plate 22 and the column 12. When the lever 24 is pulled in this direction, the cam 26 rotates in a clockwise direction (as viewed in FIG. 5*b*) and thus pulls away from the clamp plate 22 as the first portion 26*a* is moved into juxtaposition with the clamp plate 22. When the cam 26 is pulled away from the clamp plate 22, the tension is reduced and the shelf 16 may be adjusted by a user, both vertically and horizontally.

Figure 5D:
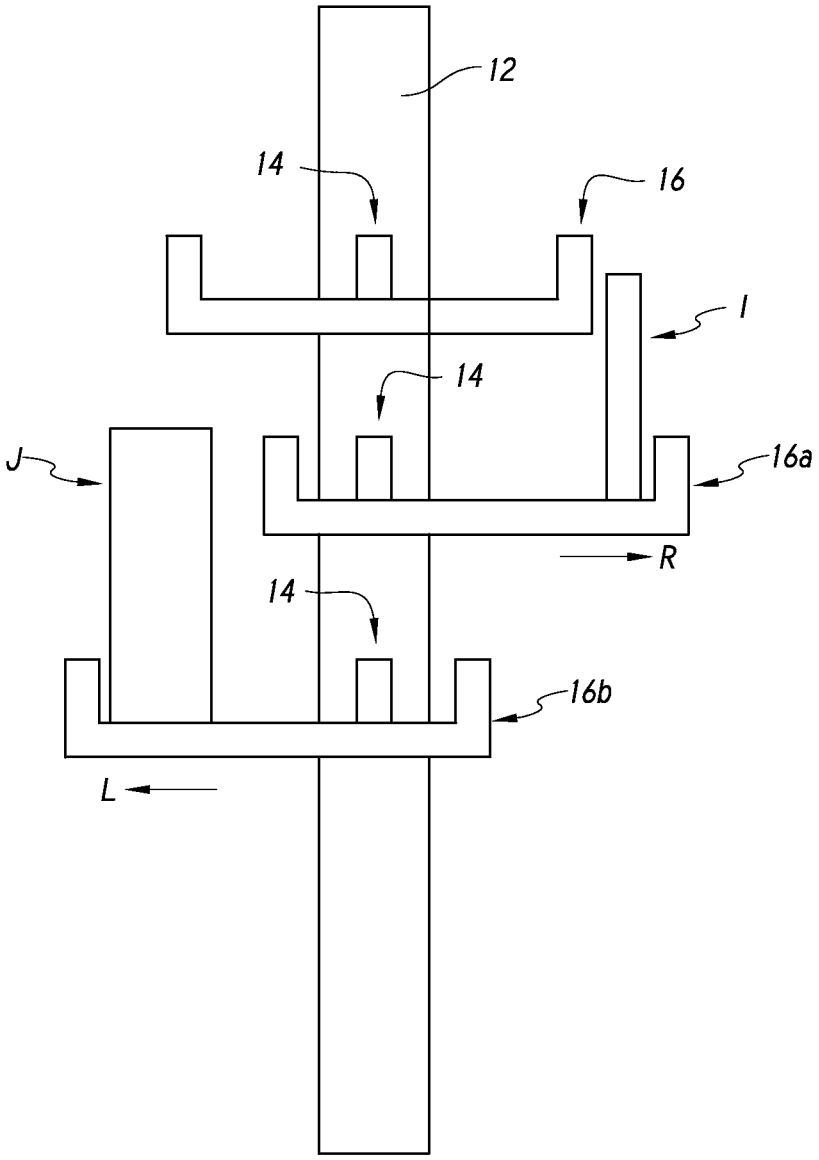
FIG. 5*d* is a schematic front elevation view of the shelving system in which two of the shelves have been adjusted laterally away from their centered position.

This arrangement provides various advantages. For example, with reference to FIG. 5*d*, the upper most shelf 16 is illustrated in its centered position (where the geometric center of the shelf 16 is aligned with the longitudinal axis of the support member 12). By configuring the shelving system to allow the shelves to be adjusted laterally, the shelves can be rearranged to accommodate differing sizes of articles. For example, with continued reference to FIG. 5*d*, the shelf below the upper most shelf 16, identified generally as shelf 16*a*, has been laterally adjusted towards the right hand side of the figure (in the direction of arrow R). In this configuration, a tall item I can be placed on shelf 16*a* without impacting the upper most shelf 16. For example, such tall items can be large shampoo bottles of the type that are commonly sold in discount warehouse retail stores. When adjacent shelves are shifted in opposite directions, an even larger space can be provided. For example, as shown in FIG. 5*d*, the shelf 16*b* which is below the shelf 16*a*, has been adjusted toward the left hand side of the figure (in the direction of arrow L). In such a configuration, an even larger tall item J can be supported on the shelf 16*b* without impacting the shelf 16*a* above the shelf 16*b*.

In operation, to adjust a shelf 16 in the lateral direction, a user can pivot the lever 24 toward the open position (FIG. 5*c*), thereby reducing pressure on the clamp plate 22, which in turn, reduces the pressure between the cross wires 30 and the outer face of the support member 12 and as well as the pressure between the hooks 15 and the flanges 12', 12" (FIG. 2). With the lever 24 positioned as such, a user can slide the shelves 16 relative to the clamping mechanism 14.

Figure 7:
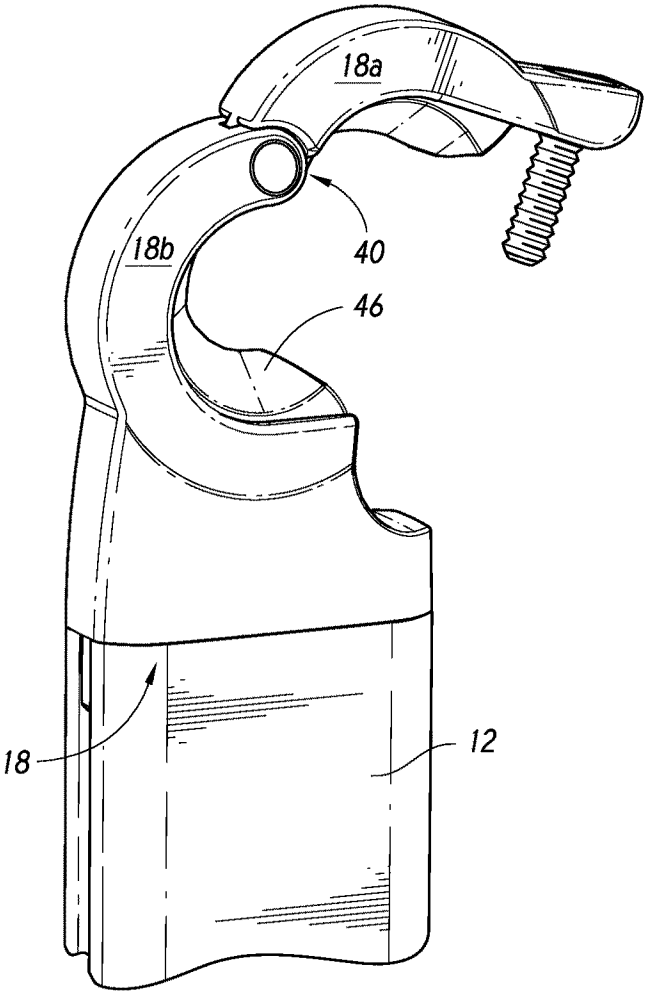
FIG. 7 is a front, top, and right side perspective view of the upper attachment device shown in an "open" position.
Figure 6:
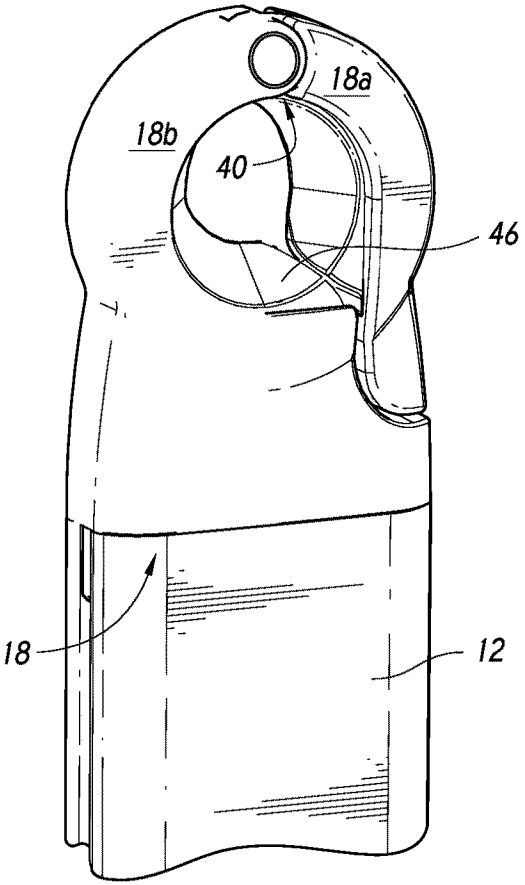
FIG. 6 is a front, top, and right side perspective view of an upper attachment device that can be used with the shower caddy shown in a "closed" position.
Figure 8:
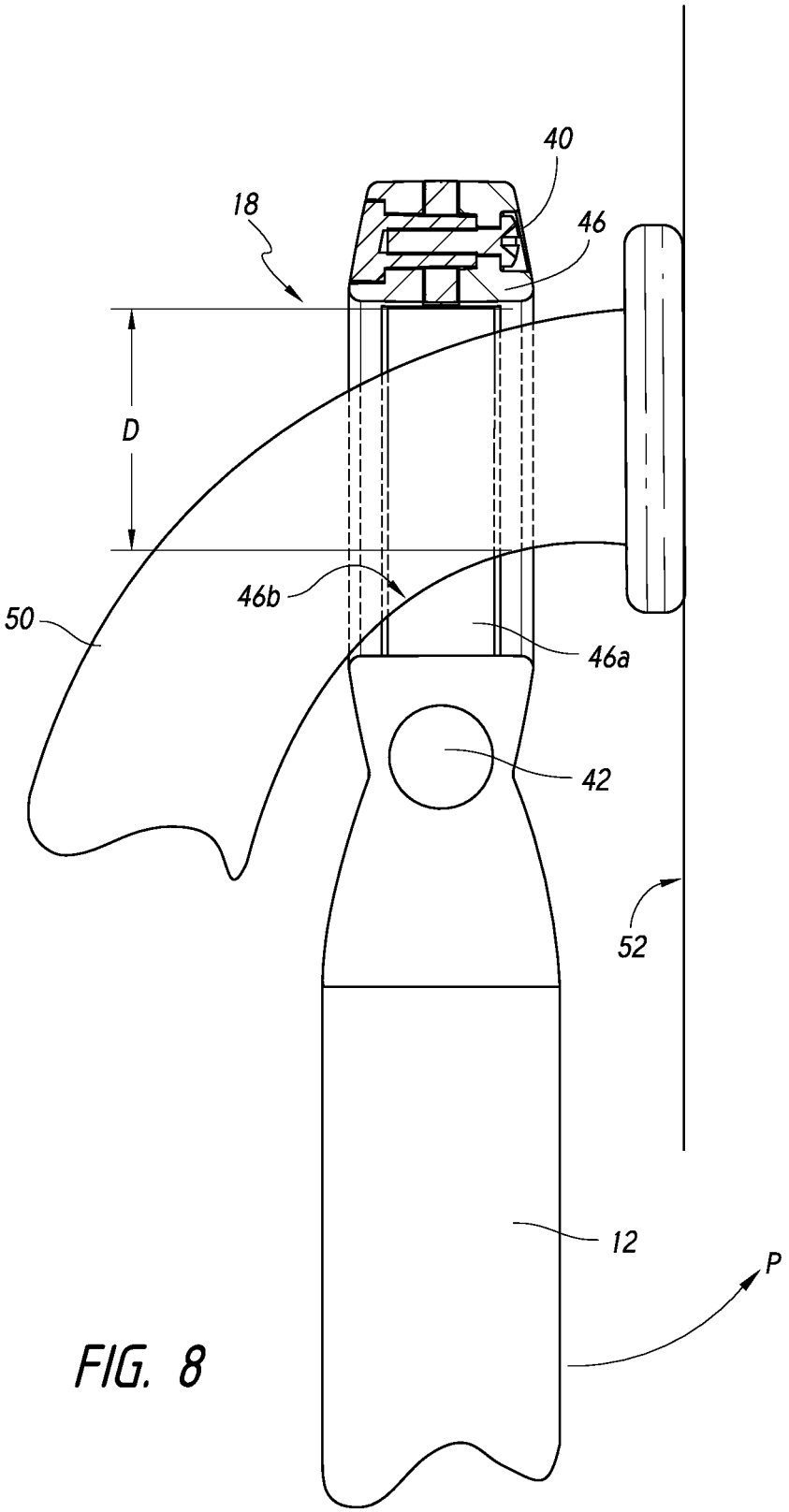
FIG. 8 is a schematic side cross-sectional view of the upper attachment device positioned on a shower head pipe.

With reference to FIGS. 6-8, the shower caddy 10 can be fitted with an openable loop mechanism 18 at the top of the support member 12. The openable loop mechanism 18 can be configured to support the weight of the shower caddy 10 from a shower head (not shown) or a pipe 50 leading to a shower head. For example, the openable loop mechanism 18 can be fitted onto the pipe 50 when it is in an open position (FIG. 7), then closed to secure it in place, as shown in FIG. 8.

In various embodiments, the loop mechanism 18 can be attached to the upper end of the support member 12. As shown in FIGS. 6 and 7, the loop mechanism 18 can be hinged. For example, in some embodiments, the loop mechanism can include a first portion 18A pivotally connected to a second portion 18B. In some embodiments, the pivotal connection between the first and second portions can be provided by a hinge 40.

The hinge 40 can be configured to allow the loop mechanism 18 to open, as shown in FIG. 7. The loop mechanism 18 can be secured by closing the first portion 18A over the shower head pipe 50 and by tightening a threaded screw 42 in the corresponding threaded opening (not shown). However, other fasteners, devices, or mechanisms can also be used to secure the first portion 18A in the closed position.

With reference to FIG. 8, some embodiments have a resilient member on at least a portion of an inner periphery of the loop mechanism 18. For example, in some embodiments, the loop mechanism 18 can be fitted with a resilient member, such as deformable members 46 on the inner periphery of the loop mechanism 18, as shown in FIGS. 6 and 7. The deformable member 46 can be made from one or a plurality of pieces. The deformable members 46 can be made from any resilient material. In some embodiments, the deformable member 46 is made from rubber. These deformable members 46 can be shaped and tapered such that it fits snugly around a standard shower head pipe 50.

In some embodiments, a lower portion of the member 46 is tapered. For example, as shown in FIG. 8, a bottom of the deformable member 46 is tapered. Such a taper can provide better contact with a surface of a generally vertically or laterally curved or slanted attachment point of the shower caddy 10.

In some embodiments, the tapered shape of the lower portion 46A can be configured to compliment the typical downwardly curved contour of a shower head pipe that emerges from a shower wall 52, such as the shower head pipe 50. Such tapering of the lower portion 46A can allow the shower caddy 10 to hang more straightly. For example, without the taper in the lower portion 46A, the lower surface of the pipe 50 would generate more pressure on a forward portion 46B of the lower portion 46A. This would generate a torque on the shower caddy 10, tending to pivot the shower caddy 10 in the direction of arrow P inwardly toward the shower wall 52. The contact patch between such an untapered member 46 would be smaller thereby weakening the grip between the member 46 and the pipe 50.

As shown in FIGS. 6-8, the member 46 can be thinner at the top of the loop mechanism 18 as compared to the lower portion 46A. This can help to reduce bouncing of the shower caddy 10 when it is hung from the loop mechanism 18.

A typical shower head pipe 50 has an outer diameter of about 0.8 inch. In some embodiments, the loop mechanism 18 has a minimum inner diameter D of about 0.74 inch when the member 46 is in a relaxed state, e.g., when the shower caddy 10 is not installed on a shower pipe 50, as shown in FIG. 8. Because the inner diameter D of the loop mechanism 18 is slightly smaller than the outer diameter of a typical shower pipe 50, the rubber inserts 46 will deform slightly and fit snugly around the shower pipe 50 when the loop mechanism 18 is fitted around the shower pipe 50. Friction between the rubber inserts 46 and the shower head pipe 50 can help to keep the shower caddy 10 in place by resisting relative movement between the two, thereby preventing the shower caddy 10 from sliding down the pipe 50.

This snug fit is particularly useful for stabilizing the shower caddy 10 on a shower pipe 50 when the weight of items (e.g., shampoo, soap, etc.) kept on the shelves 16 is not distributed evenly. It has been found that conventional shower caddies do not adequately resist sliding off a shower pipe. Conventional shower caddies configured to hang on a shower pipe are typically hung over the shower head pipe with a portion of a wire frame of the caddy and thus may be easily knocked off, either by a user or uneven weight distribution of articles stored on the shower caddy. By providing a hinged loop mechanism 18 at the top of the shower caddy 10, the shower caddy 10 can be more securely and stably attached to a shower head pipe.

Figure 1:
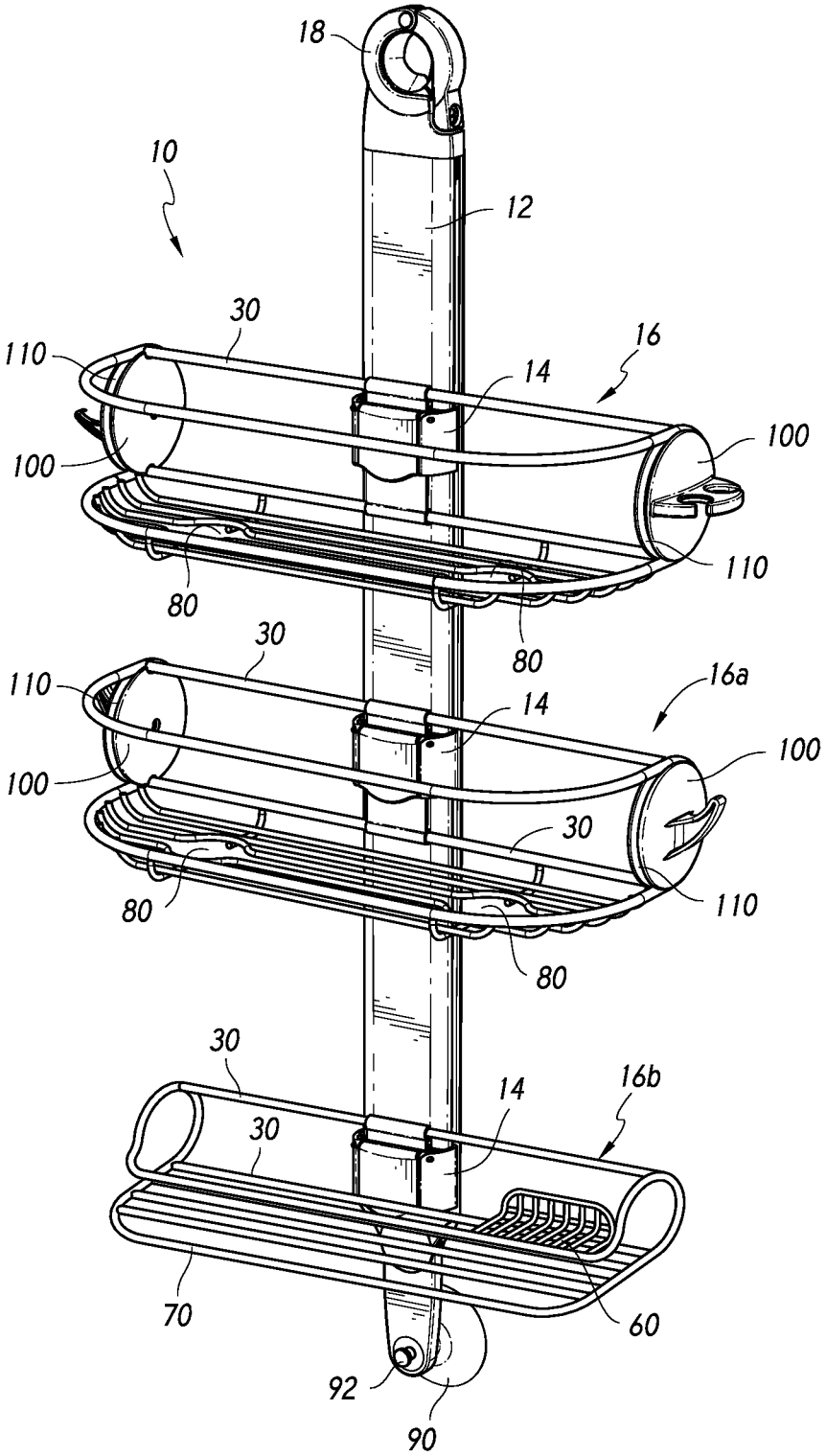
FIG. 1 is a front, top, and left side perspective view of a shower caddy constructed in accordance with some embodiments and having a central support member and three adjustable shelves.
Figure 9:
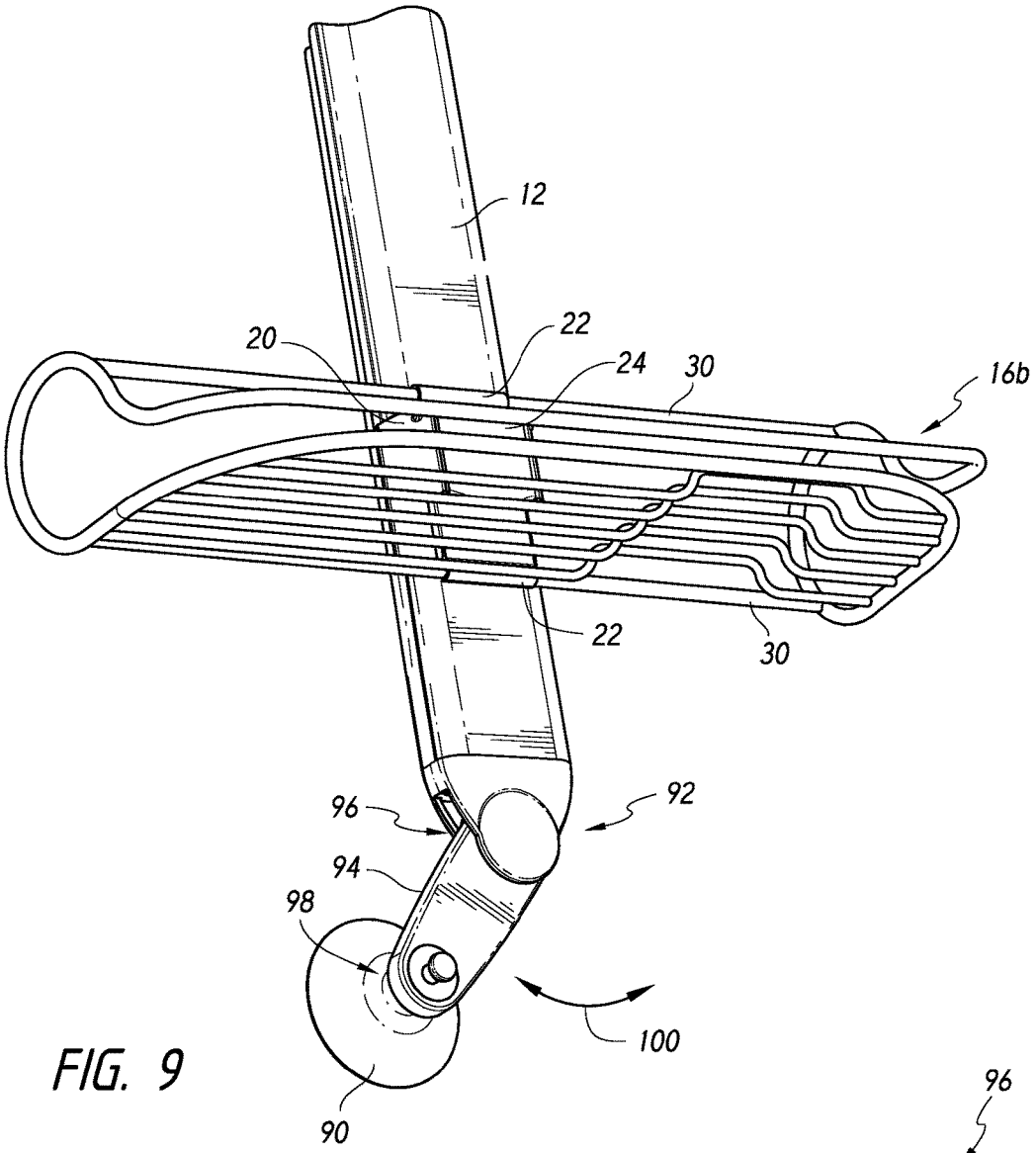
FIG. 9 is a front, bottom, and right side perspective view of a lower portion of the shower caddy having an adjustable lower attachment device.

In the illustrated embodiment, the shelves 16 are formed with cross-members 30 extending horizontally across and curved at the ends of the shelves 16 in a substantially semi-circular or generally "U" shape, as shown in FIGS. 1 and 9. As shown in the drawings, the shelves 16 can have different configurations. For example, the shelves 16 can be simple shelves having drainage holes or may be additionally fitted with a soap tray 60, towel rack 70, openings 80 for toiletries, and other accessories (e.g., hooks, etc.). Embodiments of a soap tray 60, towel rack 70, and openings 80 for toiletries are shown in FIG. 1. In the illustrated embodiment, the shelves 16 are configured as a wire basket, as shown in the drawings, to allow for drainage. However, the shelves may have different configurations other than those illustrated.

As shown in FIG. 1, the shelves 16, 16*a*, 16*b* have different configurations. The shelf 16*b* has a soap tray 60 and a towel rack 70 and the upper shelves 16, 16*a* can have openings 80 for holding bottles of toiletries, such as shampoo, upside down, e.g., with the cap of the shampoo bottle extending through the openings 80. There may be alternative embodiments for the soap tray 60, towel rack 70, and openings 80 for toiletries and that the embodiments shown in the drawings are merely example embodiments.

In some embodiments, the baskets of each shelf 16, 16*a*, 16*b*, can be formed of polished stainless steel wire. In certain embodiments, the frame of the basket, including the cross members 30, can be formed of 6 mm polished stainless steel wire. The remainder of the baskets can be formed of 3 mm polished stainless steel wire.

In some embodiments, other accessories 100 (e.g., in the form of disks) can be attached to the shower caddy 10. The accessories 100 can be formed in the shape of disks having a groove 110 on the peripheral edge. The width of the groove 110 can be about the same or slightly larger than the outer diameter of the wire forming the substantially semi-circular or U-shaped portions on the ends of the shelves 16 so that the wire of the substantially semi-circular portion fits within the groove 110. The accessories 100 are sized and shaped to fit in the substantially semi-circular portion, as shown in FIG. 1. The grooves 110 can be configured to "snap" into place in the substantially semi-circular portion of the shelves 16 by engaging the wire of the substantially semi-circular portion. The cross-members 30 of the shelves 16 may be pulled apart slightly by the user to snap the accessories 100 in place. The substantially semi-circular portion of the shelves 16 are preferably greater than or equal to 180 degrees to facilitate insertion of the accessories disks 100. The accessories 100 can be formed of a strong, rigid material, such as polycarbonate. However, the accessories 100 can be made from a variety of other suitable materials and in a variety of known manners.

In some embodiments, the shower caddy 10 can be secured to the shower wall 52 with an attachment mechanism 92. As shown, the attachment mechanism 92 can be positioned at a bottom end of the shower caddy 10. This can inhibit or prevent movement (e.g., tilting) of the shower caddy 10, such as if a user accidentally bumps the caddy 10 or if the weight of items stored on the caddy 10 is shifted to one lateral side.

Figure 10:
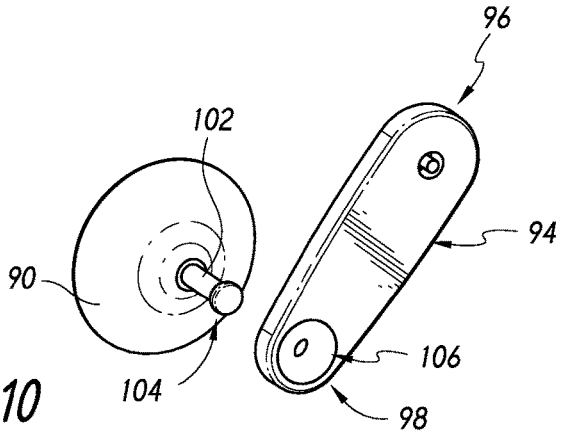
FIG. 10 is an exploded perspective view of the adjustable lower attachment device shown in FIG. 9.

As shown in FIG. 9, in some embodiments, a suction cup 90 can be rotatably mounted with the mechanism 92 at the bottom of the shower caddy 10 to secure the shower caddy 10 to the shower wall 52. FIG. 10 is an exploded perspective view of the suction cup 90 and mechanism 92 assembly.

The suction cup 90 can be rotatably attached to the lower end of the support member 12 by the mechanism 92 or some other mechanism allowing for at least lateral adjustment of the position of the suction cup 90 with respect to the wall 52. In some embodiments, the mechanism 92 can be configured to provide both lateral (e.g., generally perpendicular to the longitudinal axis of the support member 12) and longitudinal (e.g., generally parallel to the longitudinal axis of the support member 12) adjustment of the position of the suction cup 90.

The suction cup 90 can be configured to grip a substantially flat, planar surface. As mentioned above, suction cups positioned over a grout line or another type of break or irregularity in the shower wall may not generate a satisfactory seal with a suction cup. The mechanism 92 can be configured to allow movement of the suction cup 90, without adjusting the position of the shower caddy 10, so that a user may avoid positioning the suction cup 90 over a grout line or some other type of break or irregularity in the shower wall 52. In some embodiments, the suction cup 90 can be configured to be moveable such that it can be positioned over a smoother portion of the shower wall 52, thereby providing a strong and secure attachment to the wall 52.

In the illustrated embodiment, the mechanism 92 includes a pivot arm 94 having an upper end 96 pivotally mounted to the lower end of the support member 12 and a lower end 98 connected to the suction cup 90. The suction cup 90 can be pivoted along the arrow 100. As such, the suction cup 90 can be adjusted both in the longitudinal direction and the lateral direction.

The pivot arm 94 can be connected to the support member 12 and the suction cup 90 with any known device or mechanism. In some embodiments, the upper end 96 of the pivot arm can be connected to the support member 12 with a hinged connection. In some embodiments, friction can be built into the hinged connection to simplify the process of attaching the suction cup 90 to a shower wall.

In some embodiments, the lower end 98 of the pivot arm 94 can be configured to provide a flexible connection with the suction cup 90. In the illustrated embodiment, the suction cup 90 includes a shaft 102 with an enlarged head 104. The pivot arm 94, on the other hand, can include a resilient member 106 having an inner diameter, at rest, that is smaller than the outer diameter of the enlarged head 104. As such, the enlarged head 104 can be pressed through and thereby engaged with the resilient member 106.

In some embodiments, the shower caddy 10 can be provided with an adjustable suction cup assembly both at the top and the bottom, thereby eliminating the loop mechanism 18. Such alternative embodiments may be secured to the shower wall anywhere as they do not need to be secured to the shower head pipe.

FIGS. 11-21

FIGS. 11-21 illustrate another embodiment of a shower caddy, identified generally by the reference numeral 10A. Components of the shower caddy 10A that are the same or similar to the corresponding components of the shower caddy 10 are identified below with the same reference numerals except that a letter "A" has been added thereto.

Figure 11:
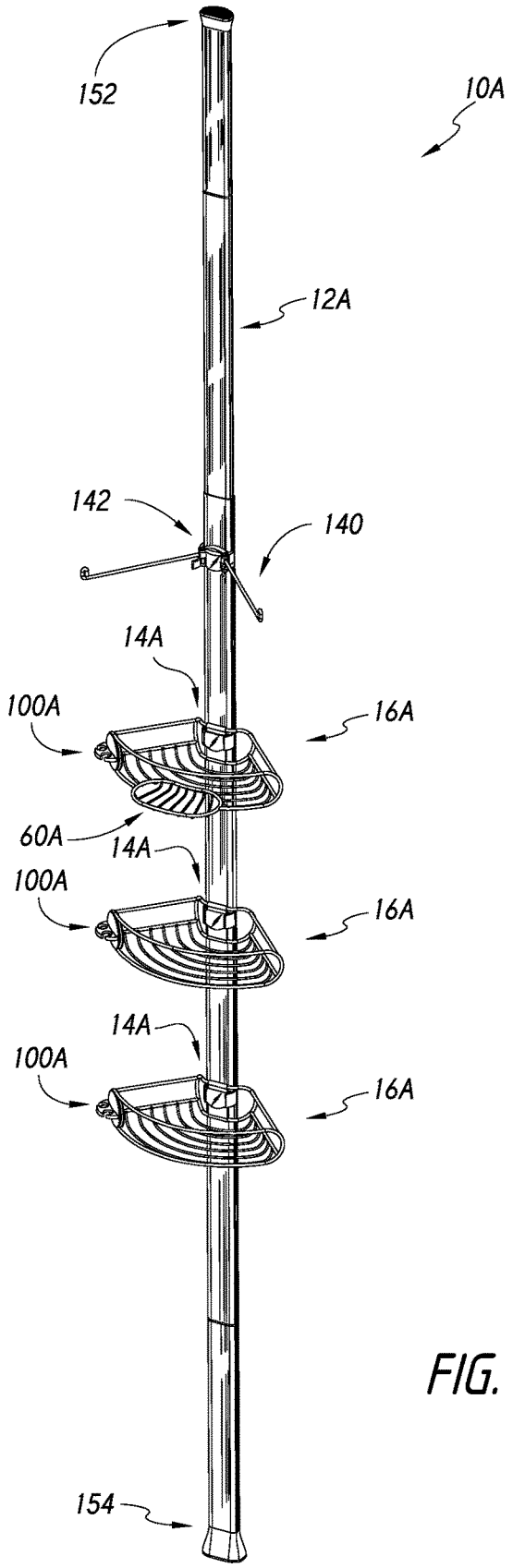
FIG. 11 is a front top and left side perspective view of another embodiment of a shower caddy.

With reference to FIG. 11, the shower caddy 10A can include an elongated support member 12A, a plurality of shelves 16A, each of which can be supported by a clamping mechanism 14A. In some embodiments, the shower caddy 10A can include one or a plurality of drying racks 140. In some embodiments, the drying racks 140 can be connected to the support member 12A with the clamping mechanisms 14A. In the illustrated embodiment, the drying rack 140 is supported by the clamping mechanism 142, which is described in greater detail below.

The support member 12A can have any configuration. In the illustrated embodiment, the support member 12A can have the same or a similar cross-sectional shape to the support member 12, as illustrated in FIG. 2. In the illustrated embodiment, the support member 12A includes a generally I-beam shaped cross-section. In some embodiments, the support member 12A can be formed in one or a plurality of segments configured to provide adjustability along various dimensions and axes.

In some embodiments, the support member 12A is configured to have a telescoping configuration so that upper and lower ends of the support member 12A can be pressed against upper and lower stationary objects. For example, in some embodiments, the support member 12A can be configured to press against the floor of a shower and the ceiling above the shower or bathtub with sufficient force to anchor the entire caddy 10A in a desired position.

Figure 11A:
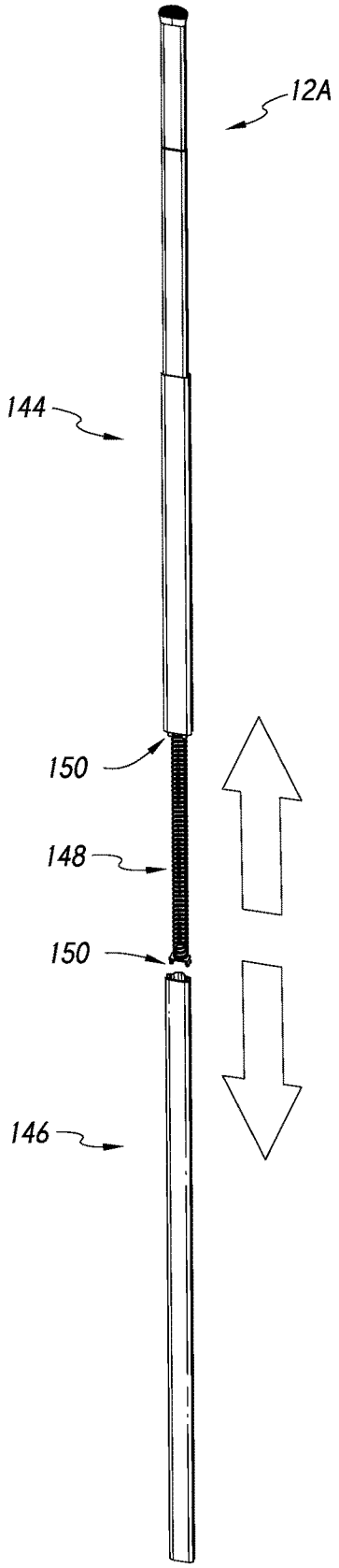
FIG. 11*a* is an exploded view of a central support member of the shower caddy illustrated in FIG. 11.
Figure 12:
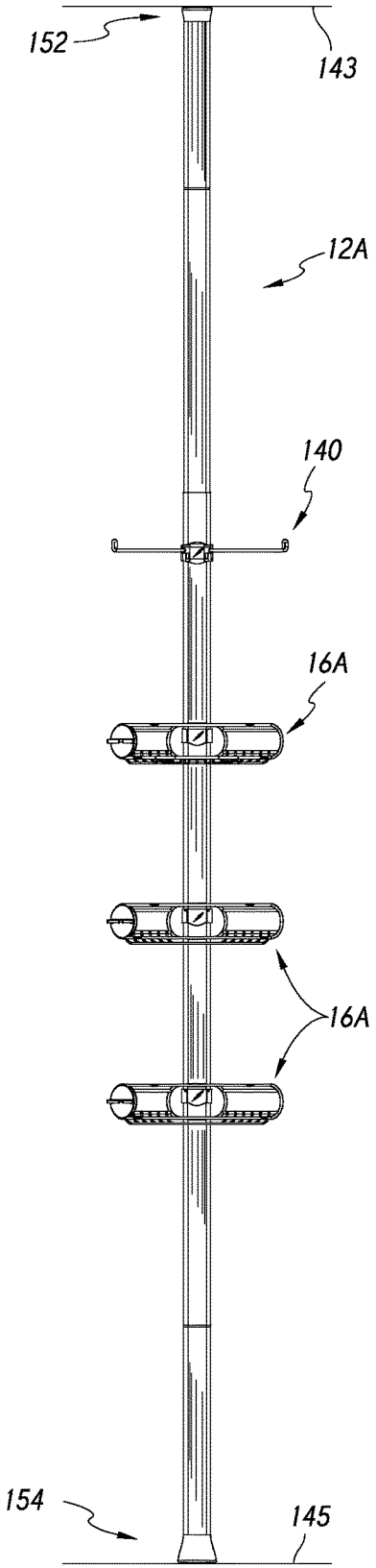
FIG. 12 is a front elevation view of the shower caddy of FIG. 11.
Figure 13:
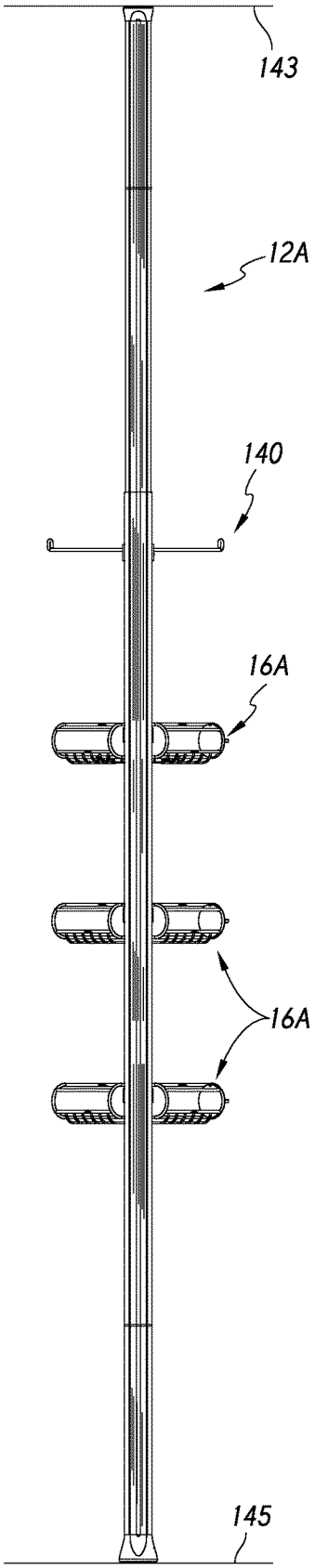
FIG. 13 is a rear elevation view of the shower caddy of FIG. 11.
Figure 14:
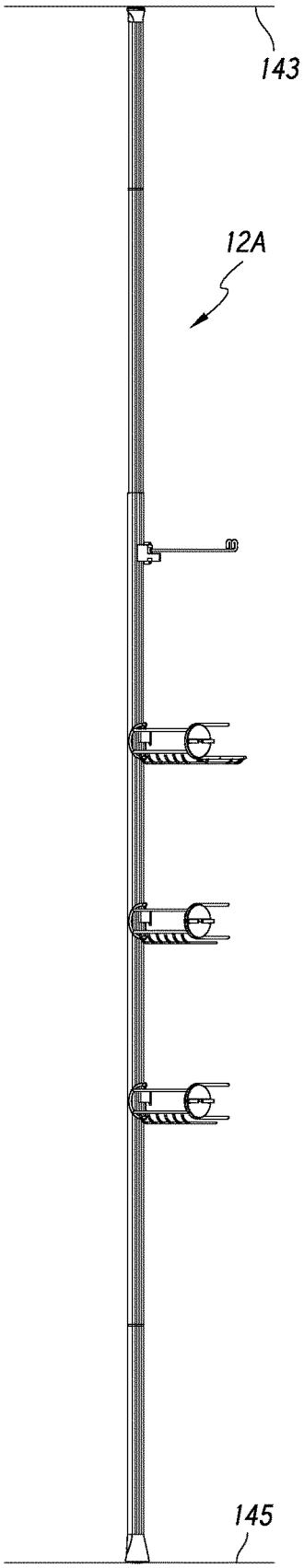
FIG. 14 is a right side elevation view of the shower caddy of FIG. 11.
Figure 15:
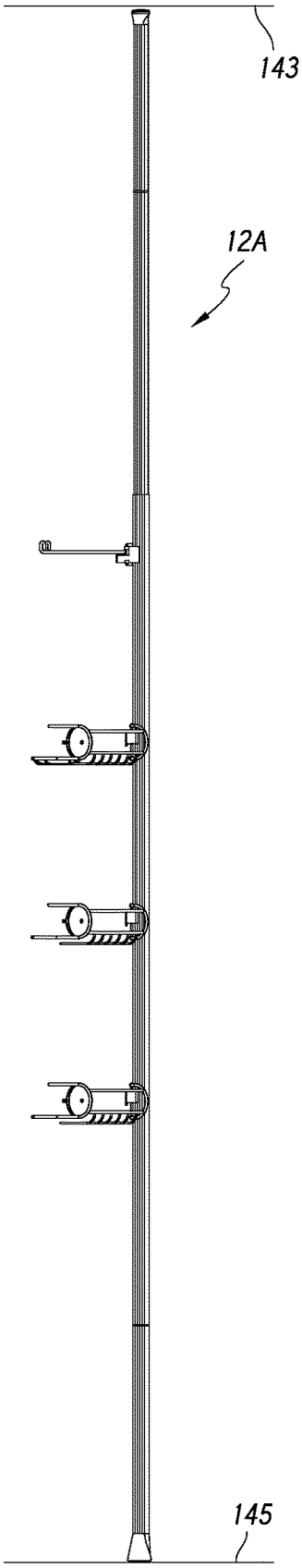
FIG. 15 is a left side elevation view of the shower caddy of FIG. 11.
Figure 16:
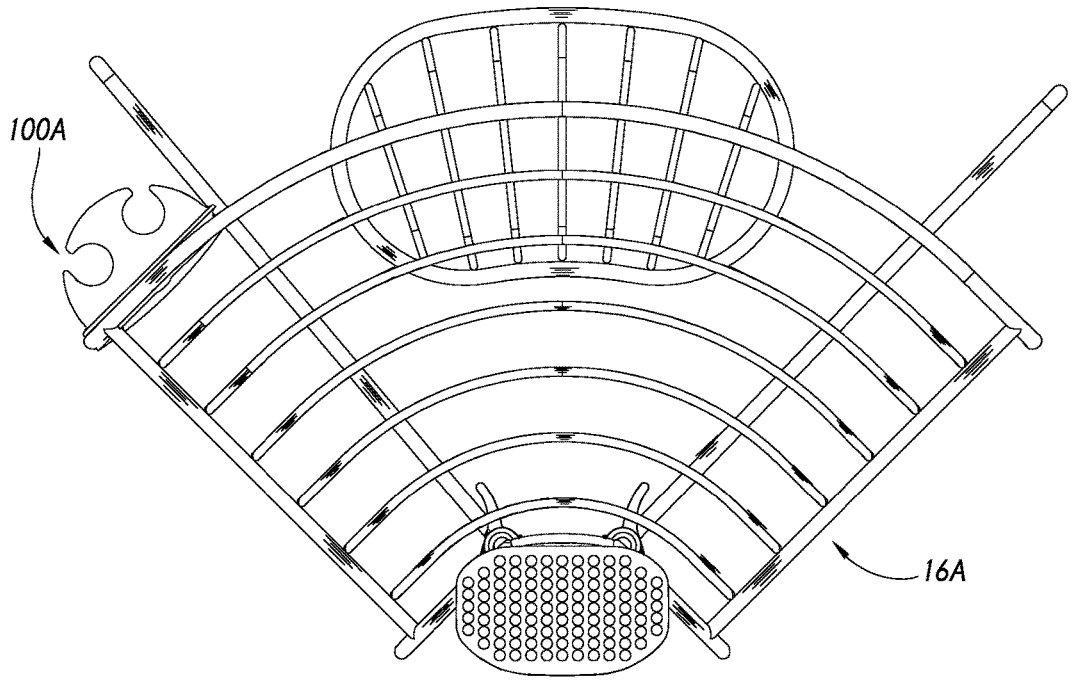
FIG. 16 is a bottom plan view of the shower caddy of FIG. 11.
Figure 17:
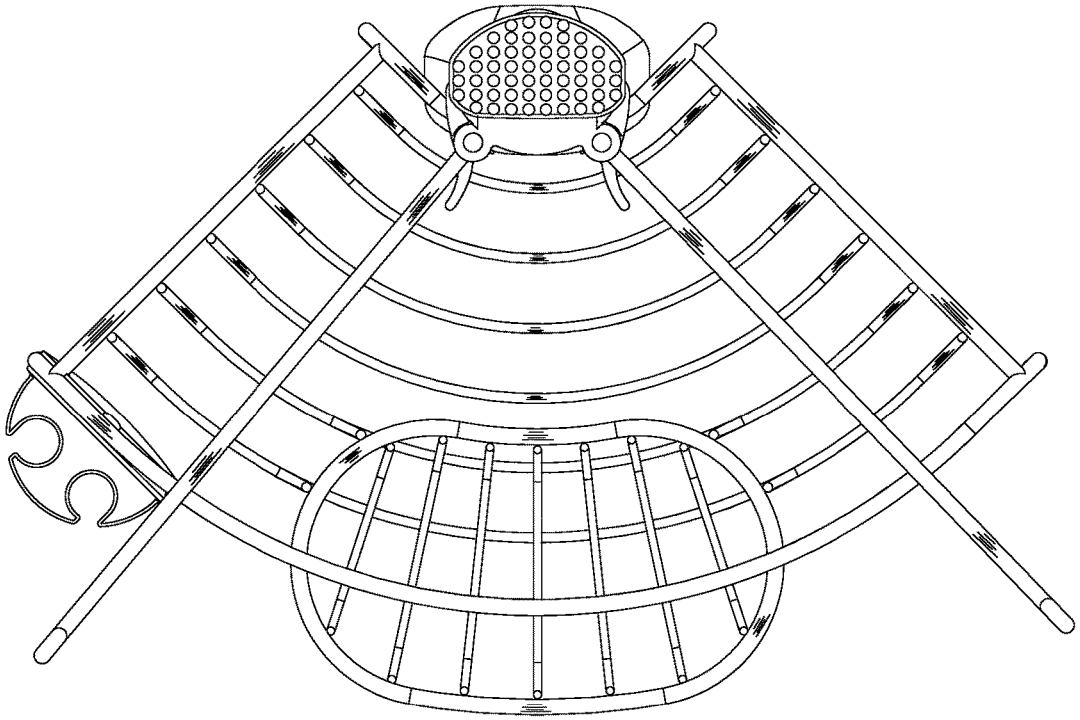
FIG. 17 is a top plan view of the shower caddy of FIG. 11.
Figure 19:
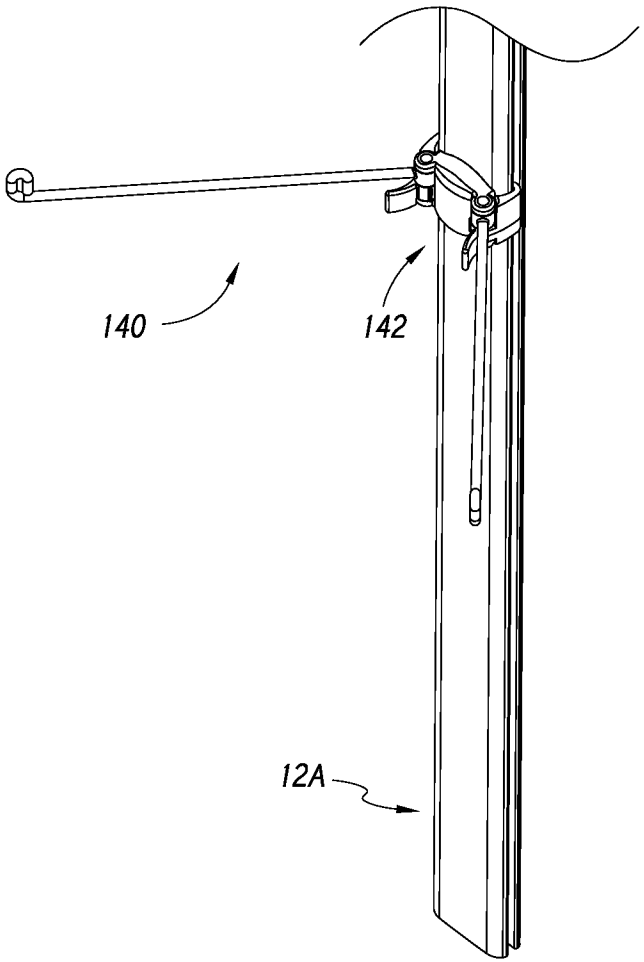
FIG. 19 is another view of the wash cloth hanger of FIG. 18 attached to the central support member.
Figure 18:
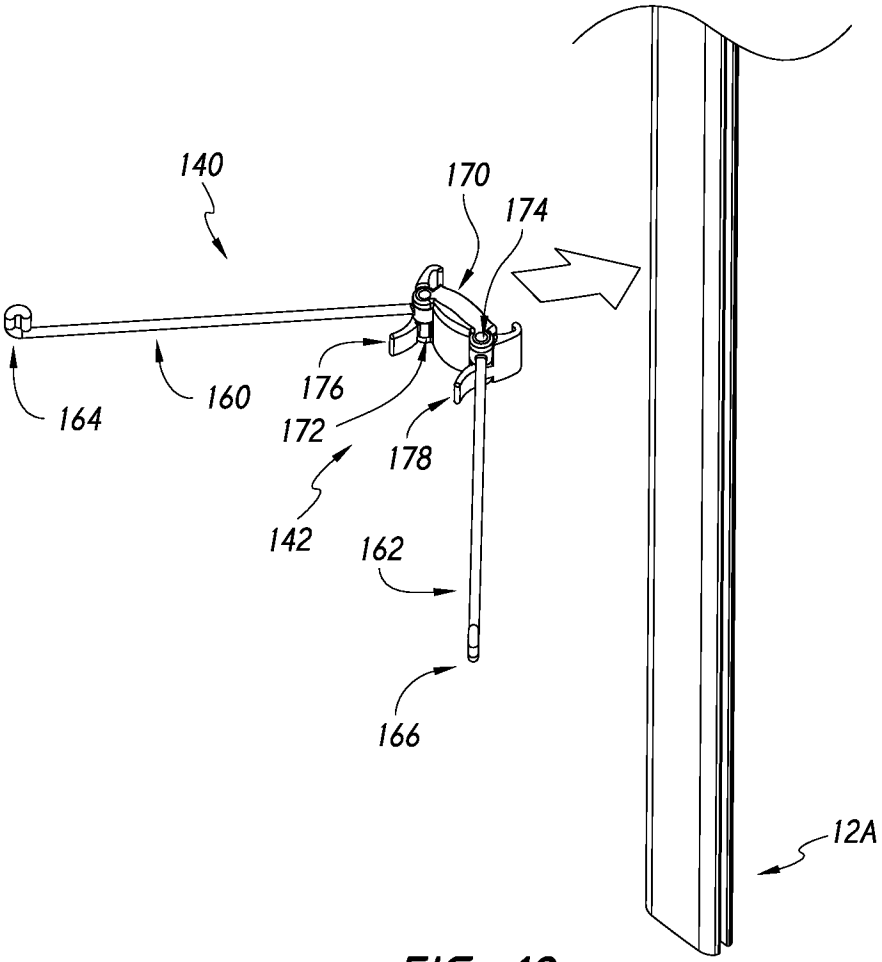
FIG. 18 is an enlarged exploded view of a wash cloth hanger illustrating motions for releasing the hanger from a central support column of the shower caddy of FIG. 11.

With reference to FIG. 11*a*, in some embodiments, the support member 12A can include telescoping or nesting segments 144, 146 having outer dimensions that are sized so as to allow one of the segments 144, 146 to slide within the other. For example, the segment 144 can be configured such that its inner dimensions are larger than the outer dimensions of the segment 146. As such, the segment 144 can extend over and thus the segment 146 can slide into the segment 144.

As noted above, the support member 12A can include a spring. In the illustrated embodiment, the support member 12A includes a spring 148 configured to bias the sections 144, 146 away from each other. As such, the support member 12A can generate an anchoring force to retain the caddy 10A (FIG. 11) in a secure position within a shower, bathtub, or other location.

Figure 20:
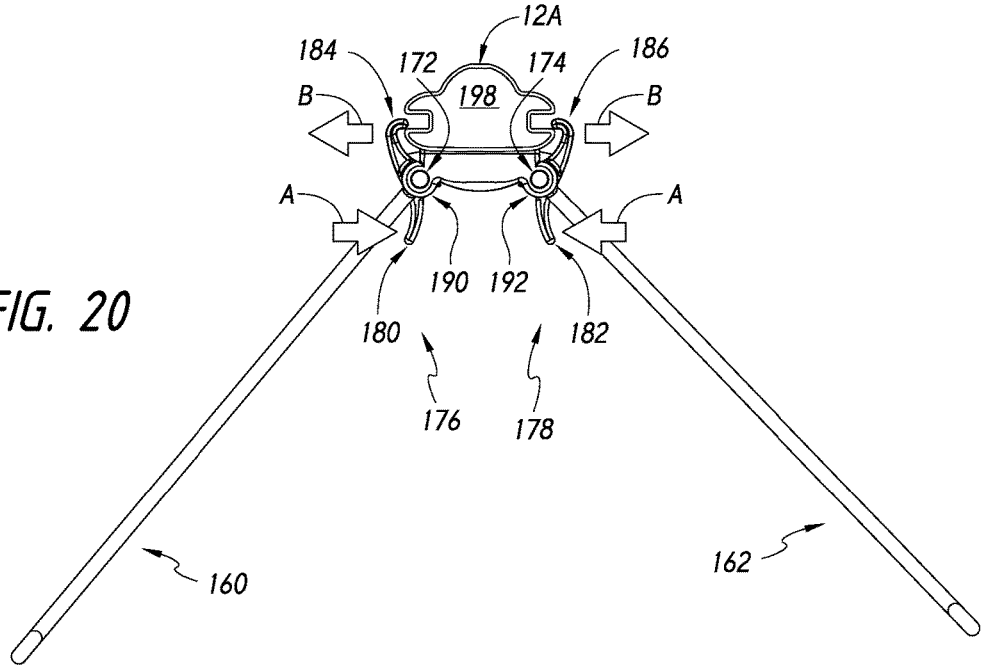
FIG. 20 is an enlarged top plan and partial sectional view illustrating a releasing motion of the wash cloth hanger illustrated in FIGS. 18 and 19.

With reference to FIG. 20, the support member 12A can include an enlarged inner portion 198 configured to accommodate the spring 148 (not shown in FIG. 20). The enlarged portion 198 extends along the length of the support member 12A. As such the enlarged portion 198 serves the dual purposes of providing a space in which the spring 148 can be completely contained within the interior of the support member 12A and provides additional stiffness against bending of the support member 12A.

With reference back to FIG. 11*a*, the support member 12A can include one or a plurality of mounting clips 150 configured to the engage with portions of the segments 144, 146 to allow the spring 148 to press securely against and thus, push apart the segments 144, 146.

In some embodiments, the support member 12A can include upper and lower feet 152, 154 configured to provide additional traction when the upper and lower ends of the support member 12A are pressed against surfaces 143,145 such as the ceiling and floor of a shower or bathtub. For example, the feet 152, 154 can be made of rubber, silicon, or any other material that would provide enhanced traction in such an environment of use.

As illustrated in FIG. 11, the shelves 16A can have a wedge or pie-shaped configuration. This provides a more compact arrangement when the shower caddy 10A is mounted in a bathtub or shower corner that has walls that meet at a 90° angle. In such an environment, the wedge or pie-shaped configuration of the shelves 16A allows the shower caddy 10A to be tucked compactly into such a 90° corner. The shelves 16A can include accessories that are similar to or the same as various other accessories described above with reference to the shower caddy 10.

As noted above, the shelves 16A can be secured to the support member 12A with clamping mechanisms 14A. The clamping mechanisms 14A can be the same or similar to the clamping mechanisms 14 described above in detail with reference to FIGS. 1-5. In various embodiments, the shelves 16A can be moved vertically along the vertical length of the support member 12A. The shelves 16A can be adjusted in a lateral direction relative to the vertical direction of the support member 12A.

With reference to FIGS. 18-21, the wash towel drying racks 140 can be configured, as noted above, to be engageable with the support member 12A. In various embodiments, the drying racks 140 can be connected to and easily removed from the support members 12 or 12A. As such, a user can quickly and conveniently change the configuration of the shower caddies 10, 10A to include or exclude such drying racks 140.

In the illustrated embodiment, the drying rack 140 comprises a clamping mechanism 142 and one or a plurality of rack members 160, 162. The rack members 160, 162 can have any configuration. In the illustrated embodiment, the rack members 160, 162 are configured to support a hanging article, such as a wet wash cloth. In the illustrated embodiment, the rack members 160, 162 are made from rod shaped material with enlarged end portions 164, 166 to prevent the hanging article from inadvertently sliding off of the rack members 160, 162. In certain embodiments, the rack members 160, 162 can be made from a metal material, such as stainless steel.

The drying rack 140 can include a main body portion 170 configured to support the rack members 160, 162 as well as supporting and/or forming a part of the clamping mechanism 142. The main body member can support one or a plurality of pivot pins 172, 174. The pivot pins 172, 174 can be used to pivotally support the rack members 160, 162. In some embodiments, the pivot pins 172, 174 support clamp members 176, 178. As such, the pivot pins 172, 174 can provide pivotal support for both the rack members 160, 162 and the clamp members 176, 178.

With reference to FIG. 20, the clamp members 176, 178 can include control ends 180, 182 and engagement ends 184, 186, respectively. The control ends 180, 182 can be configured to allow a user to control the movement of the engaging portions 184, 186. For example, the control portions 180, 182 can be shaped such that a user can comfortably grasp these portions 180, 182, optionally with one hand, and squeeze them toward each other in the direction of arrows A in FIG. 20 thereby causing the engaging portions 184, 186 to move away from the support member 12A in the direction of arrows B. In some embodiments, the control ends 180, 182 are connected with the engaging portions 184, 186, respectively with pivot portions 190, 192. The pivot portions 190, 192 can comprise an opening configured to receive the pins 172, 174. In some embodiments, the pivot portions 190, 192 are made integrally or monolithically with the corresponding control portions 180, 182 and engaging portions 184, 186.

Figure 21:
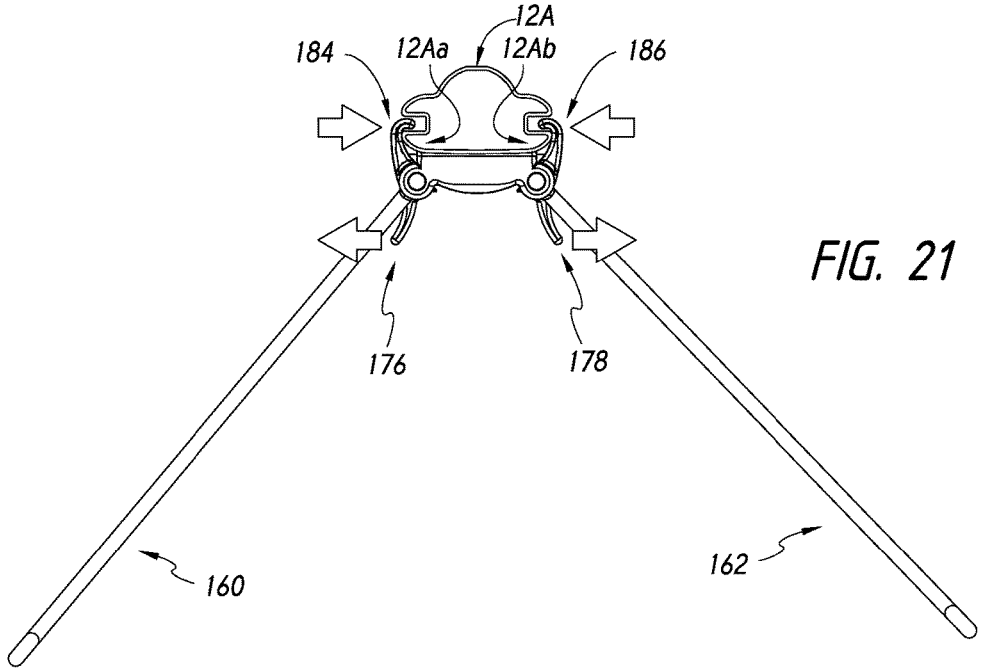
FIG. 21 is an enlarged top plan and partial sectional view illustrating a clamping motion of the wash cloth hanger illustrated in FIGS. 18 and 19.

In some embodiments, the members 176, 178 can be biased toward the closed position, as illustrated in FIG. 21. For example, springs, such as torsional springs (not shown) can be provided in or adjacent to the pivot portions 190, 192 to bias the members 176, 178 toward the closing direction. More specifically, such springs can bias the members 176, 178 such that the engaging portions 184, 186 are biased toward a position in which the engaging portions 184, 186 extend into the channels by the outer flanges 12Aa, 12Ab. Further, the springs (not shown) can be configured to bias the members 176, 178 at such with sufficient force to maintain the drying rack 140 in its vertical position along the support member 12A even when one or a plurality of wet articles, such as wet wash clothes, are hanging from the rack members 160, 162.

FIGS. 22-33*a*

FIGS. 22-33*a* illustrate embodiments of another shower caddy 10B. In many respects, the shower caddy 10B resembles or is identical to either or both of the shower caddies 10, 10A discussed above. As such, components of the shower caddy 10B that are the same or similar to the corresponding components of the shower caddy 10 and/or 10A are identified below with the same reference numerals except that a letter "B" has been added thereto. The shower caddy 10B can include one, some, or all of the features of the shower caddy 10 and/or 10A, including all combinations and sub-combinations. Any component or step disclosed in any embodiment in this specification can be used in any other embodiment.

Figure 22:
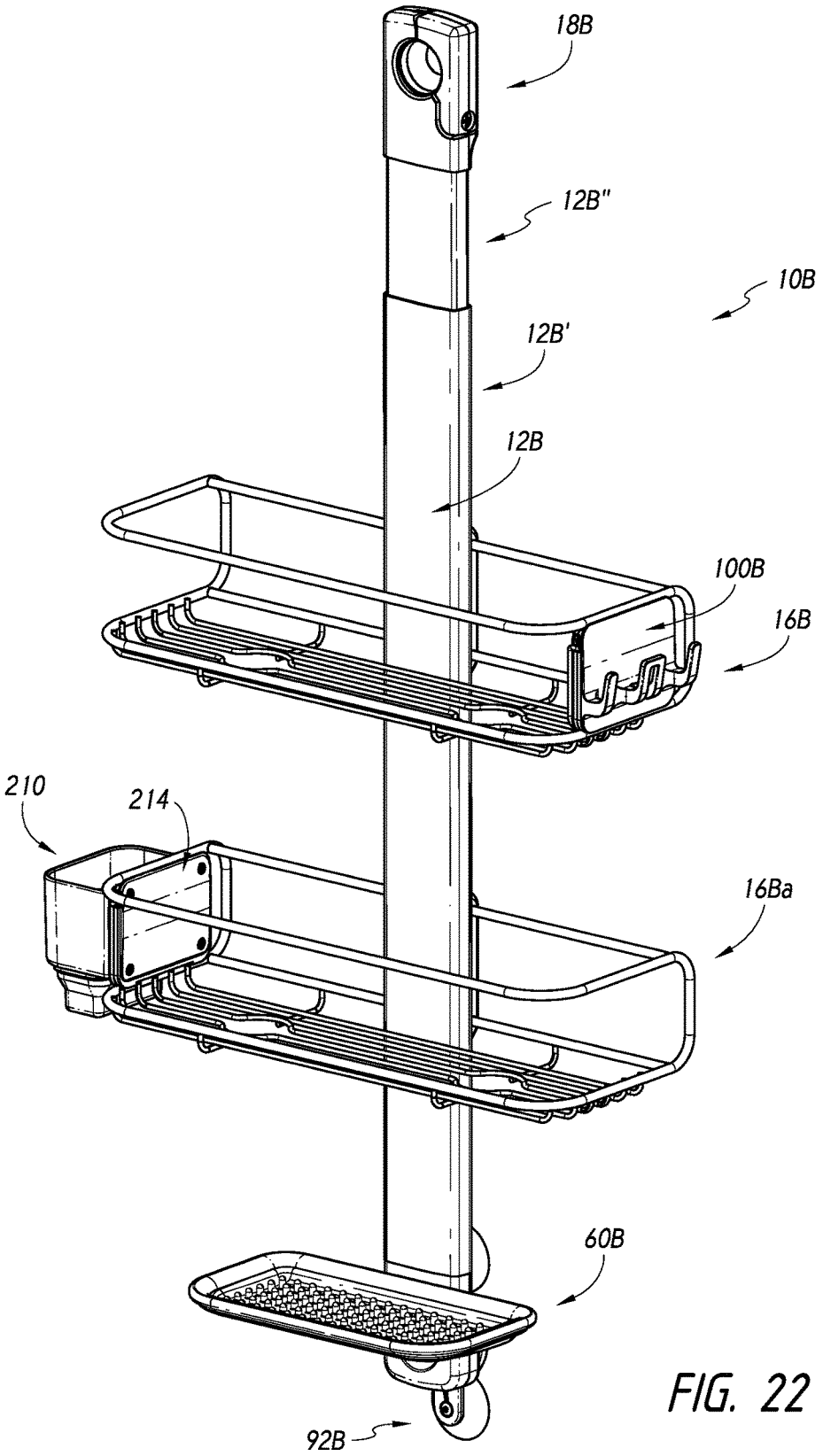
FIG. 22 is a top, front perspective view of another embodiment of a shower caddy.

With reference to FIG. 22, the shower caddy 10B can include an elongated support member 12B and at least one shelf 16B. As shown, the shower caddy 10B can include an openable loop mechanism 18B configured to support the weight of the shower caddy 10B from a shower head (not shown) or a pipe leading to a shower head. In some implementations, the caddy 10B includes a soap tray 60B.

In various embodiments, the support member 12B and/or the shelf 16B are adjustable. For example, in certain implementations, an elongate length of the support member 12B is configured to be selectable and/or variable, such as by telescoping. For example, the support member 12B can include an outer portion 12B' and an inner portion 12B" that can be received in, and slide relative to, the outer portion 12B'. In some variants, the length of the support member 12B is fixed (e.g., does not include a telescoping feature).

In some embodiments, the shelf 16B can move along the support member 12B. For example, in some variants, the shelf 16B can slide generally parallel with a longitudinal axis of the support member 12B (e.g., generally vertically in the embodiment illustrated). In certain implementations, the shelf 16B can move generally perpendicular to the support member 12B (e.g., generally horizontally in the embodiment illustrated). In some embodiments, the shelf 16B can be selectively secured with the support member 12B, such as with the clamping mechanism described above.

As shown in FIG. 22, the shelf 16B can include at least one accessory 100B. In certain embodiments, the accessory 100B is configured to secure to one end of the shelf 16B, such as a lateral end of the shelf 16B. For example, the accessory 100B can be secured with an interference fit between the accessory 100B and the frame of the shelf 16B.

The illustrated accessory 100B is generally rectangular, though various shapes are contemplated as well, such as circular (see FIG. 1). In some embodiments, the accessory 100B includes one or more supports 190, such as hooks, loops, ledges, partial openings, cups, cavities, containers, etc.

Figure 22A:
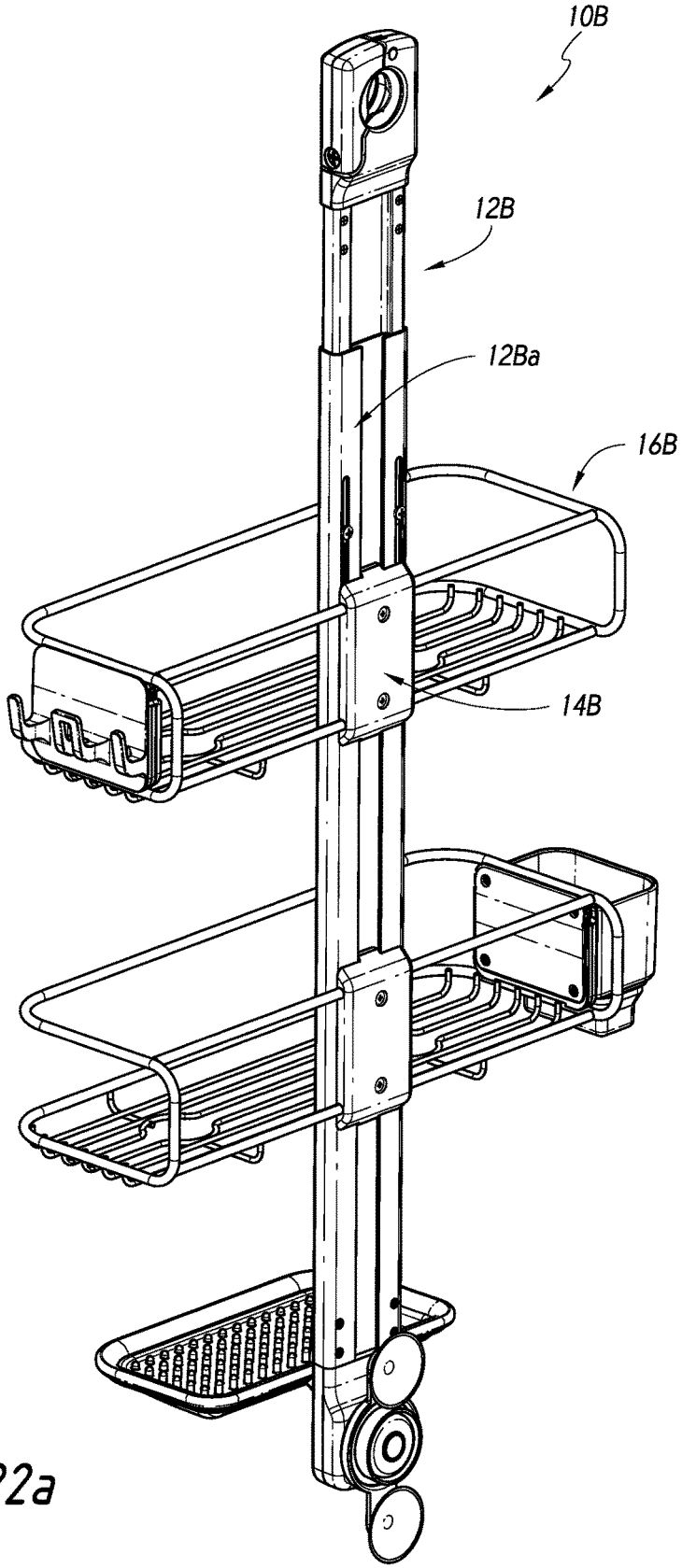
FIGS. 22*a* and 22*b* are top, rear perspective and cross-sectional views of the shower caddy of FIG. 22.
Figure 22B:
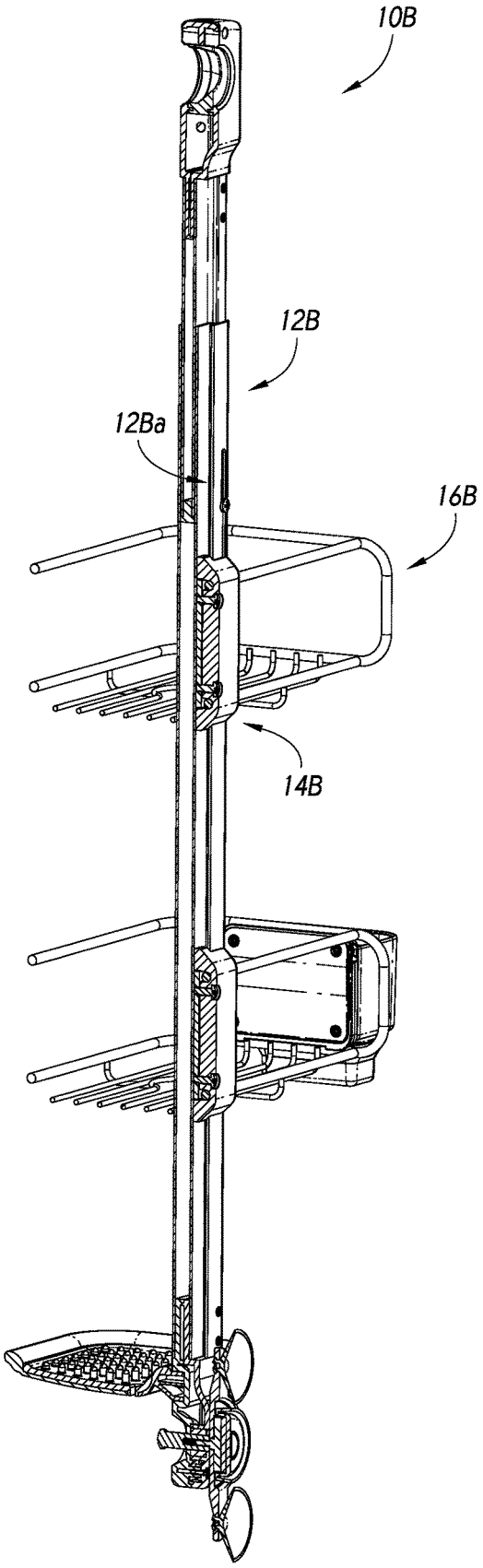

As shown in FIGS. 22*a* and 22*b*, the shower caddy 10B can include one or more clamping mechanisms 14B. The clamping mechanism 14B can secure the shelf 16D with the support member 12B. For example, the clamping mechanism 14B can include one or more fasteners (e.g., screws, bolts, nuts, toggles, cotter pins, etc.) that engage the support member 12B. As discussed in more detail below, the clamping mechanism 14B can include a rail with flanges that engage a corresponding track 12Ba with flanges on the support member 12B. In various embodiments, tightening the fasteners secures the clamping mechanism 14B and/or the shelf 16D to the support member 12B. In some variants, loosening the fasteners loosens the clamping mechanism 14B and/or the shelf 16D to the support member 12B, thereby allowing the clamping mechanism 14B and/or the shelf 16D to move relative to the support member 12B (e.g., to allow adjustment of the vertical and horizontal position of the shelf 16D).

As illustrated in FIGS. 23-26, the accessory 100B can include a divider 194 configured to selectively divide a portion of the shelf 16B. This can facilitate securing and/or sequestering certain articles in a space at least partially divided from the rest of the shelf 16B. In some embodiments, the divider 194 can aid in maintaining certain elongate articles in a generally vertical orientation, rather than a horizontal orientation, which can provide additional space for further articles. For example, in certain embodiments, an elongate article (e.g., an electric razor) stowed in the divided portion can be maintained an angle relative to a horizontal plane of at least about: 45°, 60°, 75°, 80°, 85°, values between the aforementioned values, or otherwise.

Figure 23:
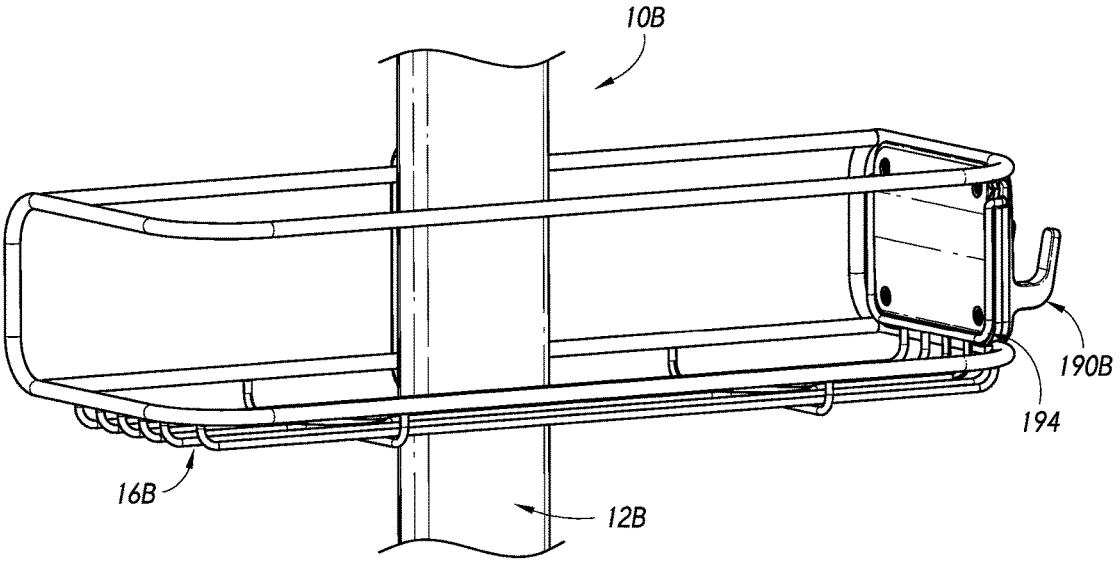
FIG. 23 is a perspective view of a portion of the shower caddy of FIG. 22, including a support structure and a rotatable divider.

The divider 194 can move between first and second positions relative to the accessory 100B and/or with respect to the frame of the shelf 16B. For example, the divider 194 can rotate between retracted and extended positions. In the retracted position, such as is shown in FIG. 23, the divider 194 is generally nested with the accessory 100B and/or substantially does not extend into the volume of the shelf 16B for holding articles. In some variants, the divider 194 is substantially flush with a surface of accessory 100B in the retracted position. In some embodiments, the retracted position occurs when rotatable divider 194 is brought into contact with at least one surface of accessory 100B. When in the retracted position, divider 194 generally does not obstruct the open space of shelf 16B. In some embodiments, the surface of accessory 100B includes a groove or recessed area designed to correspond to and receive at least a portion of divider 194 when the divider 194 is in the retracted position.

Figure 24:
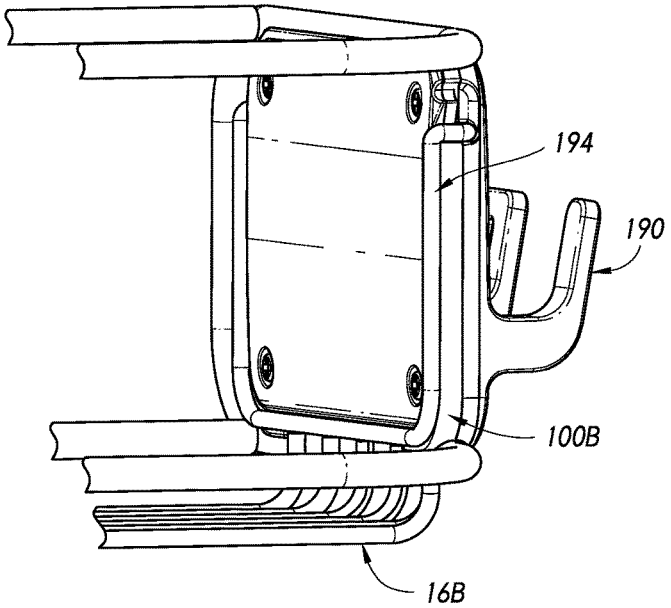
FIG. 24 is an enlarged perspective view of a portion of the shower caddy of FIG. 22, with the rotatable divider in a retracted position.

In certain embodiments, the divider 194 comprises a bar or wire. In some implementations, the divider 194 has a generally U-shaped configuration. In some embodiments, the divider 194 is shaped substantially as a rectangle. In some embodiments, the divider 194 may be shaped as a semicircle or at least a portion of its length may be shaped as a semicircle. In some embodiments, the divider 194 is shaped to accommodate any number of suitable accessories that may be stored on the shelf 16B, such as an electric razor, travel-size bottles (e.g., of shampoo), or otherwise. In various embodiments, the divider 194 includes at least one end 196 that is configured to be secured to the accessory 100B. For example, the end 196 can be shaped as a prong that is configured to be inserted into a corresponding opening or recess in the accessory 100B, as is discussed in greater detail below. In some embodiments, the divider 194 is shaped so as to be flush with the accessory 100B or so as to conform to the shape of the shelf 16B, such that it occupies no more space than necessary, or at least a reduced amount of space, when in a retracted position. As shown in FIG. 24, in the retracted position, the divider 194 does not protrude into the available shelving space on the shelf 16B.

Figure 25:
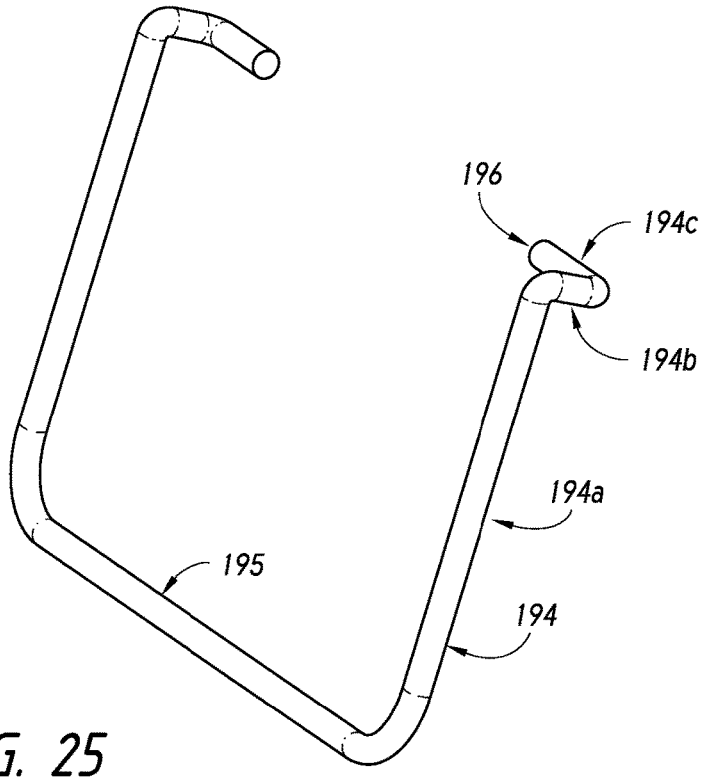
FIG. 25 is a perspective view of the rotatable divider of the shower caddy of FIG. 22.
Figure 26:
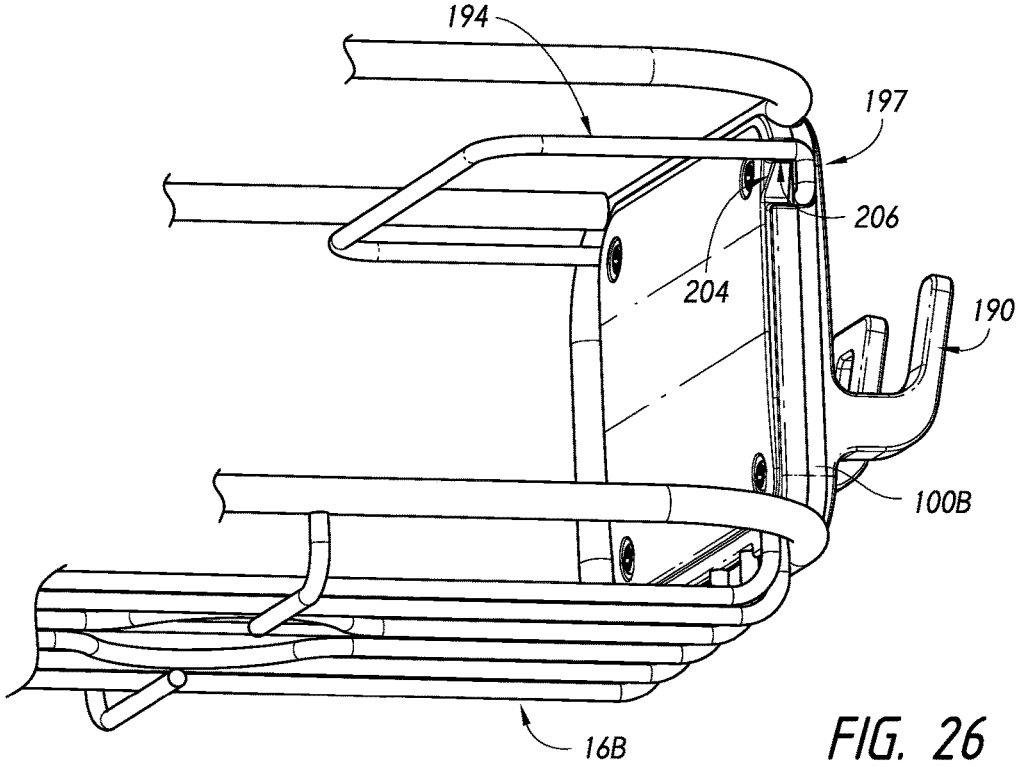
FIG. 26 is a perspective view of a portion of the shower caddy of FIG. 22, with the rotatable divider in an extended position.

As shown in FIG. 25, the divider 194 has at least three sections. In some embodiments, each of the sections can be characterized as occupying a different plane. In some embodiments, section 194*a* occupies a first plane, section 194*b* occupies a second plane (e.g., a plane generally orthogonal to the first plane), and section 194*c* occupies a third plane (e.g., a plane generally orthogonal to the second plane and/or generally parallel to the first plane). In some embodiments, during movement of the divider 194 between the extended and retracted positions, each plane rotates about a pivot located on the accessory 100B. In certain variants, each end of the divider 194 includes the first, second and third sections 194*a-c*. In some implementations, the divider 194 includes a cross-member 195.

When the divider 194 is in the retracted position (see FIG. 24), the first plane may be substantially parallel with a surface of the accessory 100B. In some embodiments, the first plane is near, adjacent, or coexistent with a surface of accessory 100B. In some embodiments, section 194*b* is long enough to allow section 194*a* to be substantially flush with a surface of the accessory 100B while also providing rotatable divider 194 with adequate support from the accessory 100B. When the divider 194 is in an extended position, the first plane extends from the accessory 100B at a substantially right angle (see FIG. 26) and/or is generally horizontal. In this position, section 194*a* is able to enclose or support one or more items, such as a razor, an electric razor, a mechanical facial cleanser, etc.

Figure 27:
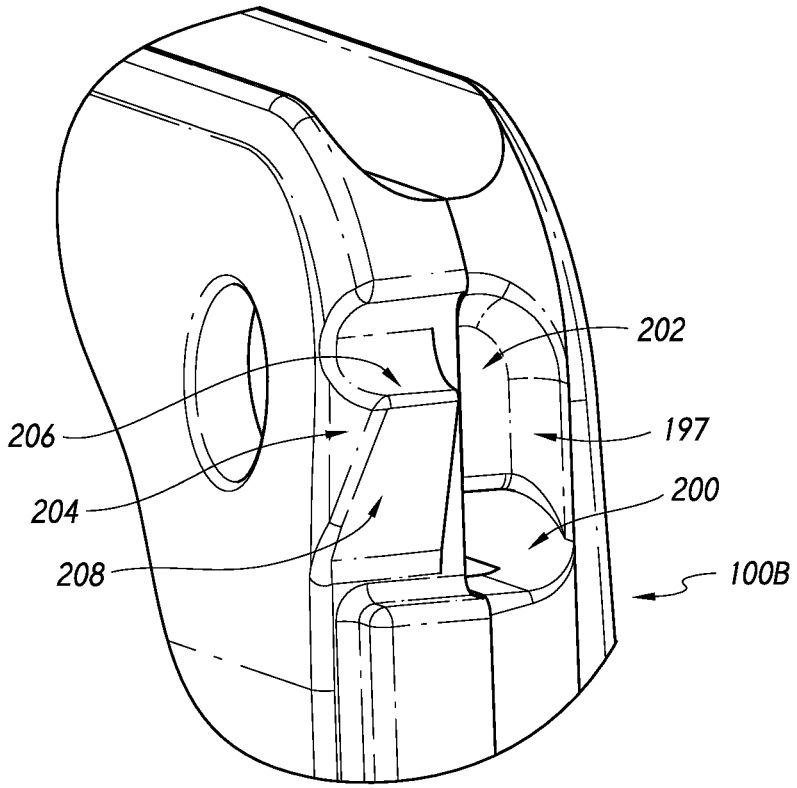
FIG. 27 is an enlarged perspective view of a portion of the support structure of FIG. 22.

In various embodiments, the portions of the divider 194 interact with and/or are received in the accessory 100B. For example, the accessory 100B can include a support structure 197 configured to interact with section 194*b* and/or to receive section 194*c* of the divider 194. As illustrated in FIG. 27, the support structure 197 can include a recess or hole 200, a groove 202, and a detent structure 204. In some embodiments, the accessory 100B includes two corresponding support structures 198. The shape and depth of the recess or hole 200 is configured to receive the end 196 of section 194*c*. This can allow the recess or hole 200 to act as a pivot location for the divider 194. In some embodiments, the groove 202 is shaped so as to correspond or accommodate to section 194*b* and at least a portion of section 194*a* of divider 194 when the divider is in the extended position. As illustrated in FIG. 27, in some implementations, at least a portion of the groove 202 is shaped substantially as an "L."

In some embodiments, the accessory 100B includes a securing structure, such as a detent structure 204, that is configured to secure and/or support the divider 194 in the extended position. In certain implementations, the detent structure 204 is located at the intersection of the two segments of the L-shaped groove 202. In some embodiments, the detent structure 204 is located toward the end of one of the segments of the L-shaped groove 202. The detent structure 204 is shown as including a ledge 206 and a slope 208, though it will be understood that other configurations could be used to adequately support the divider 194.

In some embodiments, when the divider 194 is moved between the retracted and expanded positions, the divider 194 engages components of the detent structure 204. For example, when the divider 194 is moved from the retracted position, the segment 194*a* can slide along the slope 208, can reach the ledge 206, and/or can be received in the groove 202. In some implementations, a user can grasp the cross-member 195 and apply a force to rotate the divider 194 (e.g., generally toward a midpoint of the shelf 16B, in the clockwise direction from the position shown in FIG. 23, or otherwise). In various embodiments, when the divider 194 is in the extended position, the ledge 206 can support the divider 194. This can inhibit counter-rotation of the divider 194 (e.g., to the retracted position) and/or otherwise facilitate maintaining the divider 194 in the extended position.

To move the divider 194 from the extended position to the retracted position, a force can be applied to the divider 194 to encourage counter-rotation of the divider 194. For example, a user can apply force to the cross-member 195. In some embodiments, when the divider 194 is moved from the extended position to the retracted position, the portion of the divider 194 that is engaged (e.g., abutted) with the ledge 206 can move over the ledge 206 and down the slope 208. In some embodiments, a greater amount of force is needed to move the divider 194 from the extended position to the retracted position than to move the divider 194 from the retracted position to the extended position. In certain variants, a greater amount of initial of force is needed to begin rotating the divider 194 from the extended position to the retracted position than is needed to begin rotating the divider 194 from the retracted position to the extended position.

Figure 28:
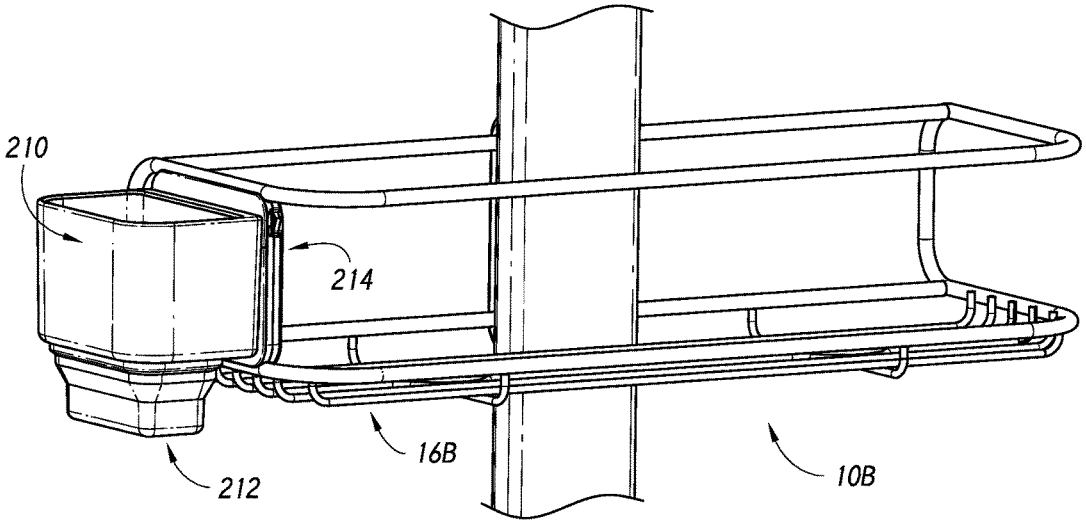
FIG. 28 is a perspective view of another portion of the shower caddy of FIG. 22, with an expandable container.
Figure 29:
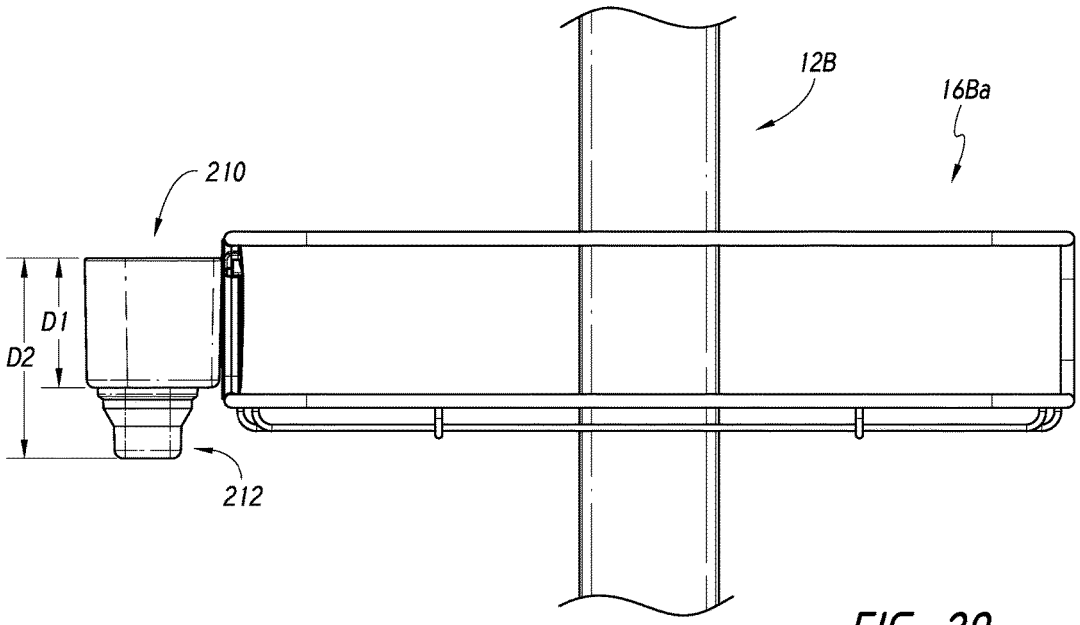
FIG. 29 is a front elevation view of the portion of the shower caddy of FIG. 28.
Figure 30:
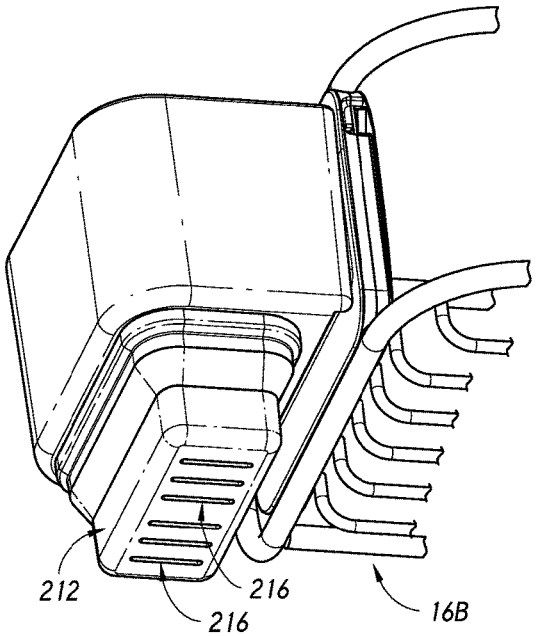
FIG. 30 is a front, bottom perspective view of the underside of the expandable container of FIG. 28.

With reference to FIGS. 28-30, some embodiments of the caddy 10B include a container 210 secured to a shelf 16Ba. For example, the container 210 can be part of a support structure 214 engaged with the shelf 16Ba. In some embodiments, the support structure 214 is similar or identical to the accessory 100B and may be secured to the shelf in a similar manner. In some embodiments, the support structure 214 includes the divider 194. In certain variants, the accessory 100B includes the container 210.

As illustrated, in some implementations, the support structure 214 and the accessory 100B are located on opposite sides of the longitudinal axis of the elongate member 12B. This can facilitate balancing the caddy 10B. For example, from the vantage of a front elevation view, the accessory 100B can be on a right portion of one of the shelves 16B, 16Ba, and the support structure 214 can be on a left portion of the other of the shelves 16B, 16Ba. In some embodiments, the shelves 16B, 16Ba each include the accessory 100B and the support structure 214.

The container 210 can include an expandable bottom portion 212. The illustrated container 210 has four walls; however, the container 210 may include any number of walls, both exterior and interior, and may include no walls. In some embodiments, the container 210 includes a lip (e.g., a bar) around some or all of a top perimeter portion, so as to keep an item (e.g., a razor brush, toothbrush, etc.) contained within the container 210. This can reduce or eliminate the need for the container 210 to have solid walls.

In some implementations, the container 210 can have an expandable bottom portion 212. In certain embodiments, the extendable bottom portion 212 can be extended generally downward (e.g., toward a floor of the shower) from the container 210. For example, the extendable bottom portion 212 can include an accordion-like portion, telescoping portion, or other portion configured to facilitate movement of the bottom of the container 210 between extended and retracted positions. In various implementations, the expandable bottom portion 212 may be formed of a flexible material, such as silicone, rubber, plastic, or another suitable material.

Certain variants are configured to allow a user to select the amount (e.g., length or volume) of extension of the bottom portion 212. For example, the extendable bottom portion 212 can include discrete positions during the course of extension. In some variants, the expandable bottom portion 212 is formed of one or more extendable segments, such as multiple nested telescoping sections or multiple nested accordion-like sections.

As shown in FIG. 29, with the expandable bottom portion 212 retracted the container can have an overall depth of D1, and with the expandable bottom portion 212 extended the container can have an overall depth of D2. In some embodiments, the ratio of D1 to D2 is at least about: 1.1, 1.2, 1.3, 1.4, 1.5, 1.6, 1.7, 1.8, 1.9, 2.0, values between the aforementioned values, or otherwise. In some implementations, the expanded bottom portion 212 provides at least about 12 mm of additional depth for the container 210, compared to the depth of the container when the bottom portion 212 is retracted.

The expandable bottom portion 212 can facilitate accommodating elongate items that, absent the extra depth, may more easily fall out of expandable container 210, perhaps due to being top heavy. For example, some razors have an elongate portion (e.g., the handle) and a head portion (e.g., the razor portion) that weighs substantially more than the elongate portion. When items of that type are stored in a substantially upright configuration (e.g., in a cup) they tend to fall out if the cup has insufficient depth. The expandable bottom portion 212 can provide the container 210 with additional depth, thereby better supporting such elongate items and/or can reducing the likelihood of such items falling out of the container 210.

As shown in FIG. 30, the bottom portion 212 can include slots 216, such as openings. This can promote drainage from the container 210 and/or facilitate drying of the interior of the container 210 and items stored therein, which can reduce or avoid bacterial and mold growth within the container 210. In some embodiments, at least some of slots 216 have a linear or curved (e.g., wavy) shape. In some variants, the slots 216 have a shape that is generally circular, ovoid, square, rectangular, etc.

Figure 31:
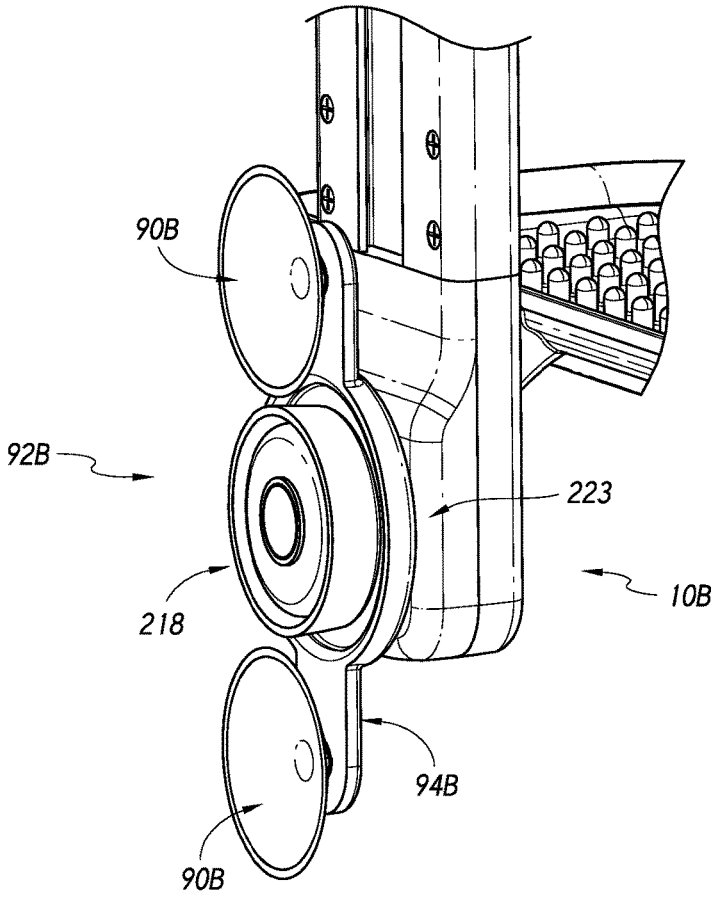
FIG. 31 is a rear perspective view of a portion of the shower caddy of FIG. 22, with an attachment mechanism.
Figure 32:
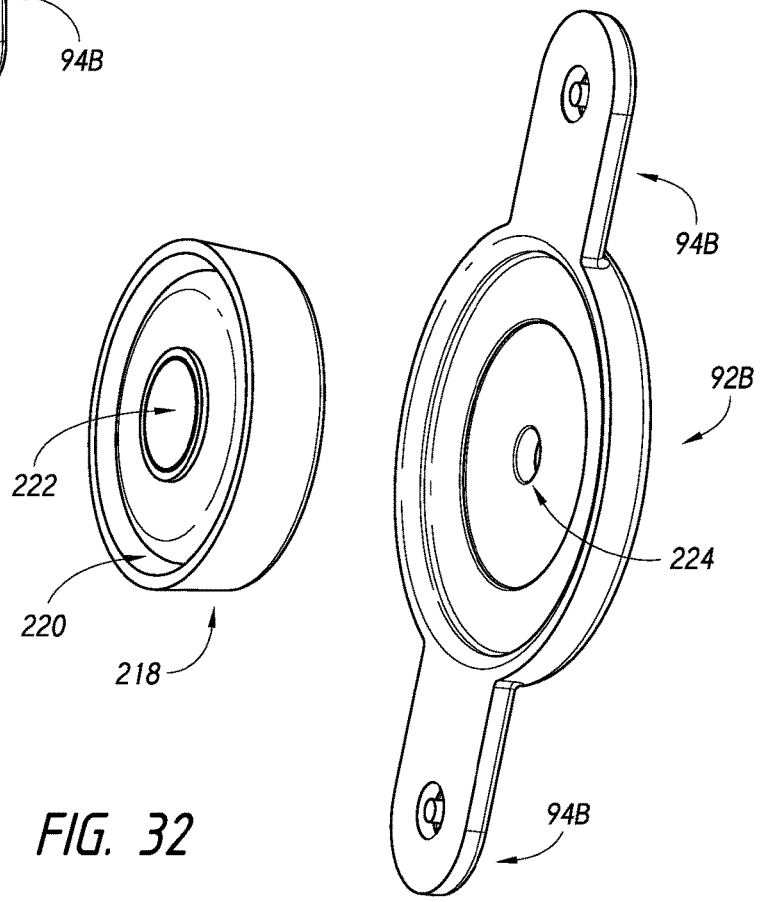
FIG. 32 is an exploded perspective view of a portion of the attachment mechanism of FIG. 31.
Figure 33:
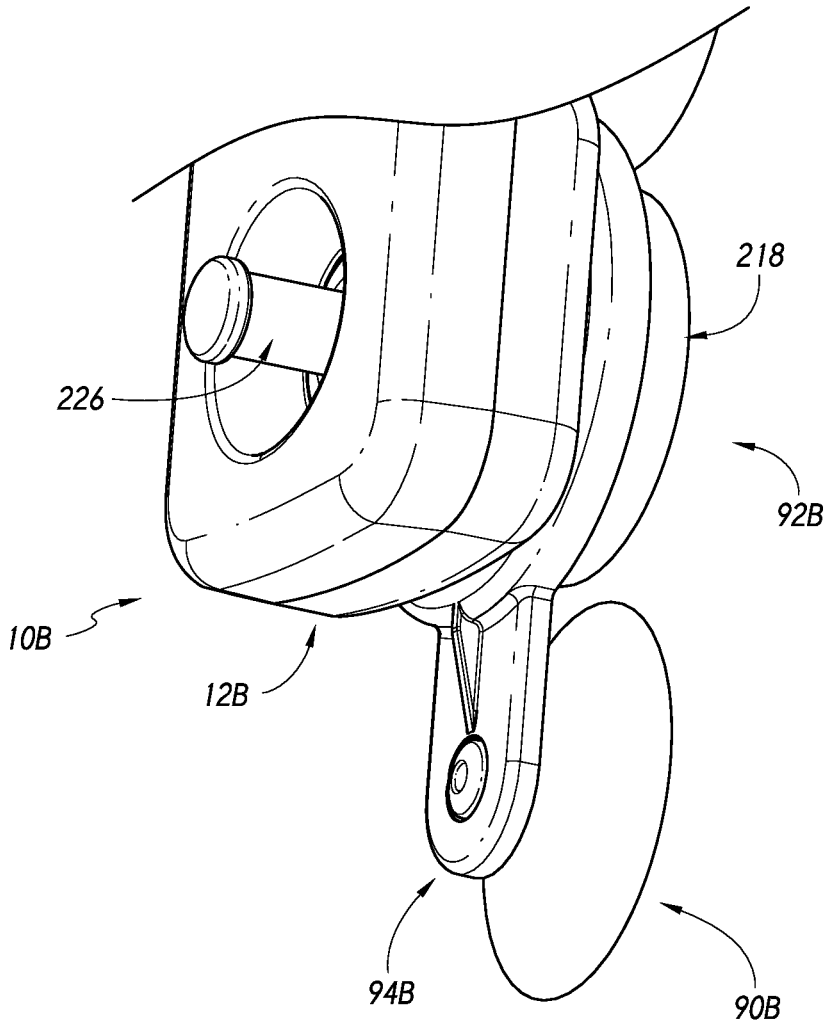
FIG. 33 is a front, bottom perspective view of the portion of the shower caddy of FIG. 31.

With reference to FIGS. 31-33, the shower caddy 10B can be secured to a shower wall with an attachment mechanism 92B. As illustrated, in some embodiments, the attachment mechanism is located at a bottom of the shower caddy 10B, which can promote stability (e.g., inhibit tilting). As shown, the attachment mechanism 92B can include a bracket, which can have one or more arms 94B. In some embodiments, attachment mechanism 92B includes wall connection features, such as suction cups 90B. As shown, the suction cups 90B can be located at opposite ends of the bracket and/or on each of the arms 94B.

In various embodiments, the attachment mechanism 92B is rotatable about a pivot point such that the suction cups 90B can rotate about the pivot point. This can aid in positioning at least one of the suction cups 92B relative to a surface to which they can be secured. For example, rotation of the attachment mechanism 92B can facilitate securing at least one (and preferably both) of the suction cups 90B to a smooth surface and/or can aid in avoiding engaging at least one of the suction cups 90B with tile edges and/or grout lines. In various embodiments, the attachment mechanism 92B is fully rotatable around the pivot point (e.g., can rotate 360° around the pivot point).

In some embodiments, the attachment mechanism 92B includes a hub 218 that is separable from the remainder of the caddy 10B. According to some embodiments, the separability of the hub 218 aids in positioning and securing the hub 218, as is discussed in more detail below. In some embodiments, the caddy 10B is configured such that the hub 218 is installed on the wall of a shower prior to the remainder of the caddy 10B being installed. Various embodiments of the hub 218 are configured to engage with a mating portion 223 of the attachment mechanism 92B. For example, at least a portion of the hub 218 and the mating portion 223 are magnetically attracted. In some embodiments, one of the hub 218 and the mating portion 223 can include a magnet and the other of the hub 218 and the mating portion 223 can include a material attracted to the magnet. In certain implementations, the hub 218 and/or the mating portion 223 can include a portion made of ferromagnetic material.

As shown in FIG. 32, the hub 218 can include a mounting area 222. In some embodiments, the mounting area 222 is configured to receive an adhesive, such as a double sided tape. This can allow a user to secure hub 218 to a surface, such as a shower wall. In various implementations, the hub 218 is secured to the surface when the hub 218 is separated from the remainder of the caddy 10B. In some embodiments, the adhesive is water resistant.

In some embodiments, the hub 218 includes a recess 220 that extends around some or all of the mounting area 222. The recess 220 can receive a water-resistant material, such as caulking, silicone, or some other suitable sealant that substantially inhibits or prevents water passage. This can reduce or eliminate water from accessing the adhesive material located on mounting area 222, which can increase the life of certain adhesives. In certain variants, the recess 220 allows the sealant to be hidden, thereby maintaining a cleaner appearance (e.g., compared to applying sealant around the exterior of hub 218).

In certain implementations, the attachment mechanism 92B includes only the suction cups 90B. In some embodiments, the attachment mechanism 92B includes only the hub 218 and the mating portion 223. In some embodiments, the attachment mechanism 92B includes both the hub 218 and the mating portion 223 as well as the suction cups 90B. In embodiments where both are included, rotation of the attachment mechanism 92B allows for the positioning of the suction cups 90B on smooth surfaces, while the adhesive material applied to the mounting area 222 to secure hub 218 to a wall may be able to function even if it is located at the edge of a tile, between tiles, or adjacent grout.

Figure 33A:
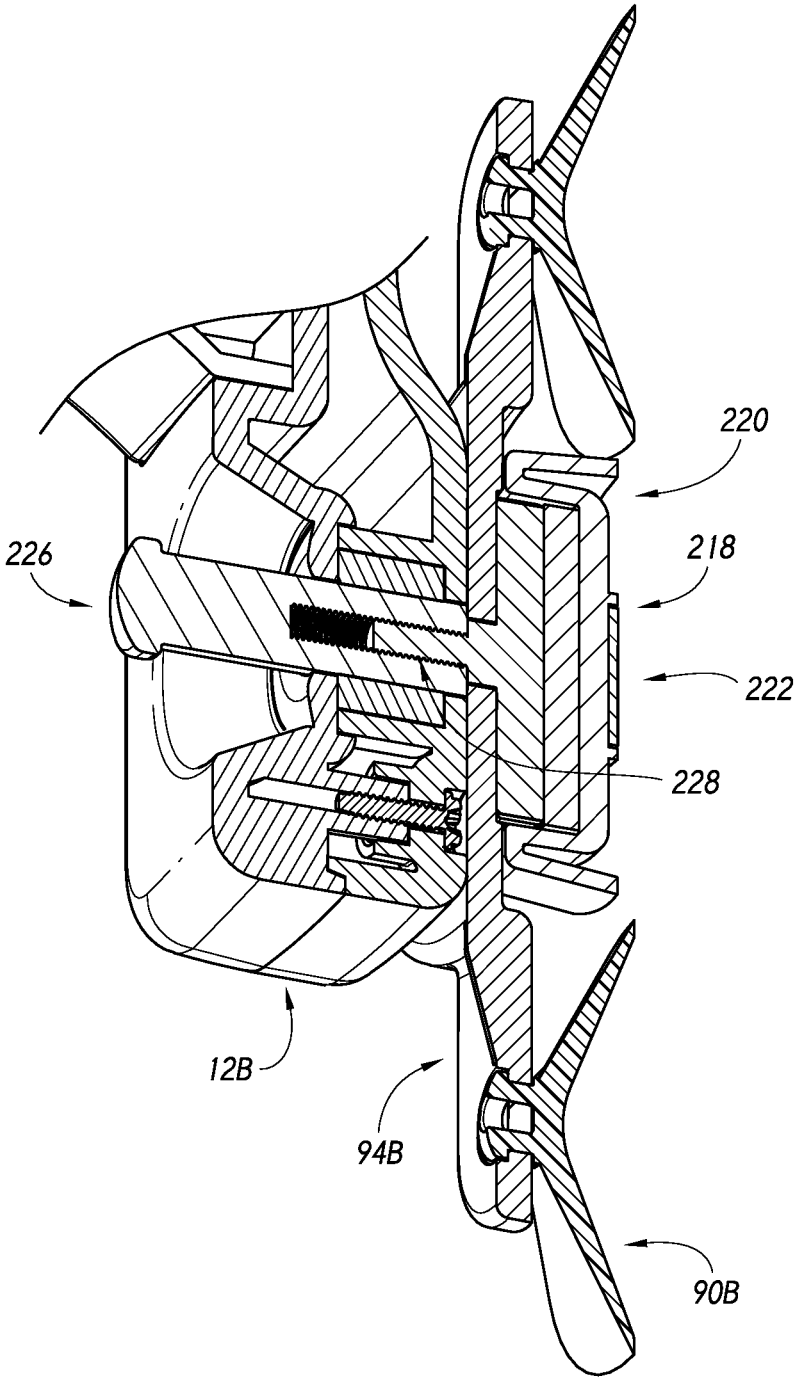
FIG. 33*a* is a cross-sectional perspective view of the shower caddy of FIG. 33.

According to some embodiments, the attachment mechanism 92B includes a distance adjustment unit, such as is shown in FIGS. 33 and 33*a*. The distance adjustment unit can be configured to enable a user to adjust the distance between the attachment mechanism 92B and a shower wall. This can aid in making the distance between the shower caddy 10B and the wall substantially uniform along the vertical length of shower caddy 10B, which can aid in maintaining various surfaces (e.g., the shelves 16B) in a substantially flat state. The distance adjustment unit can include an adjustment member 226, such as a threaded element (e.g., a screw, pin, or otherwise). In some embodiments, the adjustment member 226 is configured such that actuation (e.g., rotation) of the adjustment member 226 increases or decreases the distance between the attachment mechanism 92B and a wall (e.g., a shower wall). For example, in the embodiment shown in FIG. 33*a*, the adjustment member 226 threadably connects with a mating portion 228 of the hub 218 and rotation of the adjustment member 226 drives the hub 218 nearer or farther from the support member 12B. Thus, when the hub 218 is mounted to the wall, the adjustment member 226 can enable a user to vary the amount of distance between the support member 12B and the hub 218. In some implementations, the adjustment member 226 passes through a through-hole 224 in the support member 12B and/or the bracket. In certain variants, the adjustment member 226 is connected with the support member 12B such that the adjustment member 226 can rotate but not translate.

Figure 34:
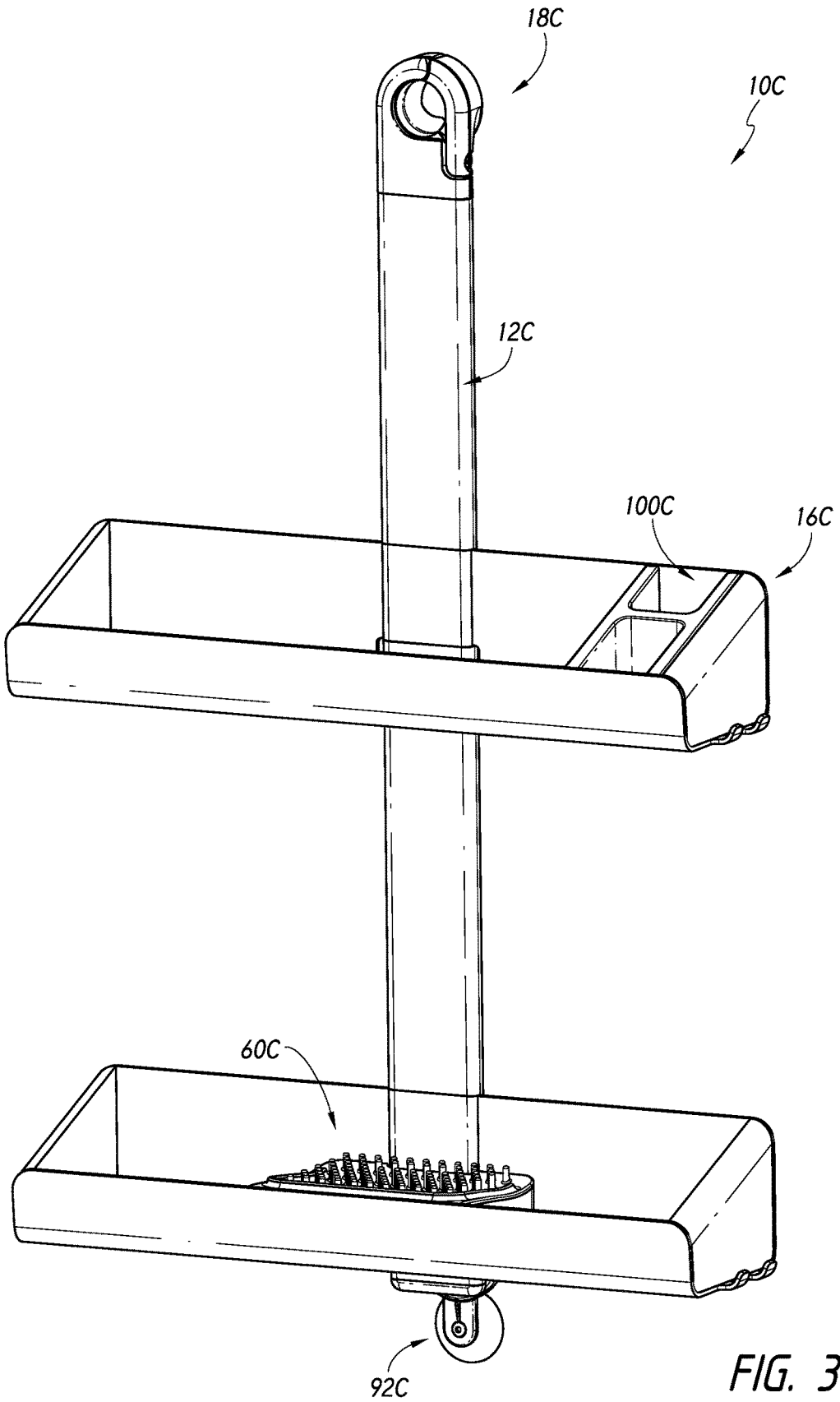
FIG. 34 is a top, front perspective view of another embodiment of a shower caddy.
Figure 35:
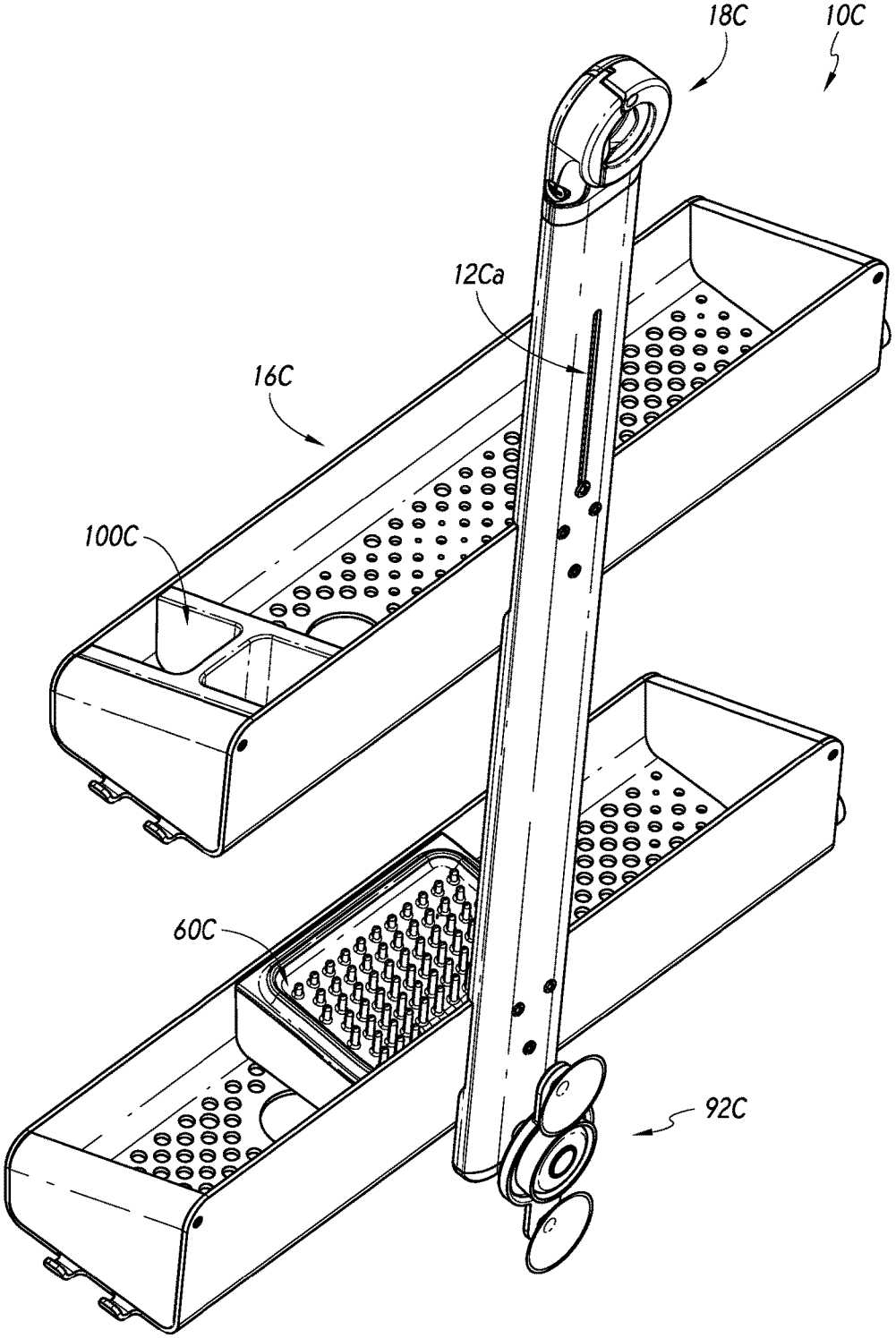
FIG. 35 is a top, rear perspective view of the shower caddy of FIG. 34.
Figure 36:
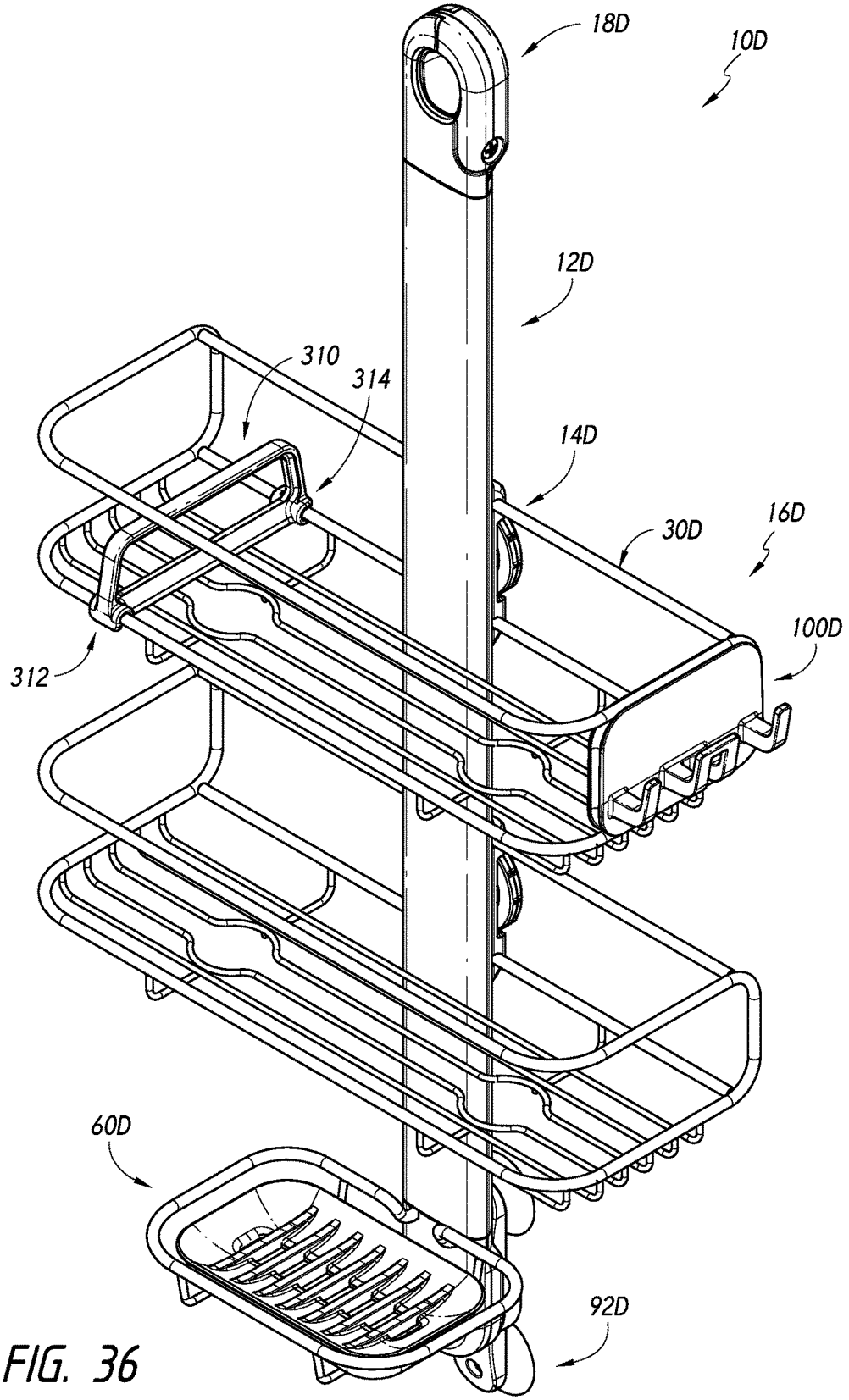
FIG. 36 is a top, front perspective view of another embodiment of a shower caddy.
Figure 37:
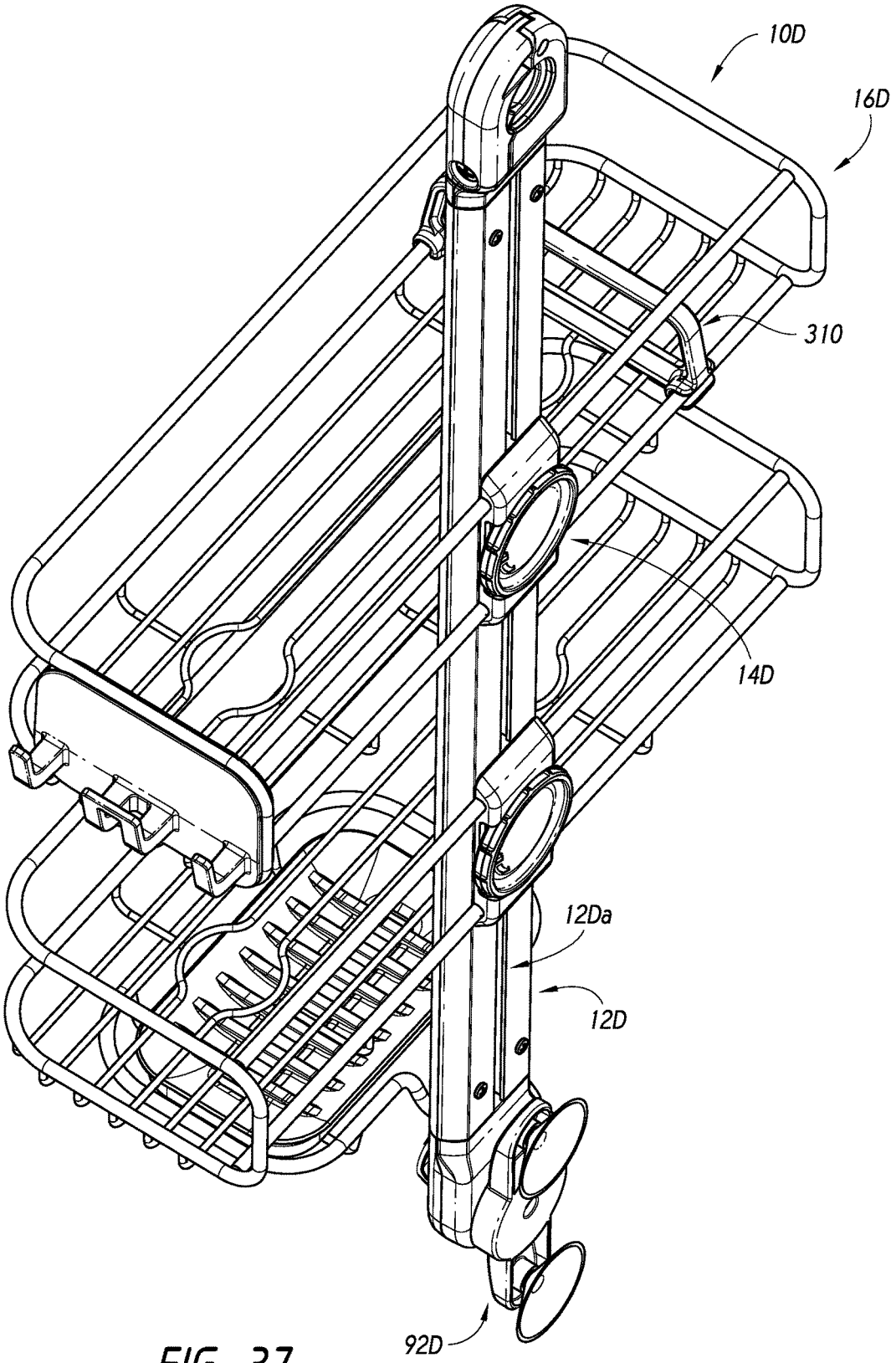
FIG. 37 is a top, rear perspective view of the shower caddy of FIG. 36.

FIGS. 34 and 35

FIGS. 34 and 35 illustrate an embodiment of another shower caddy 10C. In many respects, the shower caddy 10C resembles or is identical to any of the shower caddies 10, 10A, 10B discussed above. As such, components of the shower caddy 10C that are the same or similar to the corresponding components of the shower caddy 10, 10A, and/or 10B are identified below with the same reference numerals except that a letter "C" has been added thereto. The shower caddy 10C can include one, some, or all of the features of the shower caddy 10, 10A, and/or 10B, including all combinations and sub-combinations. Any component or step disclosed in any embodiment in this specification can be used in any other embodiment.

In various embodiments, the shower caddy 10C can include an elongated support member 12C and at least one shelf 16C. In certain implementations, the support member 12C can be configured to have a variable length, such as with one or more telescoping sections. In certain embodiments, the support member 12C can be secured at a desired length. For example, the length can be maintained with a fastener, such as a screw, pin, detent, ratchet mechanism, or otherwise. In some embodiments, the fastener can slide in a track 12Ca of the support member 12C. As is shown, the shower caddy 10C can include a loop mechanism 18C that is configured to support the weight of the shower caddy 10C, such as from a shower head (not shown) or a pipe leading to a shower head. The mechanism 18C can be configured to open, such as with a hinged connection. In some implementations, the caddy 10C includes a soap tray 60C, which can be positioned in one of the shelves 16C. Some embodiments include an accessory 100C, such as an insert or divider. In certain variants, the accessory 100C is removable from the shelf 16C. The shower caddy 10C can include an attachment mechanism 92C, which can be positioned at a bottom portion of the caddy 10C.

In some embodiments, the shelves 16C are rigidly attached with the support member 12C. In certain variants, the shelves 16C are configured to move vertically and/or horizontally with respect to the support member 12C, such as is described above. For example, any of the shelves 16C can include the clamping mechanism described above. As shown, the shelves 16C can include one or more hooks or other mounts. The bottom of the shelves 16C can include slots (e.g., holes) to facilitate drainage and/or airflow. In some embodiments, one or more walls of one or more shelves 16C can be solid, and/or generally solid, and/or not predominantly or entirely made of wire, and/or generally planar. For example, as illustrated, one or more of a front wall, a rear wall, a left wall, and/or a right wall can each or all be generally planar and/or generally solid. One or more such walls can help to obscure disorganized or cluttered contents, providing a more clean and smooth aesthetic for the shelving. In certain embodiments, the shelves 16C and/or the support member 12C are metal, such as stainless steel or aluminum.

FIGS. 36-42

FIGS. 36-42 illustrate an embodiment of another shower caddy 10D. In many respects, the shower caddy 10D resembles or is identical to any of the shower caddies 10-10C discussed above. Components of the shower caddy 10D that are the same or similar to the corresponding components of the shower caddy 10, 10A, 10B, and/or 10C are identified below with the same reference numerals except that a letter "D" has been added thereto. The shower caddy 10D can include one, some, or all of the features of the shower caddy 10, 10A, 10B, and/or 10C, including all combinations and sub-combinations. Any component or step disclosed in any embodiment in this specification can be used in any other embodiment.

As illustrated in FIGS. 36-39, the shower caddy 10D can include an elongated support member 12D and at least one shelf 16D. For example, the shower caddy 10D can have one, two, three, four, or more shelves. As shown, the shelf 16D can include at least one cross member 30D. Some embodiments of the shower caddy 10D have an openable loop mechanism 18D that is configured to support the weight of the shower caddy 10D, such as from a shower head (not shown) or a pipe leading to a shower head. Certain embodiments have an attachment mechanism 92D that is configured to secure the shower caddy 10D to a shower wall.

In some implementations, the shower caddy 10D includes features to aid in organizing and/or accessing bathing implements. For example, the shower caddy 10D can have a soap tray 60D, which can be positioned below one or all of the shelves 16D. Some embodiments have an accessory 100D that includes one or more supports, such as hooks, loops, ledges, partial openings, cups, cavities, containers, etc.

In some embodiments, the shower caddy 10D includes a handle and/or a divider 310. As shown, in some embodiments, the divider 310 can engage with portions of the shelf 16D, such as with a first end 312 that engages a first support member of the shelf 16D and a second end 314 that engages a second support member of the shelf 16D. In various embodiments, the divider 310 is readily disengagable from the shelf 16D, such as to facilitate repositioning of the divider 310. For example, in the illustrated embodiment, the front end 312 of the divider 310 can be rotated about the second end 314, thereby allowing removal of the divider 310 from the shelf 16D. As shown, in some embodiments, the front end 312 and the second end 314 each have recesses that receive the respective first and second support members of the shelf 16D. The opening of these recesses can be oriented in generally perpendicular directions. For example, in FIG. 36, the recess in the front end 312 opens downward (e.g., in a generally vertical direction) and the recess in the second end 314 opens rearward (e.g., in a generally horizontal direction). In certain implementations, the divider 310 can be repositioned while remaining engaged with the shelf 16D. For example, in the embodiment illustrated, the divider 310 can slide relative to the shelf 16D while remaining engaged with the shelf (e.g., not needing to be removed from the shelf 16D).

In various embodiments, the shower caddy 10D includes one or more clamping mechanisms 14D, such as one clamping mechanism 14D associated with each shelf 16D. The clamping mechanism 14D can be configured to secure the shelf 16D with the support member 12D, as will be discussed in more detail below. In certain embodiments, the clamping mechanism 14D is positioned on the rear of the shower caddy 10D and/or engages a rear wall of the support member 12D. Rearward location of the clamping mechanism 14D can aid in obscuring the clamping mechanism 14D from view, protecting the clamping mechanism 14D from damage due to being impacted by bath implements (e.g., shampoo bottles), providing a streamlined (e.g., generally uninterrupted) front face of the support member 12D, and/or increasing the amount of usable space in the shelf 16D (e.g., by not taking-up space with the clamping mechanism 14D). In some embodiments, from a front elevation view of the shower caddy 10D, the clamping mechanism 14D is substantially obscured from view, such as by permitting only a user-actuatable portion (e.g., a lateral region of a dial or lever) to be exposed in the front view only as needed to contact a user's fingers. In some implementations, from a front elevation view of the shower caddy 10D, a great majority (e.g., at least about: 90%, 95%, 99%, 99.9%, percentages between the aforementioned percentages, or other percentages) of the total surface area of the clamping mechanism 14D is obscured from view.

Figure 38:
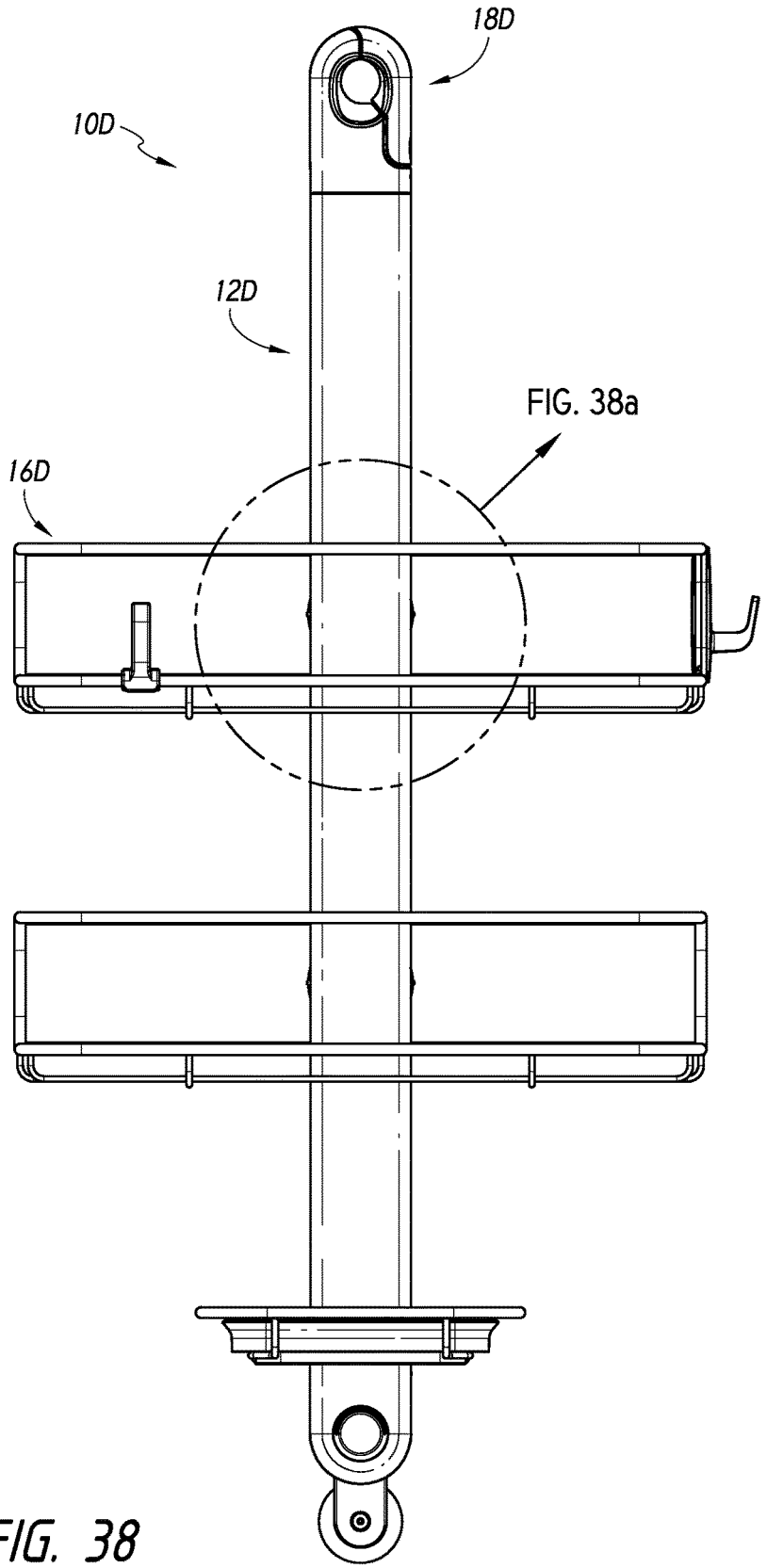
FIG. 38 is a front elevation view of the shower caddy of FIG. 36.
Figure 38A:
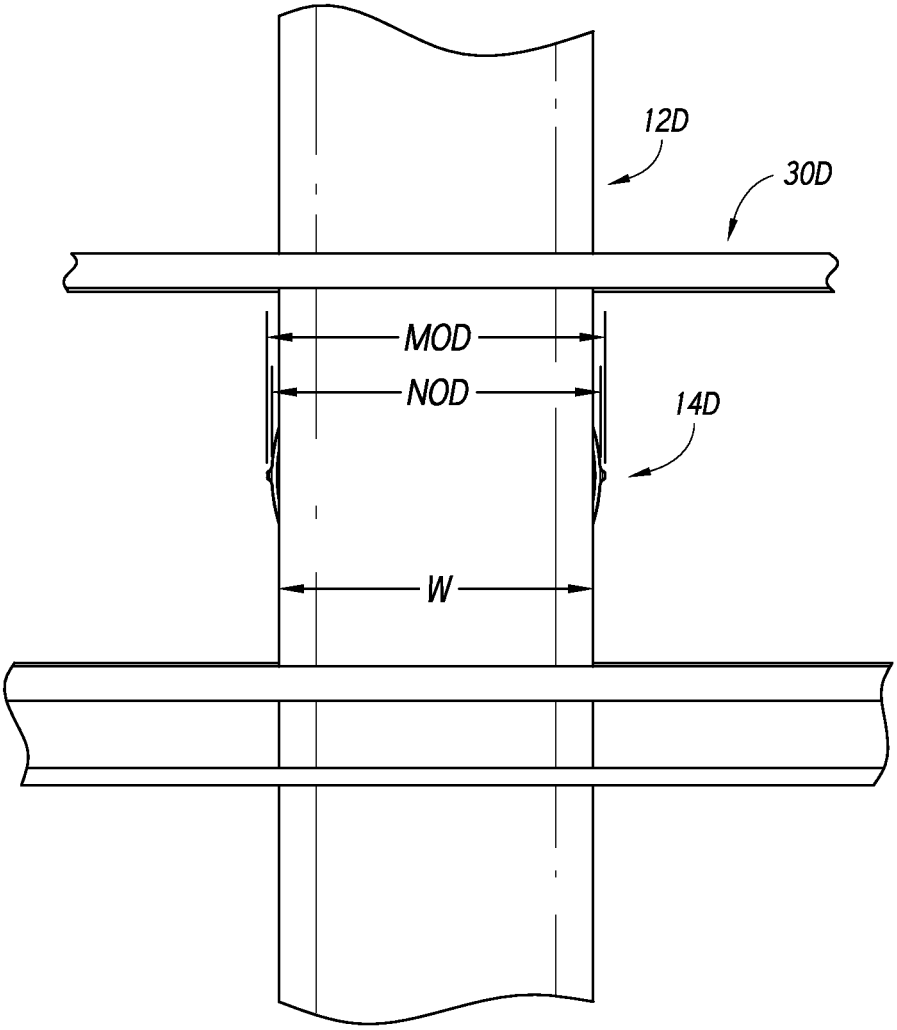
FIG. 38*a* is an enlarged view of a portion of FIG. 38.
Figure 39:
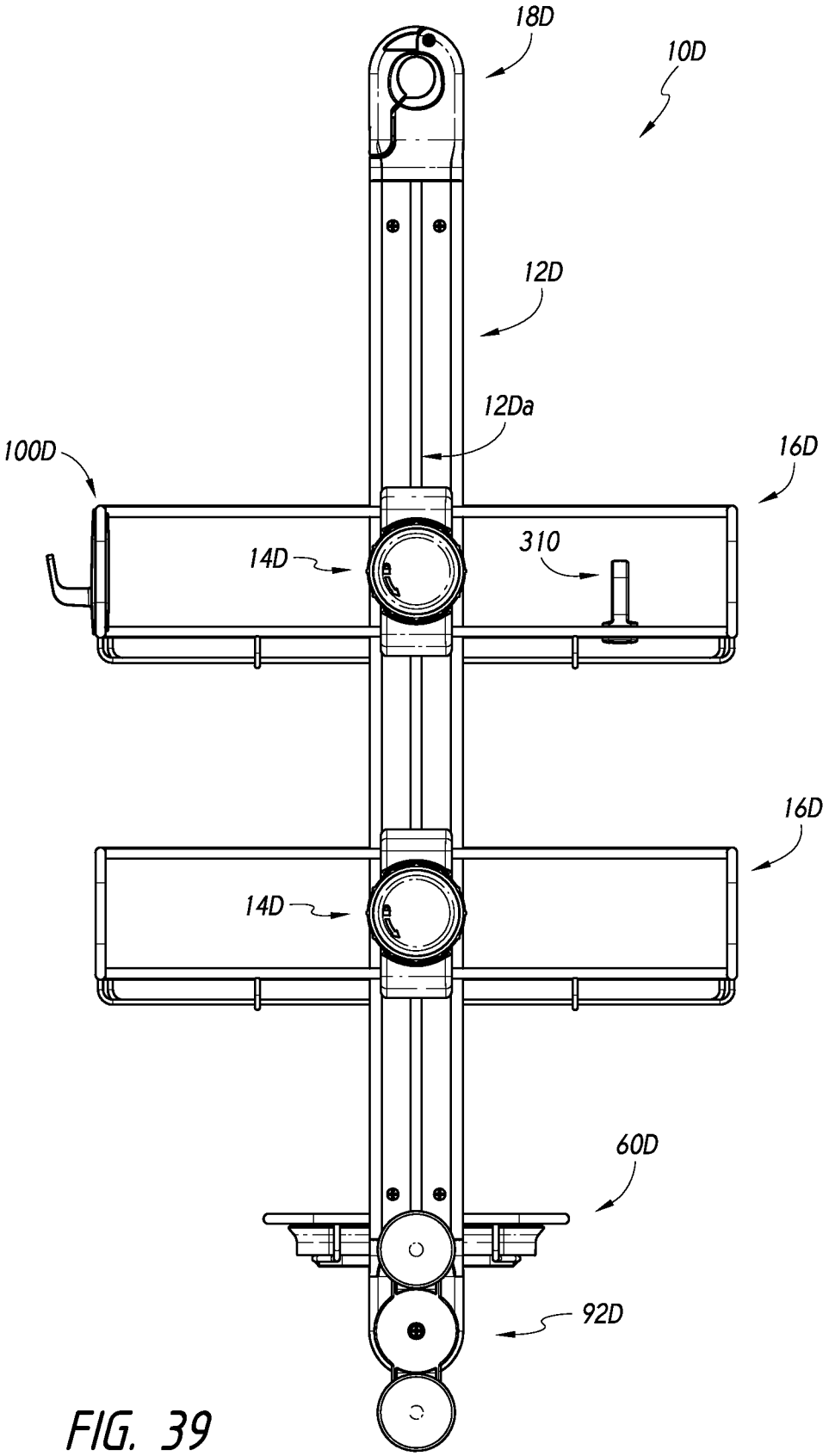
FIG. 39 is a rear elevation view of the shower caddy of FIG. 36.

In various embodiments, the clamping mechanism 14D is accessible from the front of the shower caddy 10D and/or without needing to turn the shower caddy 10D around. For example, as shown in FIGS. 38, 38*a*, and 39, although the clamping mechanism 14D is positioned on the rear of the shower caddy 10D, the clamping mechanism 14D can have an adjustment portion 320 (e.g., a dial or lever) with an outside diameter that is greater than the lateral width W of the support member 12D. This can allow a user to grip and/or actuate (e.g., rotate) the adjustment portion 320 from the front of the shower caddy 10D. For example, in some embodiments, the shower caddy 10D is configured to allow a user to hook a thumb and finger around opposite lateral sides of the support member 12D to actuate the adjustment portion 320 of the clamping mechanism 14D. In some implementations, such as is shown in FIG. 38*a*, the adjustment portion 320 protrudes laterally outward beyond one or both lateral sides of the support member 12D. In certain variants, a majority of the surface area of the adjustment portion 320 can be obscured by the support member 12D from a front elevation view. In some embodiments, the ratio of the maximum outside diameter MOD of the adjustment portion 320 to the lateral width W of the support member 12D is at least about: 1.005, 1.01, 1.05, 1.07, 1.09, 1.10, 1.20, values between the aforementioned values, or other values. In some embodiments, the adjustment portion 320 can rotate about an axis that is generally parallel with an axis that passes through front and rear walls of the support member 12D. In some variants, the adjustment portion 320 can rotate about an axis that is generally perpendicular with a longitudinal (e.g., vertical) axis of the support member 12D and/or generally perpendicular with a lateral (e.g., side-to-side) axis of the support member 12D.

As shown in FIGS. 38*a* and 39, the adjustment portion 320 can include gripping features, such as ribs, ridges, knurling, etc. In some variants, only the gripping features extend outward of the lateral width of the support member 12D. In certain implementations, the ratio of the nominal outside diameter NOD (e.g., not including the gripping features) of the adjustment portion 320 to the lateral width W of the support member 12D is at least about: 1.01, 1.02, 1.04, 1.06, 1.10, 1.20, values between the aforementioned values, or other values.

As shown in FIG. 39, the support member 12D can include an engaging portion 12Da, such as a track. In some embodiments, the engaging portion extends generally parallel with a longitudinal axis of the support member 12D. In certain variants, the engaging portion 12Da is on a rear of the support member 12D and/or is generally or completely obscured from view from a front elevation and/or side elevation vantage point. The engaging portion 12Da can be configured to engage with the clamping mechanism 14D, as is discussed in more detail below.

Figure 40A:
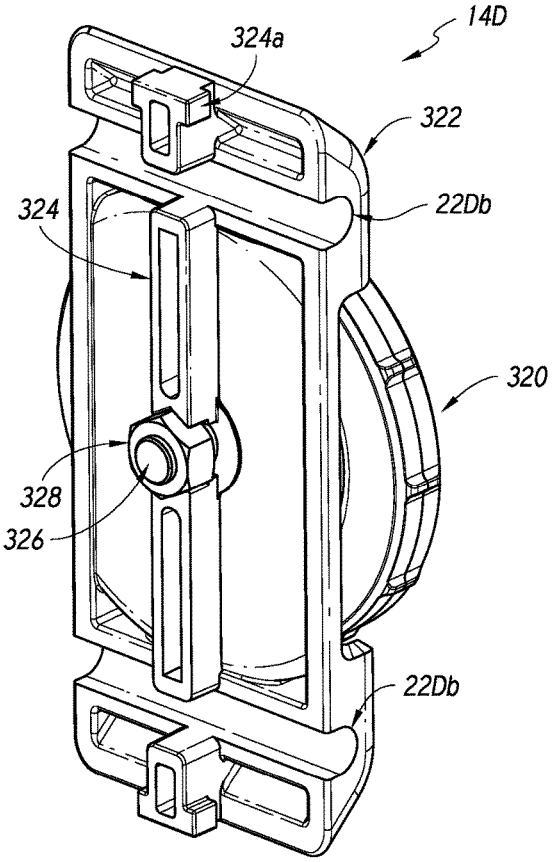
FIG. 40*a-c* are various views of a clamp unit of the shower caddy of FIG. 36.
Figure 40B:
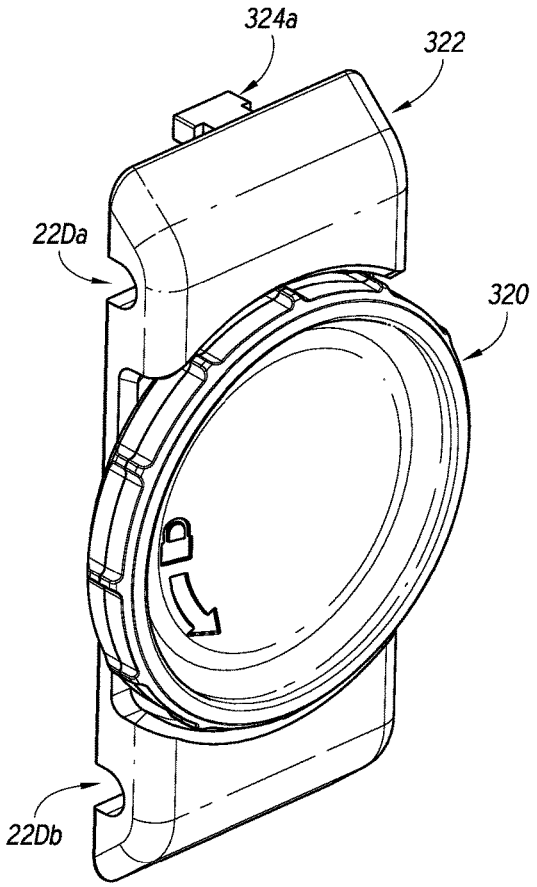
Figure 40C:
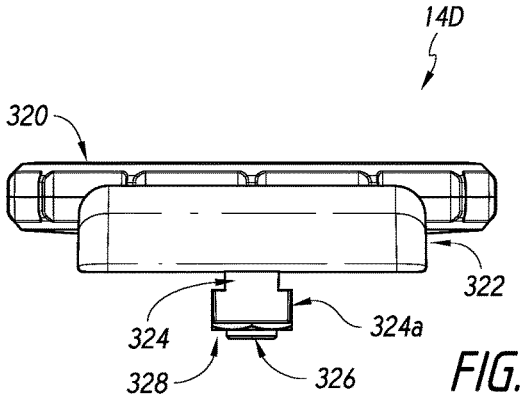

An example of the clamping mechanism 14D is illustrated in FIGS. 40*a*-40*c*. The clamping mechanism 14D can include the adjustment portion 320, such as a dial or lever, and a base portion 322. The base portion 322 can include have upper and lower shoulders 22Da, 22Db, such as rounded portions that are shaped to receive cross members 30D of the shelf 16D. The base portion 322 can include an engaging portion 324, such as a projection or rail, which can include a laterally extending flange 324*a*. As shown, the clamping mechanism 14D can include securing members, such as a bolt 326 and nut 328. In some implementations, the adjustment portion 320 is rigidly connected with the bolt 326 and/or the clamping mechanism 14D is configured such that rotation of the adjustment portion 320 moves the bolt 326 relative to the nut 328. As is also shown, some embodiments include indicia, such an indicator (e.g., a symbol and/or an arrow) of a direction to actuate the adjustment portion 320 to secure the clamping mechanism 14D.

Figure 41:
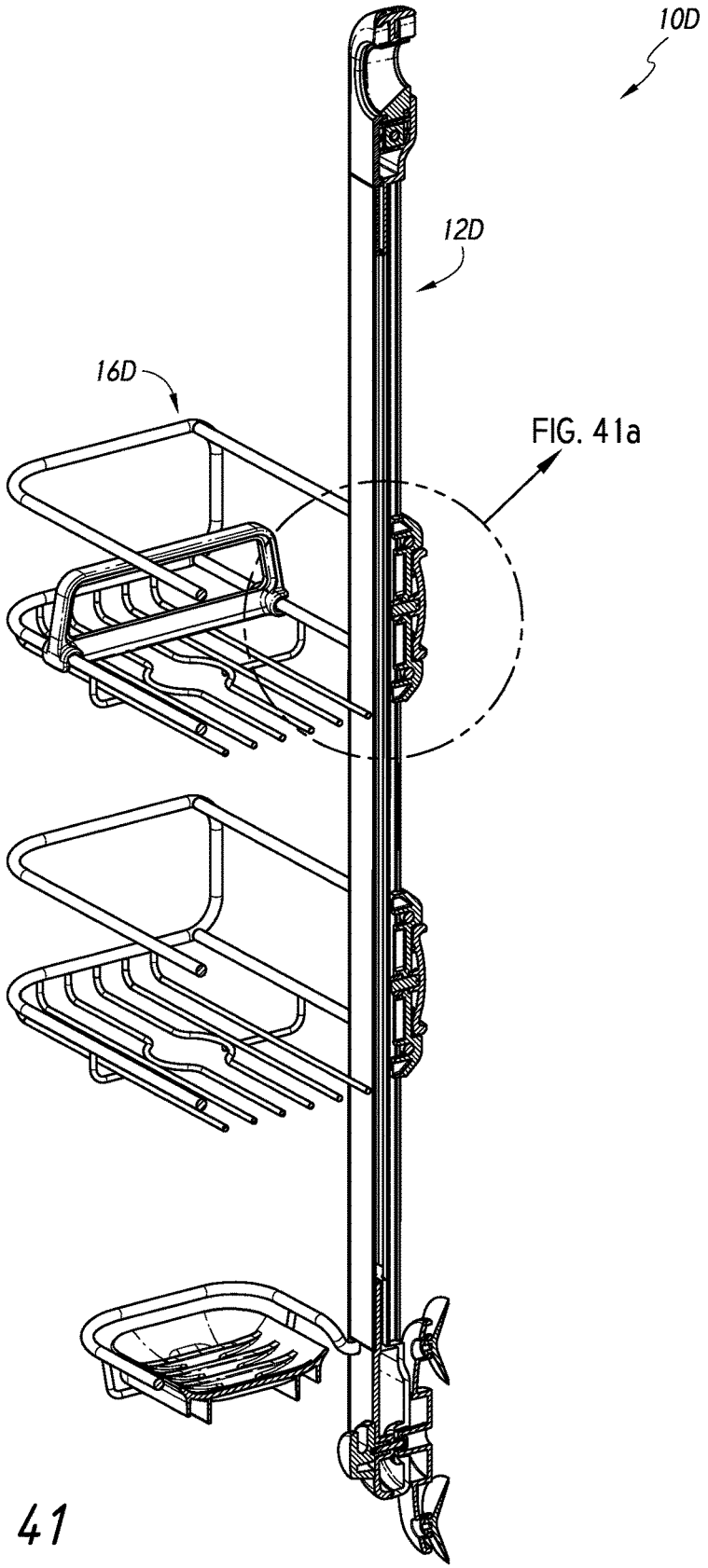
FIG. 41 is a top, front perspective cross-sectional view of the shower caddy of FIG. 36.
Figure 41A:
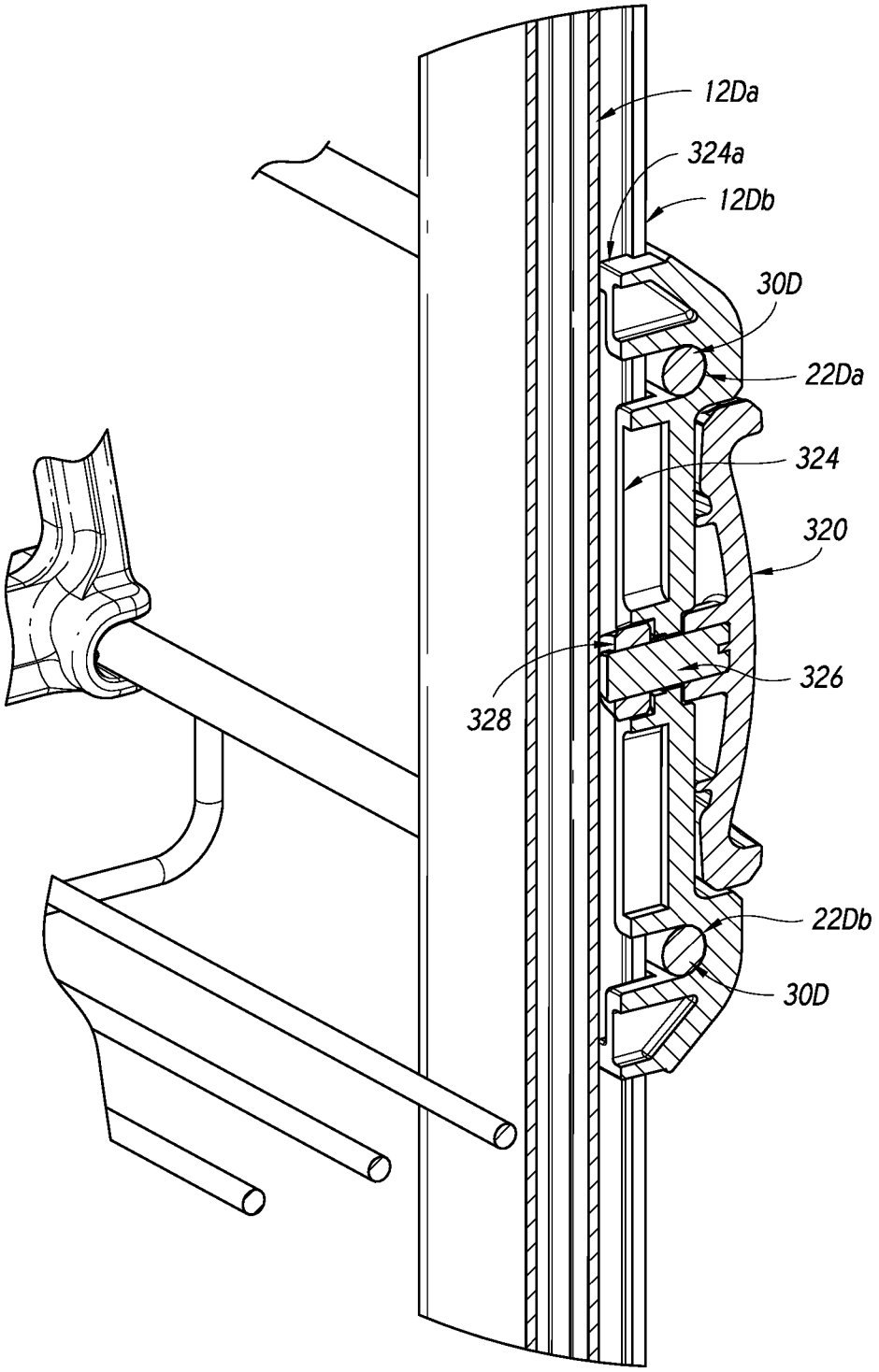
FIG. 41*a* is an enlarged view of a portion of FIG. 41.
Figure 42:
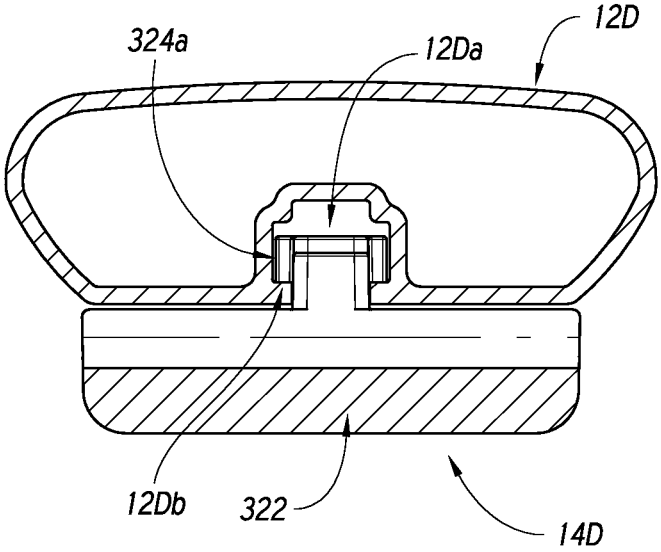
FIG. 42 is a cross-sectional view of a portion of a support member and a portion of a clamp mechanism of the shower caddy of FIG. 36.
Figure 43:
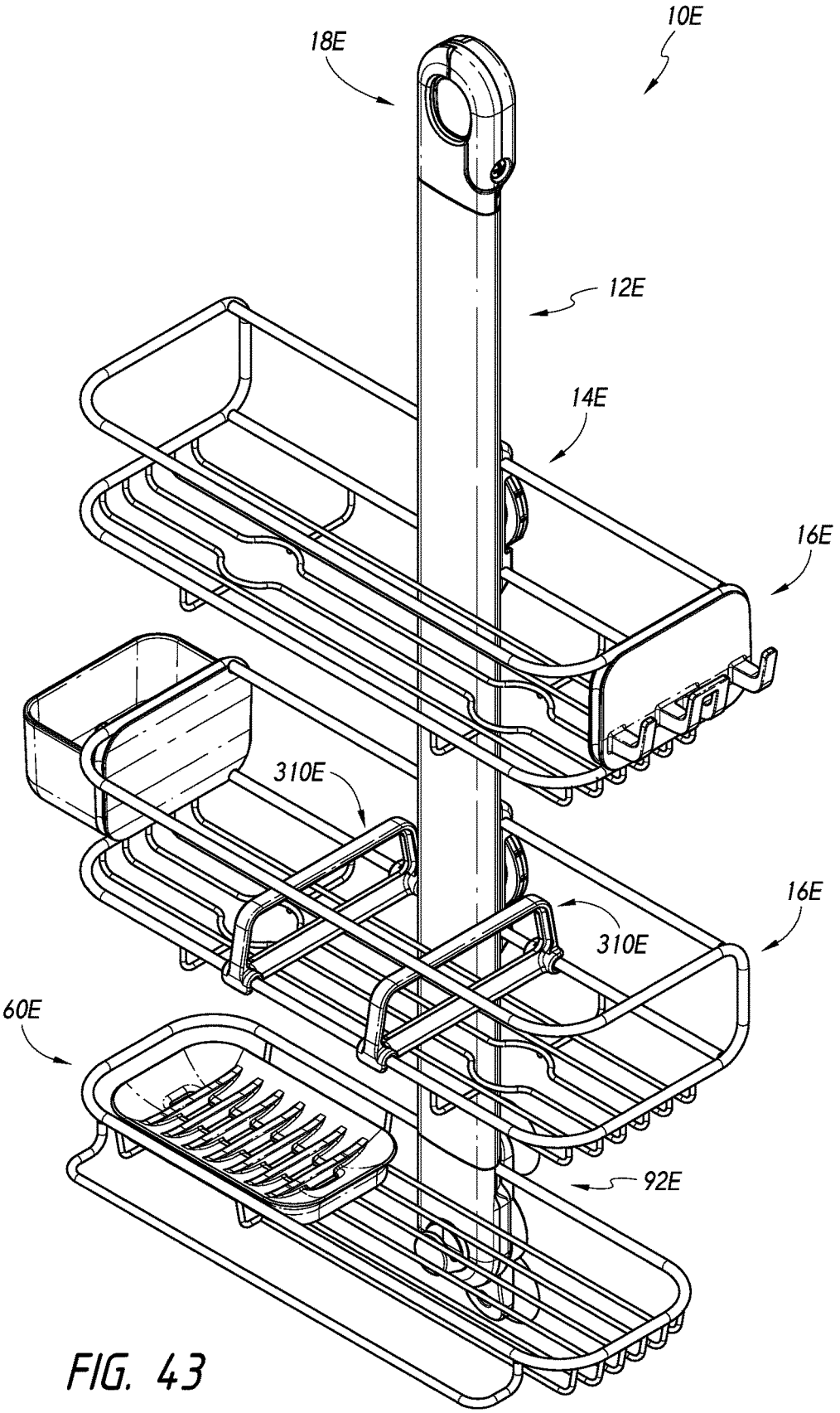
FIG. 43 is a top, front perspective view of another embodiment of a shower caddy.
Figure 44:
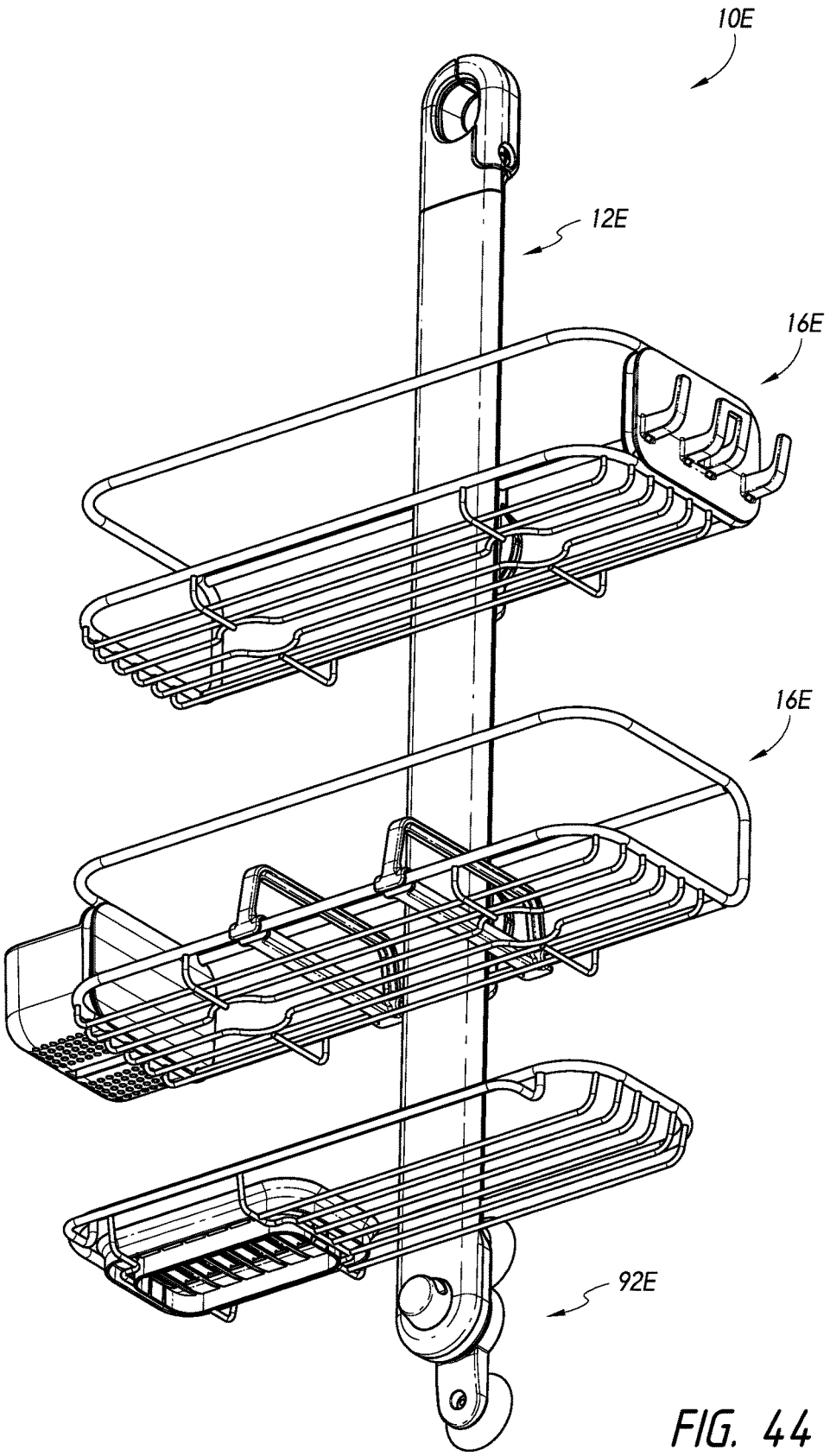
FIG. 44 is a bottom, front perspective view of the shower caddy of FIG. 43.
Figure 45:
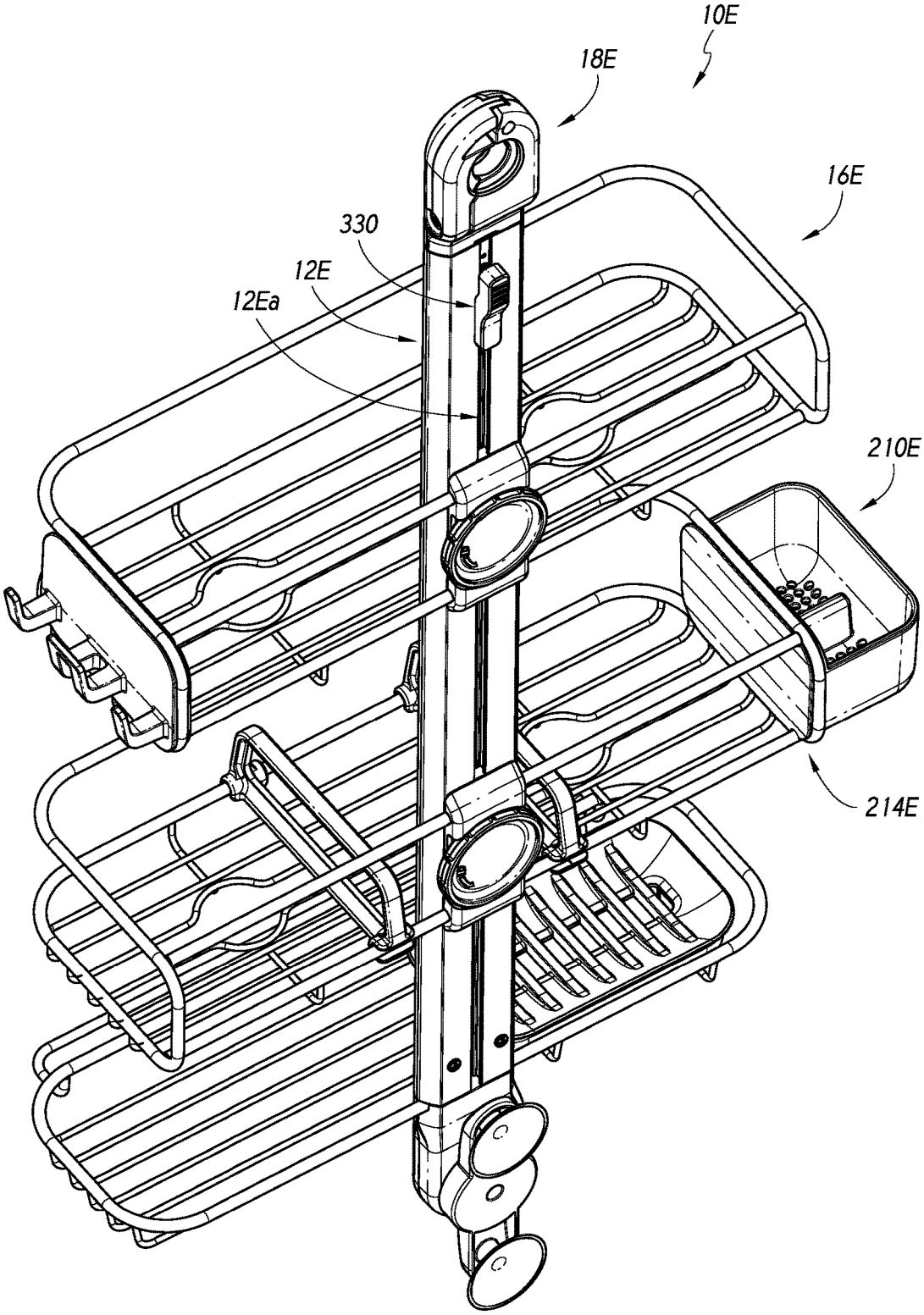
FIG. 45 is a top, rear perspective view of the shower caddy of FIG. 43.

Certain interactions between the clamping mechanism 14D and the support member 12D are shown in the cross-sectional views of FIGS. 41, 41*b*, and 42. As shown, the engaging portion 324 (e.g., rail) of the base portion 322 of the clamping mechanism 14D is configured to engage with (e.g., be received in) the engaging portion 12Da (e.g., track) of the support member 12D. As also shown, the flange 324*a* of the engaging portion 324 can engage a corresponding flange 12Db of the support member 12D, which can inhibit or prevent the clamping mechanism 14D from disengaging from the track 12Da. In some embodiments, the engaging portions 12Da, 324 have corresponding cross-sectional shapes. For example, both can have a generally "T"-shaped cross section (e.g., a shape with an outline comprising two generally perpendicular portions).

The shower caddy 10D can be configured such that actuating (e.g., rotating) the adjustment portion 320 (e.g., dial) secures the clamping mechanism 14D and/or the shelf 16D to the support member 12D. For example, in the embodiment illustrated, rotation of the dial 320 tightens the bolt 326 in the nut 328, which results in force being applied from the dial 320 to the base portion 322. The force is applied through the flange 324*a* of base portion 322 and against the corresponding flange 12Db of the support member 12D, thereby clamping the clamping mechanism 14D and/or the shelf 16D to the support member 12D. In some implementations, a portion of the force is applied from the base portion 322, through the support 30D of the shelf 16D, and against a rear wall of the support member 12D. This can facilitate securing the shelf 16D to the support member 12D, such as by clamping the support 30D of the shelf 16D between the support member 12D and the base portion 322 of the clamping mechanism 14D.

The shower caddy 10D can be configured such that the clamping mechanism 14D can be loosened to allow adjustment. For example, actuation of the adjustment portion 320 (e.g., dial) can be reversed (e.g., rotated in the opposite direction) to decrease or remove the securement of the clamping mechanism 14D and/or the shelf 16D to the support member 12D. In some embodiments, in the loosened state, the clamping mechanism 14D and the shelf 16D can move relative to the support member 12D. For example, the clamping mechanism 14D can slide generally vertically along the track 12Da. In certain implementations, in the loosened state, the shelf 16D can move relative to the clamping mechanism 14D and the support member 12D, such as by the supports 30D sliding generally horizontally along the shoulders 22Da, 22Db.

FIGS. 43-46*a*

FIGS. 43-46*a* illustrate another embodiment of a shower caddy 10E. In many respects, the shower caddy 10E resembles or is identical to any of the shower caddies 10-10D discussed above. Components of the shower caddy 10E that are the same or similar to the corresponding components of the shower caddy 10, 10A, 10B, 10C, and/or 10D are identified below with the same reference numerals except that a letter "E" has been added thereto. The shower caddy 10E can include one, some, or all of the features of the shower caddy 10, 10A, 10B, 10C, and/or 10D, including all combinations and sub-combinations. Any component or step disclosed in any embodiment in this specification can be used in any other embodiment.

The shower caddy 10E can include an elongated support member 12E and at least one shelf 16E. As shown, the support member 12E can include an engaging portion 12Ea, such as a groove or track. Some embodiments of the shower caddy 10E have an openable loop mechanism 18E that is configured to support the weight of the shower caddy 10E, such as from a shower head (not shown) or a pipe leading to a shower head. Certain embodiments have an attachment mechanism 92E that is configured to secure the shower caddy 10E to a shower wall. Some embodiments include a container 210E, which can be connected with a support structure 214E that is engaged with the shelf 16E. In certain embodiments, the support member 12E can telescope. For example, support member 12E can include a first (e.g., outer) portion 12E' and a second (e.g., inner) portion 12E" that can be received in, and slide relative to, the outer portion 12E'.

Figure 46:
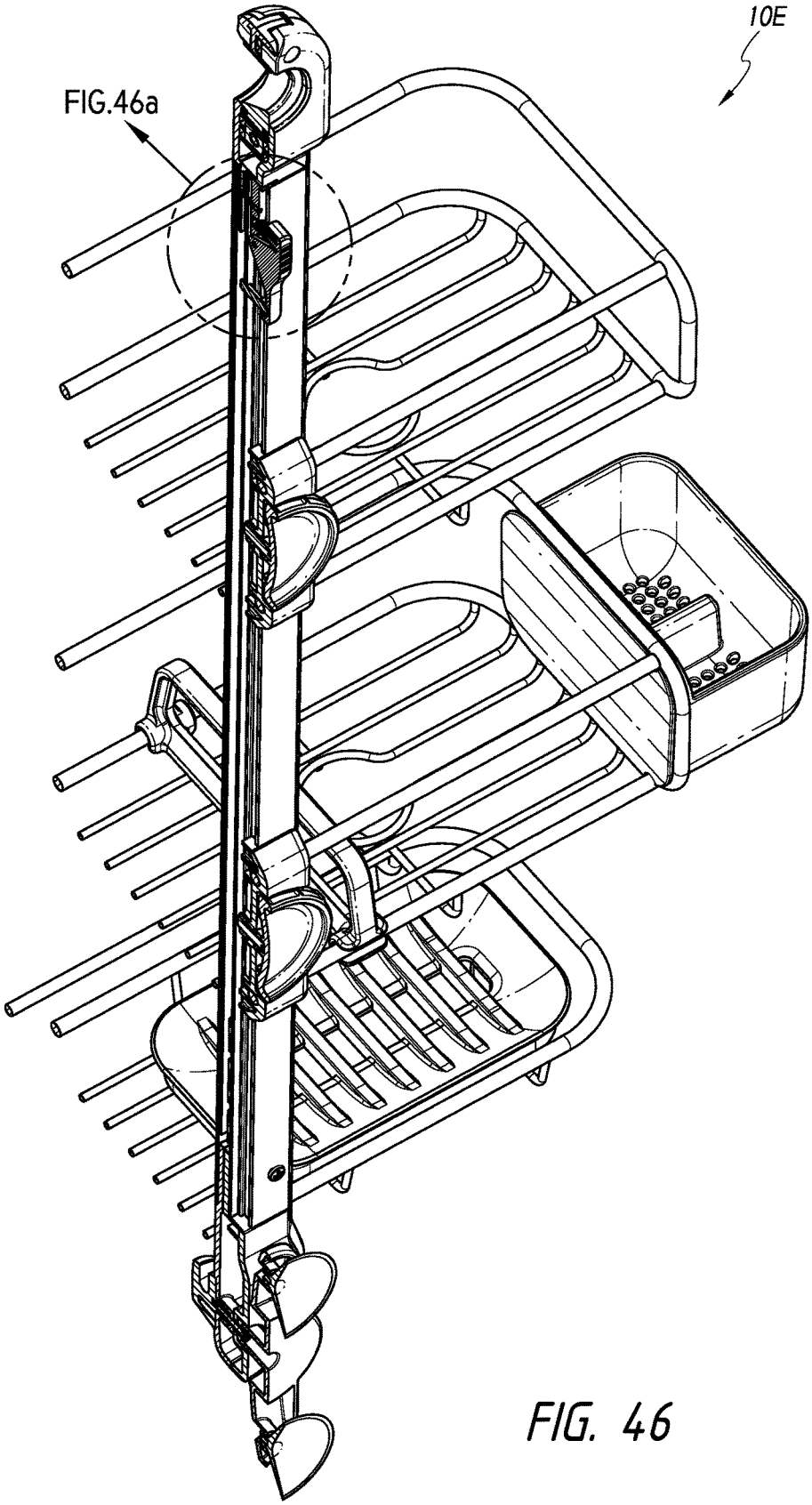
FIG. 46 is a top, front perspective cross-sectional view of the shower caddy of FIG. 43.
Figure 46A:
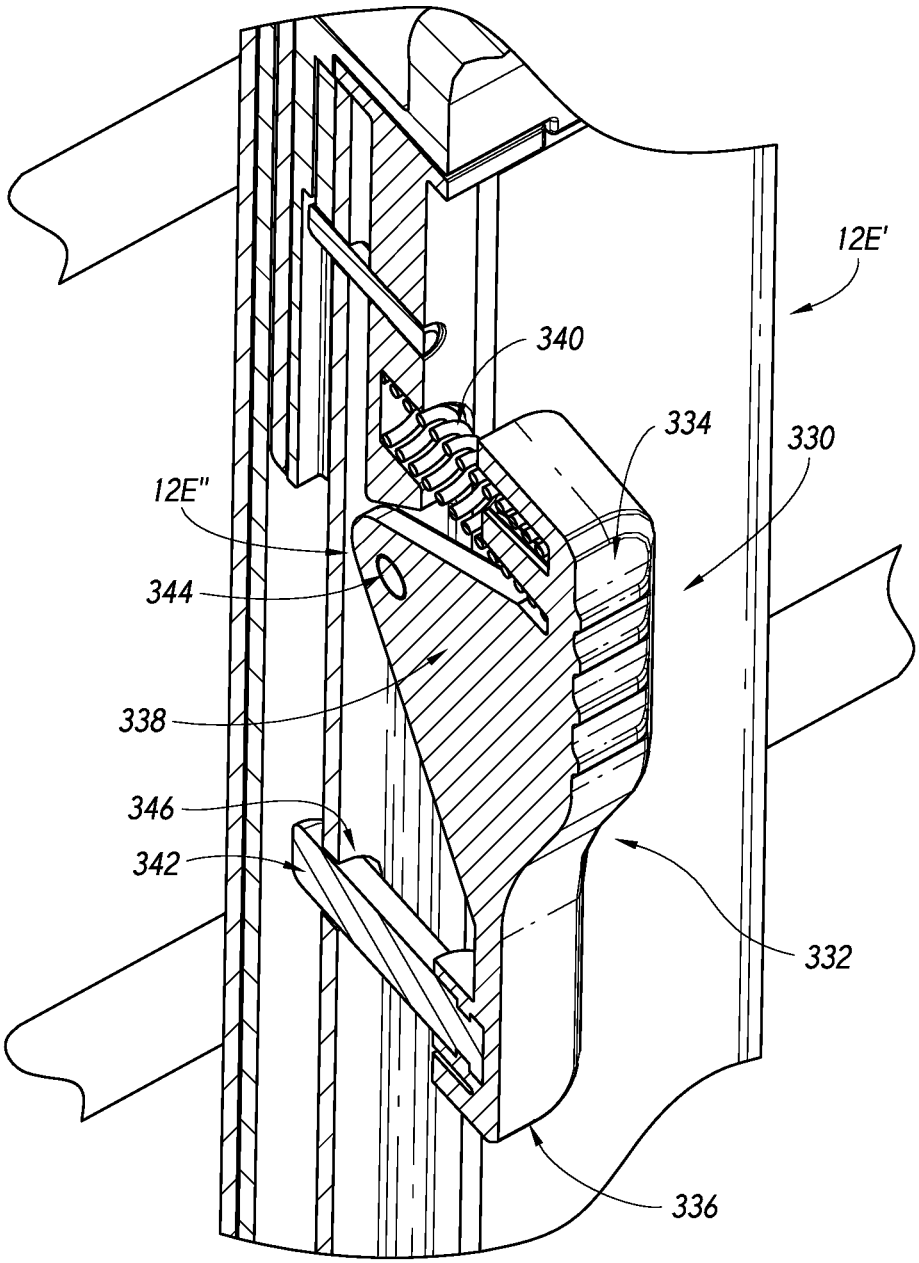
FIG. 46*a* is an enlarged view of a portion of FIG. 46.

In some embodiments, the shower caddy 10E includes a length adjustment assembly 330. The length adjustment assembly 330 can be configured to adjust the length of the support member 12E. As shown in FIG. 46*a*, the length adjustment assembly 330 can include an actuation member 332, such as a rocking and/or depressible element (e.g., a button). The actuation member 332 can include a first end 334, a second end 336, and a body 338. The first end 334 can be biased by a biasing member (e.g., a spring) 340. The second end 336 can connect with a projection or elongate member, such as a pin 342. The body 338 can be pivotably connected with a pivot element 344 (e.g., a pin), which can be connected with the support member 12E.

As shown, in a non-actuated state, the pin 342 can be engaged with an opening 346 in the second portion 12E" of the support member 12E. This can provide an interference that secures the portions 12E', 12E" of the support member 12E relative to each other, which can inhibit or prevent the portions 12E', 12E" from translating relative to each other and/or can aid in maintaining a desired length of the support member 12E. In various embodiments, maintaining the pin 342 in the opening 346 is aided by the bias of the biasing member 340. For example, the biasing member 340 can apply rearward force to the first end 334 of the actuation member 332, which the pivot 344 translates into frontward force on the second end 336 and the pin 342, thereby pressing the pin 342 toward the front of the caddy 10E and/or further into the opening 346.

In some embodiments, the length of the support member 12E can be adjusted by actuating the actuating member 332, such as by frontwardly depressing the first end 334 of the actuation member 332. This can move the first end 334 against the bias of the biasing member 340 and/or can pivot the actuation member 332 about the pivot element 344, which in turn can move the second end 336 and the pin 342 rearwardly. In some embodiments, such movement of the pin 342 disengages the pin 342 from the opening 346 in the second portion 12E" of the support member 12E. This can allow the second portion 12E" to slide relative to the first portion 12E', thereby allowing a change in the length of the support member 12E. In some embodiments, the second portion 12E" includes a plurality of the openings 346 along its length. This can allow a user to select and set a variety of lengths for the support member 12E. In various embodiments, after the actuating member 332 is released, the bias of the biasing member 340 pushes the pin 342 into the opening 346, thereby resecuring the portions 12E', 12E" of the support member 12E relative to each other.

In some embodiments, the length adjustment assembly 330 is similar or identical in structure and/or operation to the clamping mechanism 14D discussed above. The length adjustment assembly 330 can include any one, or any combination, of the features of the clamping mechanism 14D. In certain implementations, the actuation member 332 of the length adjustment assembly 330 includes a rotatable member, such as a dial. The dial can be configured to allow a user to vary the length of the support member 12E and/or to maintain a desired length of the support member 12E. For example, the dial can be configured to adjust the ability of the portions 12E', 12E" to move (e.g., slide) relative to each other, such as by increasing or decreasing the amount of friction on one or both of the portions 12E', 12E". In certain variants, the dial connects with a threaded member, such as a screw, that can be adjusted to increase or decrease the amount of friction on a flange or other surface of one or both of the portions 12E', 12E". In various embodiments, the actuation member 332 is on the rear of the shower caddy 10E and/or is generally obscured from the vantage of a front elevation view of the shower caddy 10E. In some embodiments, the actuation member 332 extends laterally outward of one or both lateral sides of the support member 12E.

Certain Terminology

Terms of orientation used herein, such as "top," "bottom," "horizontal," "vertical," "longitudinal," "lateral," and "end" are used in the context of the illustrated embodiments. However, this disclosure should not be limited to the illustrated orientation. Other orientations are possible and are within the scope of this disclosure.

Terms relating to circular shapes as used herein, such as diameter or radius, should be understood not to require perfect circular structures, but rather should be applied to any suitable structure with a cross-sectional region that can be measured from side-to-side. Terms relating to shapes generally, such as "circular" or "cylindrical" or "semi-circular" or "semi-cylindrical" or any related or similar terms, are not required to conform strictly to the mathematical definitions of circles or cylinders or other structures, but can encompass structures that are reasonably close approximations.

Conditional language, such as "can," "could," "might," or "may," unless specifically stated otherwise, or otherwise understood within the context as used, is generally intended to convey that certain embodiments include or do not include, certain features, elements, and/or steps. Thus, such conditional language is not generally intended to imply that features, elements, and/or steps are in any way required for one or more embodiments.

Conjunctive language, such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

The terms "approximately," "about," and "substantially" as used herein represent an amount close to the stated amount that still performs a desired function or achieves a desired result. For example, in some embodiments, as the context may dictate, the terms "approximately", "about", and "substantially" may refer to an amount that is within less than or equal to 10% of the stated amount. The term "generally" as used herein represents a value, amount, or characteristic that predominantly includes or tends toward a particular value, amount, or characteristic. For example, in certain embodiments, as the context may dictate, the term "generally parallel" can refer to something that departs from exactly parallel by less than or equal to 20 degrees and the term "generally perpendicular" can refer to something that departs from exactly perpendicular by less than or equal to 20 degrees.

Unless otherwise explicitly stated, articles such as "a" or "an" should generally be interpreted to include one or more described items. Accordingly, phrases such as "a device configured to" are intended to include one or more recited devices. Such one or more recited devices can also be collectively configured to carry out the stated recitations. For example, "a device configured to carry out recitations A, B, and C" can include a first device configured to carry out recitation A working in conjunction with a second device configured to carry out recitations B and C.

The terms "comprising," "including," "having," and the like are synonymous and are used inclusively, in an open-ended fashion, and do not exclude additional elements, features, acts, operations, and so forth. Likewise, the terms "some," "certain," and the like are synonymous and are used in an open-ended fashion. Also, the term "or" is used in its inclusive sense (and not in its exclusive sense) so that when used, for example, to connect a list of elements, the term "or" means one, some, or all of the elements in the list.

Overall, the language of the claims is to be interpreted broadly based on the language employed in the claims. The language of the claims is not to be limited to the non-exclusive embodiments and examples that are illustrated and described in this disclosure, or that are discussed during the prosecution of the application.

Summary

Various shelving systems have been disclosed. Although the shelving systems have been disclosed in the context of certain embodiments and examples (e.g., the shower caddies 10-10E), the shelving systems extend beyond the specifically disclosed embodiments to other alternative embodiments and/or uses of the embodiments and certain modifications and equivalents thereof. For example, although the illustrated embodiment of the shower caddies have two or three shelves, the shower caddy may have only one shelf, more than three shelves, or even no shelves. As another example, although the illustrated embodiments have shelves having certain configurations, the shelves may have different configurations. Various features and aspects of the disclosed embodiments can be combined with or substituted for one another in order to form varying modes of the conveyor. The scope of this disclosure should not be limited by the particular disclosed embodiments described herein.

Certain features that are described in this disclosure in the context of separate implementations can also be implemented in combination in a single implementation. Conversely, various features that are described in the context of a single implementation can also be implemented in multiple implementations separately or in any suitable subcombination. Although features may be described above as acting in certain combinations, one or more features from a claimed combination can, in some cases, be excised from the combination, and the combination may be claimed as any subcombination or variation of any subcombination.

Some embodiments have been described in connection with the accompanying drawings. The figures are drawn to scale, but such scale should not be limiting, since dimensions and proportions other than what are shown are contemplated and are within the scope of the disclosed invention. Distances, angles, etc. are merely illustrative and do not necessarily bear an exact relationship to actual dimensions and layout of the devices illustrated. Components can be added, removed, and/or rearranged. Further, the disclosure herein of any particular feature, aspect, method, property, characteristic, quality, attribute, element, or the like in connection with various embodiments can be used in all other embodiments set forth herein. Additionally, it will be recognized that any methods described herein may be practiced using any device suitable for performing the recited steps.

In summary, various embodiments and examples of shelving systems have been disclosed. Although the shelving systems have been disclosed in the context of those embodiments and examples, this disclosure extends beyond the specifically disclosed embodiments to other alternative embodiments and/or other uses of the embodiments, as well as to certain modifications and equivalents thereof. This disclosure expressly contemplates that various features and aspects of the disclosed embodiments can be combined with, or substituted for, one another. Accordingly, the scope of this disclosure should not be limited by the particular disclosed embodiments described above, but should be determined only by a fair reading of the claims that follow.

The following is claimed:

1. A shower caddy having a longitudinal axis, a lateral axis, and a front-to-rear axis, the shower caddy comprising:

a connection mechanism configured to couple with a pipe and to support the weight of the shower caddy from the pipe;

an elongate support member connected with the connection mechanism and extending downward from the connection mechanism along the longitudinal axis, the elongate support member having a front wall, rear wall, and lateral sidewalls, the rear wall including a track that extends generally parallel with the longitudinal axis;

a shelf comprising a shelving area configured to support bathing implements, the shelf coupled with the elongate support member via a clamping mechanism;

the clamping mechanism positioned on the rear of the shower caddy and comprising:

a dial configured to rotate about an axis that is generally parallel with the front-to-rear axis of the shower caddy; and a body portion comprising a rail that is received in the track in the rear wall of the elongate support member, the rail configured to apply pressure to the track; and the clamping mechanism configured to be:

rotated in a first direction to increase the amount of pressure applied by the rail to the track to put the clamping mechanism in a tightened state, thereby rendering the shelf generally fixed with respect to the support member; and rotated in a second direction to decrease the amount of pressure applied by the rail to the track to put the clamping mechanism in a loosened state, thereby enabling the shelf to be moved in a direction generally parallel with the longitudinal axis and in a direction generally parallel with the lateral axis of the shower caddy.

2. The shower caddy of claim 1, wherein the rail and the track have substantially corresponding cross-sectional shapes.

3. The shower caddy of claim 1, wherein the dial extends laterally outward of the elongate support member.

4. The shower caddy of claim 1, wherein the dial has a maximum outside diameter, the elongate support member has a lateral width, and the ratio of the maximum outside diameter to the lateral width is at least about 1.05.

5. The shower caddy of claim 1, wherein the dial has a nominal outside diameter, the elongate support member has a lateral width, and the ratio of the nominal outside diameter to the lateral width is at least about 1.02.

6. The shower caddy of claim 1, wherein the clamping mechanism does not extend into the shelving area.

7. The shower caddy of claim 1, wherein the clamping mechanism is substantially obscured from view from a front elevation view of the shower caddy.

8. An adjustable bathroom shelving system comprising:

an elongate support member having a front wall, a rear wall, and lateral sidewalls, the rear wall including a first engaging portion that comprises a track in the elongate support member;

a clamping mechanism having an adjustment portion and a body portion, wherein:

the adjustment portion is configured to enable a user to selectively move the clamping mechanism between secured and unsecured states; and the body portion has a second engaging portion that comprises a projection on the body portion, the second engaging portion matingly engaged with the first engaging portion and configured such that:

when the clamping mechanism is in the secured state, the clamping mechanism is generally rigidly secured with the elongate support member; and when the clamping mechanism is in the unsecured state, the clamping mechanism is slidable along the first engaging portion of the rear wall of the elongate support member; and a shelf coupled with the clamping mechanism and on the front wall of the elongate support member, the shelf comprising a shelving area configured to support bathing implements.

9. The shelving system of claim 8, wherein the elongate support member is configured to press against the floor and ceiling in a shower or bathtub with sufficient force to anchor the shelving system in position.

10. The shelving system of claim 8, wherein the adjustment portion comprises a rotatable dial.

11. The shelving system of claim 8, wherein the clamping mechanism does not engage with the front wall of the elongate support member.

12. The shelving system of claim 8, wherein the first engaging portion and the second engaging portion have corresponding cross-sectional shapes.

13. The shelving system of claim 12, the first engaging portion and the second engaging portion have generally "T"-shaped cross-sectional shapes.

14. The shelving system of claim 8, wherein the adjustment portion extends laterally outward of the elongate support member.

15. The shelving system of claim 8, wherein the clamping mechanism does not extend into the shelving area.

16. The shelving system of claim 8, wherein the clamping mechanism is substantially obscured from view from a front elevation view of the shower caddy.

17. The shelving system of claim 8, wherein, from a front elevation view of the shower caddy, at least about 95% of the total surface area of the adjustment portion is obscured from view.

18. The shelving system of claim 8, wherein the elongate support member further comprises:

an outer portion;

an inner portion received in, and configured to slide relative to, the outer portion; and a length adjustment mechanism comprising an actuator, the length adjustment mechanism configured such that actuation of the actuator removes an interference between the outer and inner portions, thereby enabling the inner and outer portions to slide relative to each other to facilitate changing of the length of the elongate support member.

19. The shelving system of claim 18, wherein the actuator comprises a button biased by a spring.

20. The shelving system of claim 8, further comprising a divider assembly comprising:

a support structure secured to the shelf; and a rotatable divider configured to rotatably engage the support structure and to move between a retracted position and an extended position;

wherein, in the extended position, the rotatable divider, the support structure, and the shelf form an enclosure for holding bathing implements.

21. The shelving system of claim 20, wherein the rotatable divider comprises three sections, each extending along a plane, the planes of the first and third sections being generally parallel to each other, the plane of the second section being generally perpendicular to the planes of the first and third sections.

22. The shelving system of claim 20, wherein the support structure comprises at least one detent configured to support the rotatable divider when the rotatable divider is in the extended position.

23. The shelving system of claim 8, further comprising an expandable container secured to the shelf, the expandable container comprising:

an internal space for receiving and storing bathing implements;

a top end with an opening configured to allow bathing implements to be inserted into the space; and a bottom end configured to resiliently move between a collapsed position and an expanded position;

wherein the height of the container is greater when the container is in the expanded position than when the container is in the collapsed position.

24. The shelving system of claim 23, wherein the bottom end comprises baffles and is configured to move between the expanded and collapsed positions in an accordion-like manner.

25. The shelving system of claim 23, wherein the bottom end comprises at least one of a thermoplastic material, a silicone material, or a rubber material.

26. The shelving system of claim 23, further comprising a generally vertical wall that divides a portion of the internal space of the expandable container.

27. The shelving system of claim 8, wherein the shelving system is a shower caddy.

28. The shelving system of claim 8, further comprising an openable loop mechanism at an upper end of the elongate support member, the openable loop mechanism configured to engage a pipe to enable the shelving system to hang from the pipe.

29. A method of manufacturing a shower caddy, the method comprising:

obtaining an elongate support member having a front wall, a rear wall, and lateral sidewalls, the rear wall comprising a longitudinally extending track with a flange;

obtaining a clamping mechanism having an adjustment portion and a body portion, the body portion comprising a rail with a flange;

engaging the clamping mechanism with a support member of a shelf, the shelf comprising a shelving area configured to support bathing implements;

receiving the rail of the clamping mechanism in the longitudinally extending track in the rear wall of the elongate support member; and either:

adjusting the adjustment portion of the clamping mechanism until the flange of the rail of the body portion of the clamping mechanism applies sufficient force to the flange of the longitudinally extending track of the elongate support member such that the clamping mechanism and the shelf are fixed with respect to the elongate support member; or adjusting the adjustment portion of the clamping mechanism until the flange of the rail of the body portion of the clamping mechanism applies substantially no force to the flange of the longitudinally extending track of the elongate support member, thereby enabling the shelf to be moved in a direction generally parallel with a longitudinal axis of the shower caddy and in a direction generally parallel with a lateral axis of the shower caddy.

30. The method of claim 29, wherein adjusting the adjustment portion of the clamping mechanism comprising rotating the adjustment portion about an axis that is generally parallel with a front-to-rear axis of the shower caddy.

31. The method of claim 29, wherein adjusting the adjustment portion of the clamping mechanism does not include flipping a lever.

32. The method of claim 29, wherein adjusting the adjustment portion of the clamping mechanism does not include extending the adjustment portion into the shelving area.

33. An adjustable bathroom shelving system comprising:

an elongate support member comprising:

a front wall;

a rear wall including a first engaging portion;

lateral sidewalls;

an outer portion;

an inner portion received in, and configured to slide relative to, the outer portion; and a length adjustment mechanism comprising an actuator, the length adjustment mechanism configured such that actuation of the actuator removes an interference between the outer and inner portions, thereby enabling the inner and outer portions to slide relative to each other to facilitate changing of the length of the elongate support member; and a clamping mechanism having an adjustment portion and a body portion, wherein:

the adjustment portion is configured to enable a user to selectively move the clamping mechanism between secured and unsecured states; and the body portion has a second engaging portion, the second engaging portion matingly engaged with the first engaging portion and configured such that:

when the clamping mechanism is in the secured state, the clamping mechanism is generally rigidly secured with the elongate support member; and when the clamping mechanism is in the unsecured state, the clamping mechanism is slidable along the first engaging portion of the rear wall of the elongate support member; and a shelf coupled with the clamping mechanism and on the front wall of the elongate support member, the shelf comprising a shelving area configured to support bathing implements.

34. The shelving system of claim 33, wherein the adjustment portion comprises a rotatable dial.

35. The shelving system of claim 33, wherein the adjustment portion extends laterally outward of the elongate support member.

36. The shelving system of claim 33, wherein the clamping mechanism does not engage with the front wall of the elongate support member.

37. The shelving system of claim 33, wherein the clamping mechanism does not extend into the shelving area.

38. The shelving system of claim 33, wherein the clamping mechanism is substantially obscured from view from a front elevation view of the shower caddy.

39. The shelving system of claim 33, wherein, from a front elevation view of the shower caddy, at least about 95% of the total surface area of the adjustment portion is obscured from view.

40. The shelving system of claim 33, wherein the elongate support member is configured to press against the floor and ceiling in a shower or bathtub with sufficient force to anchor the shelving system in position.

* * * * *